US008586918B2

(12) United States Patent
Brucker et al.

(10) Patent No.: US 8,586,918 B2
(45) Date of Patent: Nov. 19, 2013

(54) ELECTROSTATIC ION TRAP

(75) Inventors: Gerardo A. Brucker, Longmont, CO (US); Kenneth D. Van Antwerp, Colorado Springs, CO (US); G. Jeffery Rathbone, Longmont, CO (US); Scott C. Heinbuch, Fort Collins, CO (US); Michael N. Schott, Loveland, CO (US); Barbara Jane Hinch, Edison, NJ (US); Alexei V. Ermakov, Highland Park, NJ (US)

(73) Assignee: Brooks Automation, Inc., Chelmsford, MA (US)

( * ) Notice: Subject to any disclaimer, the term of this patent is extended or adjusted under 35 U.S.C. 154(b) by 0 days.

(21) Appl. No.: 13/289,142

(22) Filed: Nov. 4, 2011

(65) Prior Publication Data

US 2012/0112056 A1 May 10, 2012

Related U.S. Application Data

(63) Continuation of application No. PCT/US2010/033750, filed on May 5, 2010.

(60) Provisional application No. 61/215,501, filed on May 6, 2009, provisional application No. 61/176,390, filed on May 7, 2009, provisional application No. 61/325,119, filed on Apr. 16, 2010, provisional application No. 61/329,163, filed on Apr. 29, 2010.

(51) Int. Cl.
*H01J 49/00* (2006.01)

(52) U.S. Cl.
USPC ..... 250/292; 250/281; 250/282; 250/283

(58) Field of Classification Search
USPC ..... 250/281–283, 292, 293
See application file for complete search history.

(56) References Cited

U.S. PATENT DOCUMENTS 2,570,158 A 10/1951 Schissel
3,107,295 A 10/1963 Tretner (Continued)

FOREIGN PATENT DOCUMENTS

DE 1448192 10/1968
DE 1448200 10/1968

(Continued)

OTHER PUBLICATIONS

Kouji, H., "Theory behind Farvitron Mass Spectrometer [online]," 1998, *M2*. [retrieved on Apr. 5, 2012] Retrieved from the Internet URL: www.ss.teen.setsunan.ac.jp/1996/hathene2.html. Original language of document is Japanese, Verification of Translation attached.

(Continued)

*Primary Examiner* — Michael Maskell
(74) *Attorney, Agent, or Firm* — Hamilton, Brook, Smith & Reynolds, P.C.

(57) ABSTRACT

An ion trap includes an electrode structure, including a first and a second opposed mirror electrodes and a central lens therebetween, that produces an electrostatic potential in which ions are confined to trajectories at natural oscillation frequencies, the confining potential being anharmonic. The ion trap also includes an AC excitation source having an excitation frequency f that excites confined ions at a frequency of about twice the natural oscillation frequency of the ions, the AC excitation frequency source preferably being connected to the central lens. In one embodiment, the ion trap includes a scan control that mass selectively reduces a frequency difference between the AC excitation frequency and about twice the natural oscillation frequency of the ions.

52 Claims, 47 Drawing Sheets

(56) References Cited

U.S. PATENT DOCUMENTS

| | | | | |
|---|---|---|---|---|
| 3,174,034 | A | 3/1965 | Behrisch et al. | |
| 3,226,543 | A | 12/1965 | Melzner | |
| 3,258,591 | A | 6/1966 | Blauth et al. | |
| 3,258,592 | A | 6/1966 | Blauth et al. | |
| 2004/0149903 | A1 | 8/2004 | Wang | |
| 2008/0111067 | A1 | 5/2008 | Glish et al. | |
| 2008/0121795 | A1 | 5/2008 | Sugiyama et al. | |
| 2010/0084549 | A1* | 4/2010 | Ermakov et al. | 250/283 |

FOREIGN PATENT DOCUMENTS

| | | | |
|---|---|---|---|
| DE | 1448201 | | 11/1968 |
| DE | 1498873 | | 4/1969 |
| EP | 1 298 700 | A2 | 4/2003 |
| KR | 10-2009-0010067 | | 1/2009 |
| KR | 10-2009-0010067 | A | 1/2009 |
| WO | WO 2006/008537 | A2 | 1/2006 |
| WO | WO 2007/072038 | A2 | 6/2007 |
| WO | WO 2008/063497 | | 5/2008 |
| WO | WO 2008/063497 | A2 | 5/2008 |

OTHER PUBLICATIONS

Kouji, H., "Design and Production of Simple Farvitron Mass Spectrometer [online]," 1998, *M2.* [retrieved on Mar. 29, 2012] Retrieved from the Internet URL: http://www.ss.teen.setsunan.ac.jp/1996/hatheme1.html. Original language of document is Japanese, Verification of Translation attached.

Sakuhin, "Sakuhin Collection 1997 [online]," [retrieved on Mar. 29, 2012] Retrieved from the Internet URL: http://www.ss.teen.setsunan.ac.jp/1997/sakuhin97.html. Original language of document is Japanese, Verification of Translation attached.

Blauth, "Dynamic mass spectrometers", Elsevier, Amsterdam, XP002503688, p. 58, last paragraph—p. 59; figure 45 (1966) (No month available).

Correa, J. R. and Ordonez, C. A., "Electrostatic Confinement of a Reflecting Ion Beam," *Non-Neutral Plasma Physics V: Workshop on Non-Neutral Plasmas,* AIP Conference Proceedings, vol. 692, pp. 246-251 (2003) (No month available).

Bhushna, K. G., et al., "A Fourier Transform Electrostatic Ion Trap for High-resolution Mass Spectrometry," *Proceedings of 12th ISMAS Symposium cum: Workshop on Mass Spectrometry,* IRP-1, 6 pp., (Mar. 25-30, 2007).

PCT International Search Report and PCT Written Opinion of the International Searching Authority, 14 pp., mailed Dec. 29, 2008.

PCT Notification Concerning Transmittal of International Preliminary Report on Patentability (Chapter I of the Patent Cooperation Treaty), PCT/US2007/023834, Mailed May 19, 2009, 7 pp.

Blauth, E.W., "Dynamic Mass Spectrometers," Elsevier Publishing Company (1966), pp. 124-134 (No month available).

Clifcorn, L.E., et al., edited by, Frank R. Fisher, "Freeze-Drying of Foods," *Proceedings of a Conference,* Advisory Board on Quartermaster Research and Development, National Academy of Sciences National Research Council (Apr. 12-14, 1961).

Elsey, R.J., "Outgassing of Vacuum Materials—I," Vacuum, 25(7): 299-306 (1975) (No month available).

Elsey, R.J., "Outgassing of Vacuum Materials—II," Vacuum, 25(8): 347-361 (1975) (No month available).

Huber, W.,K., "Partial Pressure Measurements in High and Ultra-High Vacuum Systems, Part I," *Vacuum,* 13:399-412 (1963) (No month available).

Leybold, Partial Pressure Indicator Farvitron®—Operating Instructions. (no date available).

Lichtman, D., "Perspective on Residual Gas Analysis," J. Vac. Sci. Technol. A 2(2): 200-205 (Apr.-Jun. 1984).

Reich, G., and Flecken, F., "Analysis of Partial Pressures by means of Omegatron and Farvitron, Comparative View of the Ranges of Application" *Vacuum,* 10(1-2):35-39 (1960) (No month available).

Tretner, W., "Session II—Methods of Measuring Residual Gases During the Manufacture and Life of Tubes—An Electrostatic Mass Spectroscope," *Vacuum,* 10(1-2):31-34 (No month available).

PCT Notification of Transmittal of the International Search Report and the Written Opinion of the International Searching Authority, or the Declaration, PCT/US2010/033750, Mailed Dec. 20, 2010.

PCT International Preliminary Report on Patentability (Chapter I of the Patent Cooperation Treaty), PCT/US2010/033750, Date of Issuance: Nov. 9, 2011, 8 pp.

Rozanov, L.N. "Electrical Methods of Measuring Partial Pressure" In *Vacuum Technique*, Hablanian, M.H., ed. (NY: Taylor & Francis), pp. 99-109 and 320 (2002).

* cited by examiner $Q_A$ = Charge for gas A
$Q_B$ = Charge for gas B
$X_{AB}$ = Weighting Factor $$\frac{Q_B}{Q_A} = \frac{PP_B \bullet X_{AB}}{PP_A}$$

$PP_A$ = partial pressure, gas A
$PP_B$ = partial pressure, gas B $$X_{AB} = \frac{\text{Ionization Efficiency gas B}}{\text{Ionization Efficiency gas A}}$$

$P_T$ = the total pressure reported by ionization gauge $\alpha$ = sensitivity factor in Amps/Torr $$P_T = PP_A + X_{AB}PP_B$$

$$I_T = \underbrace{I_A}_{} + \underbrace{I_B}_{} = \alpha PP_A + X_{AB}\alpha PP_B$$

$$I_T = \alpha[PP_A + X_{AB}PP_B]$$

$$X_{AB} = \frac{\text{Ionization Efficiency gas B}}{\text{Ionization Efficiency gas A}}$$

$$P_T = I_T/\alpha = PP_A + X_{AB}PP_B$$

$$\frac{Q_B}{Q_A} = \frac{q_B}{q_A} = \frac{PP_B \bullet X_{AB}}{PP_A}$$

$Q_A$ = charge stored corresponding to concentration of gas A
$q_A$ = charge ejected corresponding to gas A
$Q_T$ = total charge in trap = $Q_A + Q_B$ = constant
$q_T$ = total charge ejected from the trap = $q_A + q_B$ $$P_T \cdot \frac{q_A}{q_T} = \left(PP_A + X_{AB} PP_B\right) \cdot \frac{q_A}{q_A + q_B} = \left(PP_A + X_{AB} PP_B\right) \cdot \frac{1}{1 + \frac{q_B}{q_A}} = \left(PP_A + X_{AB} PP_B\right) \cdot \frac{1}{1 + PP_B \frac{X_{AB}}{PP_A}} = \left(PP_A + X_{AB} PP_B\right) \cdot \frac{PP_A}{PP_A + PP_B X_{AB}} = PP_A$$

FIG. 36

ELECTROSTATIC ION TRAP

RELATED APPLICATIONS

This application is a continuation of International Application No. PCT/US2010/033750, which designated the United States and was filed on May 5, 2010, published in English, which claims the benefit of U.S. Provisional Application No. 61/215,501, filed on May 6, 2009, U.S. Provisional Application No. 61/176,390, filed on May 7, 2009, U.S. Provisional Application No. 61/325,119, filed on Apr. 16, 2010, and U.S. Provisional Application No. 61/329,163, filed on Apr. 29, 2010.

The entire teachings of the above applications are incorporated herein by reference.

BACKGROUND OF THE INVENTION

A mass spectrometer is an analytical instrument that separates and detects ions according to their mass-to-charge ratio. Mass spectrometers can be differentiated based on whether trapping or storage of ions is required to enable mass separation and analysis. Non-trapping mass spectrometers do not trap or store ions, and ion densities do not accumulate or build up inside the device prior to mass separation and analysis. Common examples in this class are quadrupole mass filters and magnetic sector mass spectrometers in which a high power dynamic electric field or a high power magnetic field, respectively, are used to selectively stabilize the trajectories of ion beams of a single mass-to-charge (m/q) ratio. Trapping spectrometers can be subdivided into two subcategories: Dynamic Traps, such as for example the quadrupole ion traps (QIT) of Paul's design, and static traps, such as the more recently developed electrostatic confinement traps. Electrostatic traps that are presently available, and used for mass spectrometry, generally rely on harmonic potential trapping wells to trap ions into ion-energy-independent oscillations within the trap, with oscillation periods related only to the mass-to-charge ratio of the ions. Mass analysis in some modern electrostatic traps has been performed through the use of remote, inductive pick up and sensing electronics and Fast Fourier Transform (FFT) spectral deconvolution in Fourier transform mass spectrometry (FTMS). Alternatively, ions have been extracted, at any instant, by the rapid switching off of the high voltage trapping potentials. All ions then escape, and their mass-to-charge ratios are determined through time of flight (TOF) analysis. Some recent developments have combined the trapping of ions with both dynamic (pseudo) and electrostatic potential fields within cylindrical trap designs. In these designs, Quadrupole radial confinement fields are used to constrain ion trajectories in a radial direction while electrostatic potentials wells are used to confine ions in the axial direction into substantially harmonic oscillatory motions. Resonant excitation of the ion motion in the axial direction is then used to effect mass-selective ion ejection.

The PCT/US2007/023834 application by Ermakov et al. discloses an electrostatic ion trap that confines ions of different mass-to-charge ratios and kinetic energies within an anharmonic potential well. The ion trap is also provided with a small amplitude AC drive that excites confined ions. The amplitudes of oscillation of the confined ions are increased as their energies increase, due to an autoresonance between the AC drive frequency and the mass-dependent natural oscillation frequencies of the ions, until the oscillation amplitudes of the ions exceed the physical dimensions of the trap and the mass-selected ions are detected, or the ions fragment or undergo any other physical or chemical transformation.

Autoresonance is a persisting phase-locking phenomenon that occurs when the driving frequency of an excited nonlinear oscillator slowly varies with time. With phase-lock, the frequency of the oscillator will lock to and follow the drive frequency. That is, the nonlinear oscillator will automatically resonate with the drive frequency. In this regime, the resonant excitation is continuous and unaffected by the oscillator's nonlinearity. Autoresonance is observed in nonlinear oscillators driven by relatively small external forces, almost periodic with time. If the driving frequency is slowly varying with time (in the right direction determined by the nonlinearity sign), the oscillator can remain phase-locked but on average increases its amplitude with time. This leads to a continuous resonant excitation process without the need for feedback. The long time phase-lock with the perturbation leads to a strong increase in the response amplitude even under a small driving amplitude. The driving amplitude is related to the frequency sweep rate, with an autoresonance threshold proportional to the sweep rate raised to the ¾ power.

An electrostatic ion trap disclosed by Ermakov et al. included two cylindrically symmetric cup electrodes that were held at ground (0 VDC) potential, and a planar aperture trap electrode, held at a negative DC potential (typically −1000 VDC), located midway between the cup electrodes. This ion trap was entirely cylindrically symmetric, with on-axis ionization of gas molecules and atoms by impact with electrons transmitted from a hot filament into the trap, AC excitation of the ions by application of a small amplitude RF potential to one of the cup electrodes, and detection of the mass-selectively ejected ions by an on-axis electron multiplier device. This design produced good quality spectra of high vacuum environments (pressures lower than $10^{-6}$ Torr), but produced noisy spectra with substantial baseline offsets and loss of spectral resolution in higher pressure ($10^{-4}$-$10^{-5}$ Torr) environments.

SUMMARY OF THE INVENTION

In some embodiments, an ion trap includes an electrode structure, including a first and a second opposed mirror electrodes and a central lens therebetween, that produces an electrostatic potential in which ions are confined to trajectories at natural oscillation frequencies, the confining potential being anharmonic. The ion trap also includes an AC excitation source having an excitation frequency f that excites confined ions at a frequency related to the natural oscillation frequency of the ions, the AC excitation frequency source preferably being connected to the central lens. In one embodiment, the ion trap includes a scan control that controls the relationship between the AC excitation frequency and the natural oscillation frequency of the ions.

In certain embodiments, an ion trap comprises an electrode structure, including first and second opposed mirror electrodes and a central lens therebetween, that produces an electrostatic potential in which ions are confined to trajectories at natural oscillation frequencies, the confining potential being anharmonic. The ion trap also includes an AC excitation source having an excitation frequency f that excites confined ions at a frequency of about a multiple of the natural oscillation frequency of the ions, the AC excitation frequency source preferably being connected to the central lens. In one embodiment, the ion trap includes a scan control that mass selectively reduces a frequency difference between the AC excitation frequency and about twice the natural oscillation frequency of the ions. The scan control can sweep the AC excitation frequency f at a sweep rate in a direction from an excitation frequency higher than twice the natural oscillation frequency of the ions to achieve autoresonance. Alternatively, the scan control can sweep the AC excitation frequency f at a sweep rate in a direction from an excitation frequency lower than twice the natural oscillation frequency of the ions. In some embodiments, the scan control can sweep the AC excitation frequency f at a nonlinear sweep rate. In certain embodiments, the nonlinear sweep can be composed of concatenated linear sweeps. The sweep rate can be set such that $d(1/f^n)/dt$ is about equal to a constant and n is greater than zero. In one embodiment, n is approximately equal to 1. In another embodiment, n is approximately equal to 2.

In other embodiments, the scan control can sweep a magnitude V of the electrostatic potential at a sweep rate in a direction such that twice the natural oscillation frequency of the ions changes from a frequency lower than the frequency of the AC excitation source to achieve autoresonance. Alternatively, the scan control can sweep the magnitude V of the electrostatic potential at a sweep rate in a direction such that twice the natural oscillation frequency of the ions changes from a frequency higher than the frequency of the AC excitation source. The sweep rate can be nonlinear.

In some embodiments, the first opposed mirror electrode structure and the second opposed mirror electrode structure can be biased unequally. In one embodiment, each of the first and the second opposed mirror electrode structures includes a first plate-shaped electrode with an axially located aperture and a second electrode shaped in the form of a cup, open towards the central lens, with a centrally located aperture, and the central lens is plate-shaped and includes an axially located aperture.

In another embodiment, the first opposed mirror electrode of the electrode structure includes a first plate-shaped electrode with at least one aperture, located off-axis with respect to an axis of the opposed mirror electrode structure, and a second electrode shaped in the form of a cup, open towards the central lens, with a centrally located aperture. In this embodiment, the second opposed mirror electrode of the electrode structure includes a first plate-shaped electrode with an axially located aperture and a second electrode shaped in the form of a cup, open towards the central lens, with a centrally located aperture. The central lens is plate-shaped and includes an axially located aperture.

In some embodiments, the ion trap can include an ion source. The ion source can include at least one electron emissive source that creates ions by electron impact ionization of a gaseous species. In one embodiment, the ion source can include two electron emissive sources. In some embodiments, the at least one electron emissive source can be a hot filament. In other embodiments, the at least one electron emissive source can be a cold electron emissive source.

In some embodiments, the at least one electron emissive source can be located off-axis relative to the electrode structure. In these embodiments, electrons generated by the at least one electron emissive source can be injected at an angle of between about 20 degrees and about 30 degrees away from an axis normal to an axis along the electrode structure.

The ion trap can be configured as a mass spectrometer by further including an ion detector. In some embodiments, the ion detector can be located on-axis relative to the electrode structure. In other embodiments, the ion detector can be located off-axis relative to the electrode structure.

In some embodiments, the ion detector can be an electron multiplier device. In other embodiments, the ion detector can detect ions by measuring the amount of RF power absorbed from the AC excitation source as the AC excitation source frequency varies. In yet other embodiments, the ion detector can detect ions by measuring the change in electrical impedance of the electrode structure as the AC excitation frequency varies. In still other embodiments, the ion detector can detect ions by measuring the current induced by image charges as the AC excitation frequency varies.

In other embodiments, the ion detector can detect ions by measuring the amount of RF power absorbed from the AC excitation source as the magnitude of the electrostatic potential varies. In yet other embodiments, the ion detector can detect ions by measuring the change in electrical impedance of the electrode structure as the magnitude of the electrostatic potential varies. In still other embodiments, the ion detector can detect ions by measuring the current induced by image charges as the magnitude of the electrostatic potential varies.

In another embodiment, an ion trap comprises an electrode structure, including first and second opposed mirror electrodes and a central lens therebetween, that produces an electrostatic potential in which ions are confined to trajectories at natural oscillation frequencies, the confining potential being anharmonic, and a scan control that mass selectively reduces a frequency difference between an AC excitation frequency connected to the electrode structure and a multiple of the natural oscillation frequency of the ions from an excitation frequency lower than the multiple of the natural oscillation frequency of the ions. In one embodiment, the scan control reduces the frequency difference by sweeping the AC excitation frequency at a sweep rate. In some embodiments, the sweep rate can be a nonlinear sweep rate. In certain embodiments, the nonlinear sweep can be composed of concatenated linear sweeps. In another embodiment, the scan control reduces the frequency difference by sweeping the magnitude V of the electrostatic potential at a sweep rate in a direction such that the multiple of the natural oscillation frequency of the ions changes from a frequency higher than the frequency of the AC excitation source.

In one embodiment, an ion trap includes an electron source that creates ions by electron impact ionization of a gaseous species, and a collector electrode that collects the ions to form a total pressure reading. The ion trap further includes an electrode structure that produces an electrostatic potential in which ions are confined to trajectories at natural oscillation frequencies, and a mass analyzer that analyzes the gaseous species. In some embodiments, the electrode structure includes a central lens. The electrostatic potential can be anharmonic. In certain embodiments, the ion trap can further include an AC excitation source having an excitation frequency that excites confined ions at a frequency of about twice the natural oscillation frequency of the ions, the AC excitation source being connected to the central lens. In some embodiments, the electron source can be located off-axis relative to the electrode structure. In one embodiment, the collector electrode is plate-shaped and includes an axially located aperture in line with the electrode structure. In another embodiment, the collector electrode surrounds the electron source. In yet another embodiment, the collector electrode is located inside the electrode structure.

In another embodiment, an ion trap includes an electron source that creates ions by electron impact ionization of a gaseous species, and an electrode structure, including a central lens, that produces an electrostatic potential in which ions are confined to trajectories at natural oscillation frequencies. The ion trap further includes a gauge that measures total pressure, and a partial pressure analyzer that relates the densities of confined ions having specific natural oscillation frequencies to the total pressure. In some embodiments, the electrostatic potential produced by the electrode structure can be anharmonic. In certain embodiments, the ion trap can include an AC excitation source having an excitation frequency that excites confined ions at a frequency of about twice the natural oscillation frequency of the ions, the AC excitation source being connected to the central lens. In one embodiment, the total pressure gauge can include an ionization gauge.

In yet another embodiment, an ion trap includes an electrode structure, including first and second opposed mirror electrodes and a central lens therebetween, that produces an electrostatic potential in which ions are confined to trajectories at natural oscillation frequencies, the confining potential being anharmonic, and an AC excitation source having an excitation frequency that excites confined ions at a frequency of about two times the natural oscillation frequency of the ions, the AC excitation source being connected to the central lens. The ion trap further includes a bias controller that biases one of the first and the second opposed mirror electrode structures sufficiently unequally such that substantially all the ions escape the trap and are collected by an ion detector to form a total pressure reading.

In still another embodiment, an ion trap includes an electrode structure that produces an electrostatic potential in which ions are confined to trajectories at natural oscillation frequencies, the confining potential being anharmonic, and an AC excitation source, connected to the electrode structure, having an excitation frequency that excites confined ions at a frequency that is about an integer multiple of natural oscillation frequency of the ions. The ion trap further includes nonvolatile memory storing control parameters, and control electronics operatively connected to the AC excitation source and to the electrode structure, the control electronics controlling the AC excitation source and the electrostatic potential using the control parameters. Control parameters can include configuration and calibration parameters and sensitivity factors. In some embodiments, the nonvolatile memory and control electronics can be integrated with the electrode structure. Configuration parameters can include magnitudes of electrostatic potentials applied on the electrode structure that produce the electrostatic potential in which ions are confined, and amplitude and frequency settings for the AC excitation source, calibration parameters can include voltage and current input and output calibration parameters of the ion trap, and sensitivity factors can include a conversion factor from natural frequency of oscillation of ions to ion mass-to-charge (m/q) ratio. In some embodiments, the excitation frequency excites confined ions at a frequency of about twice the natural oscillation frequency of the ions.

In yet another embodiment, an ion trap includes an electrode structure that produces an electrostatic potential in which ions are confined to trajectories at natural oscillation frequencies, the confining potential being anharmonic, and an AC excitation source, connected to the electrode structure, having an excitation frequency that excites confined ions at a frequency that is about an integer multiple of natural oscillation frequency of the ions. The ion trap further includes a scan control that sweeps the AC excitation frequency f at a sweep rate that is set such that $d(1/f^n)/dt$ is equal to a constant and n is greater than zero. In one embodiment, n is approximately equal to 1. In another embodiment, n is approximately equal to 2.

A method of trapping ions in an ion trap includes producing an anharmonic electrostatic potential in which ions are confined to trajectories at natural oscillation frequencies, in an electrode structure that includes first and second opposed mirror electrodes and a central lens therebetween, and exciting confined ions at a frequency of about twice the natural oscillation frequency of the ions with an AC excitation source having an excitation frequency f, the AC excitation source being connected to the central lens. In one embodiment, the method includes the step of scanning the excitation frequency of the AC excitation source and mass selectively reducing a frequency difference between the AC excitation frequency and about twice the natural oscillation frequency of the ions. The step of scanning the excitation frequency can be performed at a sweep rate from an excitation frequency higher than about twice the natural oscillation frequency of the ions, to mass selectively achieve autoresonance as the frequency difference approaches zero. Alternatively, the step of scanning the excitation frequency can be performed at a sweep rate from an excitation frequency lower than about twice the natural oscillation frequency of the ions. In some embodiments, the sweep rate can be a nonlinear sweep rate. In certain embodiments, the nonlinear sweep can be composed of concatenated linear sweeps. The sweep rate can be set such that $d(1/f^n)/dt$ is about equal to a constant and n is greater than zero. In one embodiment, n is approximately equal to 1. In another embodiment, n is approximately equal to 2.

In other embodiments, scanning the excitation frequency can include the step of sweeping a magnitude V of the electrostatic potential at a sweep rate in a direction such that twice the natural oscillation frequency of the ions changes from a frequency lower than the frequency of the AC excitation source. Alternatively, scanning the excitation frequency can include the step of sweeping a magnitude V of the electrostatic potential at a sweep rate in a direction such that twice the natural oscillation frequency of the ions changes from a frequency higher than the frequency of the AC excitation source. The sweep rate can be nonlinear.

In some embodiments, the first opposed mirror electrode structure and the second opposed mirror electrode structure can be biased unequally. In one embodiment, the first and the second opposed mirror electrode structures each includes a first plate-shaped electrode with an axially located aperture and a second electrode shaped in the form of a cup, open towards the central lens, with a centrally located aperture, and the central lens is plate-shaped and includes an axially located aperture.

In another embodiment, the first opposed mirror electrode structure includes a first plate-shaped electrode with at least one aperture, located off-axis with respect to an axis of the opposed mirror electrode structure, and a second electrode shaped in the form of a cup, open towards the central lens, with a centrally located aperture. In this embodiment, the second opposed mirror electrode structure includes a first plate-shaped electrode with an axially located aperture and a second electrode shaped in the form of a cup, open towards the central lens, with a centrally located aperture. The central lens is plate-shaped and includes an axially located aperture.

In some embodiments, the method can include using an ion source. In other embodiments, the method can include using an ion detector, configured as a mass spectrometer. The ion source can include at least one electron emissive source that creates ions by electron impact ionization of a gaseous species. In one embodiment, the ion source can include two electron emissive sources. In some embodiments, the at least one electron emissive source can be a hot filament. In other embodiments, the at least one electron emissive source can be a cold electron emissive source.

In some embodiments, the at least one electron emissive source can be located off-axis relative to the electrode structure. In these embodiments, electrons generated by the at least one electron emissive source can be injected at an angle of between about 20 degrees and about 30 degrees away from an axis normal to an axis along the electrode structure.

In some embodiments, the ion detector can be located on-axis relative to the electrode structure. In other embodiments, the ion detector can be located off-axis relative to the electrode structure.

In some embodiments, the ion detector can be an electron multiplier device. In other embodiments, the ion detector can detect ions by measuring the amount of RF power absorbed from the AC excitation source as the AC excitation source frequency varies. In yet other embodiments, the ion detector can detect ions by measuring the change in electrical impedance of the electrode structure as the AC excitation frequency varies. In still other embodiments, the ion detector can detect ions by measuring the current induced by image charges as the AC excitation frequency varies.

In other embodiments, the ion detector can detect ions by measuring the amount of RF power absorbed from the AC excitation source as the magnitude of the electrostatic potential varies. In yet other embodiments, the ion detector can detect ions by measuring the change in electrical impedance of the electrode structure as the magnitude of the electrostatic potential varies. In still other embodiments, the ion detector can detect ions by measuring the current induced by image charges as the magnitude of the electrostatic potential varies.

In another embodiment, a method of trapping ions in an ion trap includes producing an anharmonic electrostatic potential in which ions are confined to trajectories at natural oscillation frequencies, in an electrode structure that includes first and second opposed mirror electrodes and a central lens therebetween. The method further includes scanning an excitation frequency of an AC excitation source connected to the electrode structure and mass selectively reducing a frequency difference between the AC excitation frequency and a multiple of the natural oscillation frequency of the ions from an excitation frequency lower than the multiple of the natural oscillation frequency of the ions. In one embodiment, the scan control reduces the frequency difference by sweeping the AC excitation frequency at a sweep rate. In another embodiment, the scan control reduces the frequency difference by sweeping a magnitude V of the electrostatic potential at a sweep rate in a direction such that the multiple of the natural oscillation frequency of the ions changes from a frequency higher than the frequency of the AC excitation source. In some embodiments, the sweep rate can be a nonlinear sweep rate.

In one embodiment, a method of trapping ions in an ion trap includes creating ions with an electron source by electron impact ionization of a gaseous species, collecting ions with a collector electrode to form a total pressure reading, producing an electrostatic potential in which ions are confined to trajectories at natural oscillation frequencies using an electrode structure, and providing a mass analyzer for analyzing the gaseous species. In some embodiments, the electrostatic potential can be anharmonic. The method can further include providing an AC excitation source having an excitation frequency that excites confined ions at a frequency of about twice the natural oscillation frequency of the ions, the AC excitation source being connected to the central lens. In certain embodiments, the electrode structure can include a central lens. In some embodiments, the electron source can be located off-axis relative to the electrode structure. In one embodiment, the collector electrode is plate-shaped and includes an axially located aperture in line with the electrode structure. In another embodiment, the collector electrode surrounds the electron source. In yet another embodiment, the collector electrode is located inside the electrode structure.

In another embodiment, a method of measuring absolute partial pressure using an ion trap includes creating ions with an electron source by electron impact ionization of a gaseous species, producing an electrostatic potential with an electrode structure, including a central lens, in which ions are confined to trajectories at natural oscillation frequencies, measuring total pressure with a total pressure gauge, and relating the densities of confined ions having specific natural oscillation frequencies to the total pressure with a partial pressure analyzer. In some embodiments, the electrostatic potential produced by the electrode structure can be anharmonic. In certain embodiments, the ion trap can include an AC excitation source having an excitation frequency that excites confined ions at a frequency of about twice the natural oscillation frequency of the ions, the AC excitation source being connected to the central lens. In one embodiment, the total pressure gauge can include an ionization gauge.

In yet another embodiment, a method of measuring total pressure with an ion trap includes producing an anharmonic electrostatic potential in which ions are confined to trajectories at natural oscillation frequencies, in an electrode structure that includes a first and a second opposed mirror electrodes and a central lens therebetween, exciting confined ions at a frequency of about twice the natural oscillation frequency of the ions with an AC excitation source having an excitation frequency, the AC excitation source being connected to the central lens, and biasing one of the first and the second opposed mirror electrode structures with a bias controller sufficiently unequally such that substantially all the ions escape the trap and are collected by an ion detector.

In still another embodiment, a method of trapping ions in an ion trap includes producing an anharmonic electrostatic potential in an electrode structure in which ions are confined to trajectories at natural oscillation frequencies, exciting confined ions at a frequency of about an integer multiple of the natural oscillation frequency of the ions with an AC excitation source connected to the electrode structure and having an excitation frequency, and storing configuration and calibration parameters and sensitivity factors in nonvolatile memory. In one embodiment, configuration parameters can include magnitudes of electrostatic potentials applied on the electrode structure that produce the electrostatic potential in which ions are confined, and amplitude and frequency settings for the AC excitation source, calibration parameters can include voltage and current input and output calibration parameters of the ion trap, and sensitivity factors can include a conversion factor from natural frequency of oscillation of ions to ion mass-to-charge (m/q) ratio.

In yet another embodiment, a method of trapping ions in an ion trap includes producing an anharmonic electrostatic potential in an electrode structure in which ions are confined to trajectories at natural oscillation frequencies, exciting confined ions at a frequency of about an integer multiple of the natural oscillation frequency of the ions with an AC excitation source connected to the electrode structure and having an excitation frequency, and scanning the excitation frequency f at a sweep rate that is set such that $d(1/f^n)/dt$ is about equal to a constant and n is greater than zero. In one embodiment, n is approximately equal to 1. In another embodiment, n is approximately equal to 2.

This invention has many advantages, such as improved quality of mass spectra at higher pressure ($10^{-4}$-$10^{-5}$ Torr) and reduced baseline in mass spectra throughout the operational pressure range of the ion trap ($10^{-4}$ Torr to $10^{-10}$ Torr).

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 36 is a derivation of the partial pressure of gas A.

DETAILED DESCRIPTION OF THE INVENTION

A description of example embodiments of the invention follows.

An ion trap comprises an electrode structure, including a first and a second opposed mirror electrodes and a central lens therebetween, that produces an electrostatic potential in which ions are confined to trajectories at natural oscillation frequencies, the confining potential being anharmonic. The ion trap also includes an AC excitation source having an excitation frequency f that excites confined ions at a frequency of about a multiple of the natural oscillation frequency of the ions, the AC excitation frequency source preferably being connected to the central lens.

Figure 1:
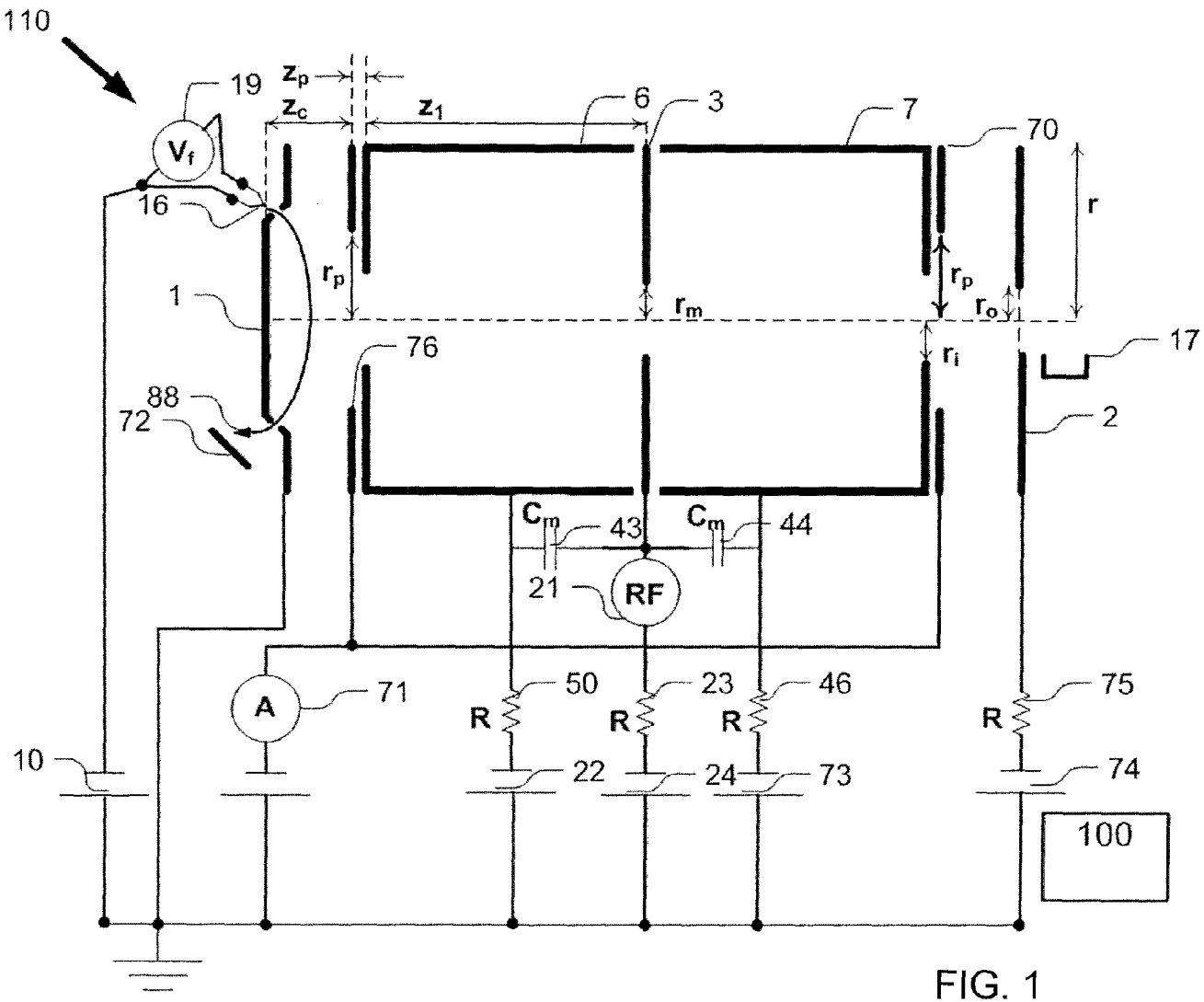
FIG. 1 is a schematic diagram of an electrostatic ion trap.

Turning now to FIG. 1, an ion trap 110 comprises an electrode structure made up of two plates 1 and 2, two cup-shaped electrodes 6 and 7, and a flat central lens 3. In this example, each plate 1 and 2 is about 0.025" thick and about 1" in diameter. Plate 1 includes a protrusion of about 0.075" in height and about 0.625" in largest dimension (the protrusion can be circular or square) with at least one slit located along the side of the protrusion, off-axis with respect to the axis of cylindrical symmetry of the ion trap 110. Plate 2 is flat and includes a circular hole of about 0.125" diameter ($r_o$=0.0625") with a fine mesh grid made of electroformed metal over the circular hole. Each cup-shaped electrode 6 and 7 is about 0.75" long ($z_1$=0.75") and about 1" in diameter (r=0.5") with a circular hole in the bottom of each cup electrode of about 0.25" diameter ($r_i$=0.125"). The cup-shaped electrodes 6 and 7 are arranged with the wide openings of the cups opposed to one another in an opposed mirror image arrangement, as shown in FIG. 1. The protrusion in plate 1 is away from the cup electrode 6. The spacing between plate 1 and cup electrode 6 is about 0.175", and the spacing between plate 2 and cup electrode 7 is about 0.25". The flat plates 1 and 2 are adjacent to the bottom of the cup electrodes 6 and 7, respectively. The flat central lens 3 is located between the cup electrodes 6 and 7, at a spacing of about 0.025" away from each cup electrode. The flat central lens 3 is about 1" in diameter, with a circular hole of about 0.187" diameter ($r_m$=0.0935"). Alternatively, the central lens 3 can be a cylinder. The electrode structure is cylindrically symmetric with an overall length of about 2.075" and a diameter of about 1". In the further description of FIG. 1 below, the plate 1 is called the entry plate 1, the cup-shaped electrode 6 is called the entry cup 6, the central lens 3 is called the transition plate 3, the cup-shaped electrode 7 is called the exit cup 7, and the plate 2 is called the exit plate 2, because ions enter the electrode structure from the left and, unless otherwise specified, are detected upon their exit through the exit plate 2 on the right. Although the entry cup 6 and exit cup 7 are illustrated as solid cups in FIG. 1, it is well known in the art that such electrode structures can also be made of perforated metal or grid material, or a stacked-ring assembly. An open electrode structure would provide higher gas conductance, faster response to transient changes in gas composition, and lower susceptibility to buildup of surface contamination inside the cups that can distort the electrostatic fields. It is also well known in the art that solid metal structures can be replaced with metal coated structures made of substrates such as, for example, plastic, ceramic, or other similar materials.

Figure 2A:
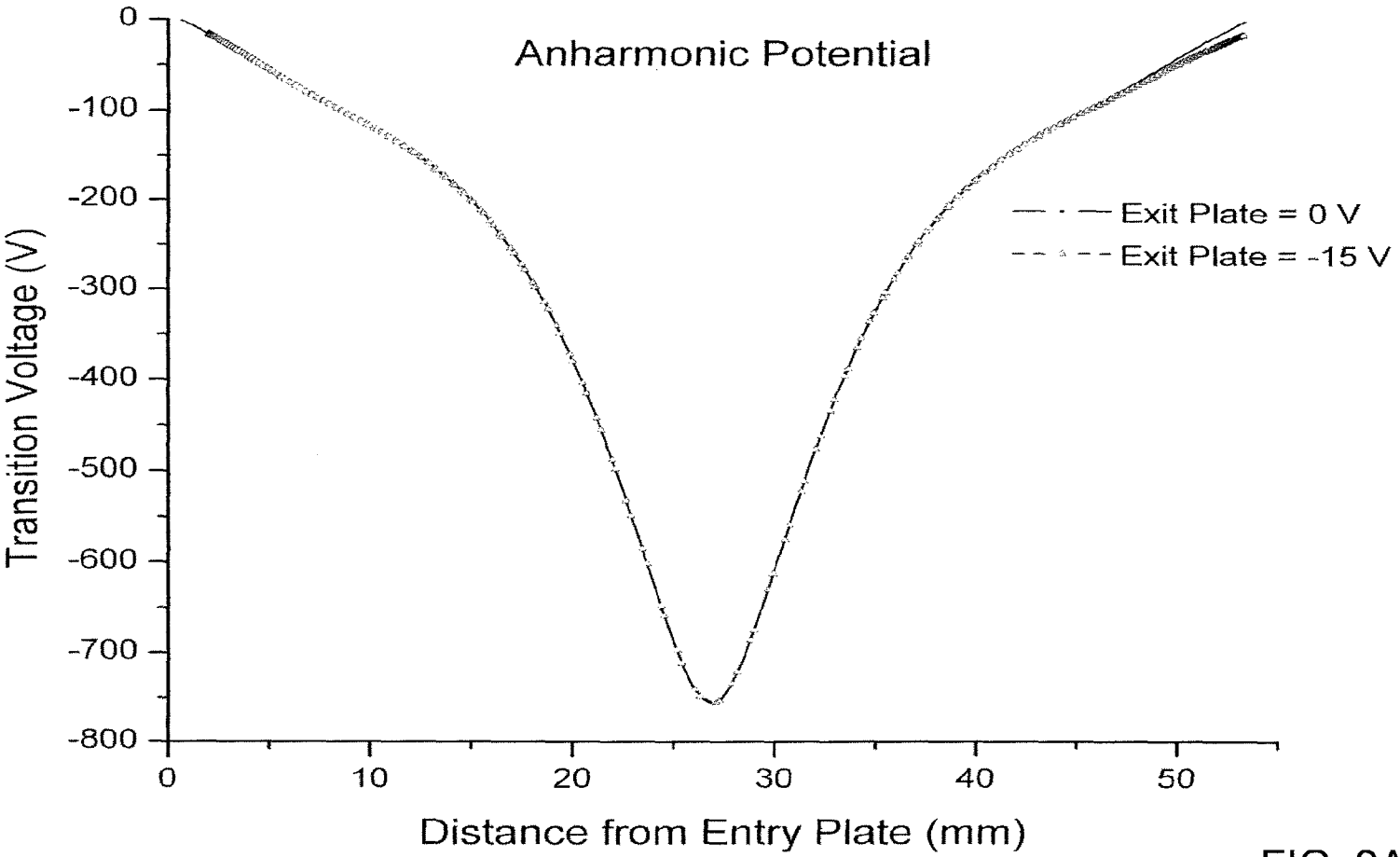
FIG. 2A is a drawing of an anharmonic potential well.
Figure 2B:
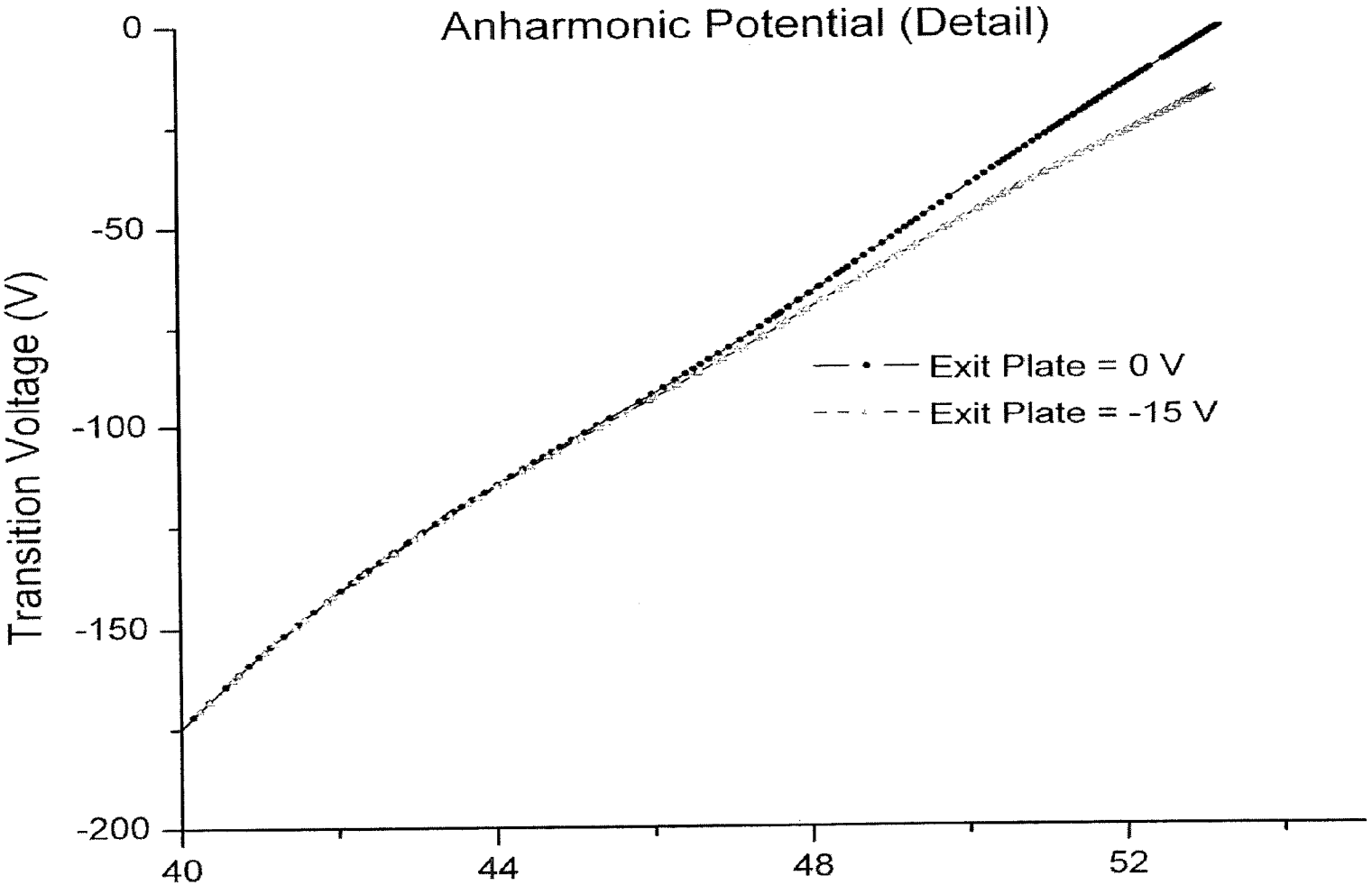
FIG. 2B is a drawing of a portion of the anharmonic potential well of FIG. 2A at an exit plate voltage of 0 VDC and an exit plate voltage of −15 VDC.

An electrostatic potential for trapping positive ions is created inside the electrode structure by biasing the transition plate 3 at about −850 VDC, the cup electrodes 6 and 7 each at about −90 VDC, the entry plate 1 at about 0 VDC, and the exit plate 2 at an adjustable bias of about 0 to about −30 VDC, preferably about 0 to about −10 VDC. The electrostatic potential along the central axis calculated with SIMION (Scientific Instrument Services, Inc., Ringoes, N.J.), and shown in FIG. 2A, is anharmonic, and, depending on the bias applied to the exit plate 2, variably asymmetric, as shown in FIG. 2A, and in the expanded view of the electrostatic potential profile near the exit plate 2 shown in FIG. 2B. Asymmetry is created in the electrostatic potential profile to preferentially eject the ions on the exit side of the trap, as described further below. An electrostatic potential for trapping negative ions can be created by reversing the sign of the bias potentials applied to the electrode structure.

A harmonic oscillator is a system which, when displaced from its equilibrium position, experiences a restoring force proportional to the displacement (i.e., according to Hooke's law). If the linear restoring force is the only force acting on the system, the system becomes a simple harmonic oscillator, and it undergoes simple harmonic motion: sinusoidal oscillations about the equilibrium point, with constant frequency which does not depend on amplitude (or stored energy). Ions trapped in a harmonic potential well experience linear fields and undergo simple harmonic motion oscillating at a fixed natural frequency depending only on the mass-to-charge ratio of the ions and the specific shape of the quadratic potential well (which is defined by the combination of the trap geometry and the magnitude of the electrostatic voltages). The natural oscillation frequency for a given ion trapped in a harmonic oscillator potential energy well is not affected by its energy or the amplitude of oscillation and there is a strict relationship between natural frequency of oscillation and the square-root of mass-to-charge ratio, i.e., ions with a larger mass-to-charge ratio oscillate at a lower natural frequency than ions with a smaller mass-to-charge ratio. High-tolerance mechanical assemblies are generally required to establish carefully selected harmonic potential wells, self-bunching, isochronous oscillations and high resolution spectral output for both inductive pickup (FTMS) and TOF detection schemes.

In the most general terms, anharmonicity is simply the deviation of a system from being a harmonic oscillator, i.e., an oscillator that is not oscillating in simple harmonic motion is known as an anharmonic or nonlinear oscillator. In complete contrast to harmonic traps, this trap utilizes strong anharmonicity in the ion oscillatory motion as a means for (1) ion trapping and also for (2) mass-selective autoresonant excitation and ejection of ions. The ion potential v. displacement along the ion trap axis for a typical electrostatic ion trap is shown in FIG. 2A. The natural frequency of oscillation of an ion in such a potential well depends on the amplitude of oscillation and results in anharmonic oscillatory motion. This means that the natural oscillation frequency of a specific ion trapped in such a potential well is determined by four factors: (1) the details of the trap geometry, (2) the ion's mass-to-charge ratio (m/q), (3) the ion's instantaneous amplitude of oscillation (related to its energy) and (4) the depth of the potential well defined by the voltage gradient established between the cup electrodes and the central lens electrode. In a non-linear axial field as shown in FIG. 2A, the ions with larger oscillation amplitudes have lower natural oscillation frequencies than same mass ions with smaller oscillation amplitudes. In other words, in anharmonic oscillations, trapped ions will experience a decrease in natural oscillation frequency and an increase in oscillation amplitude if their energy increases.

Figure 2C:
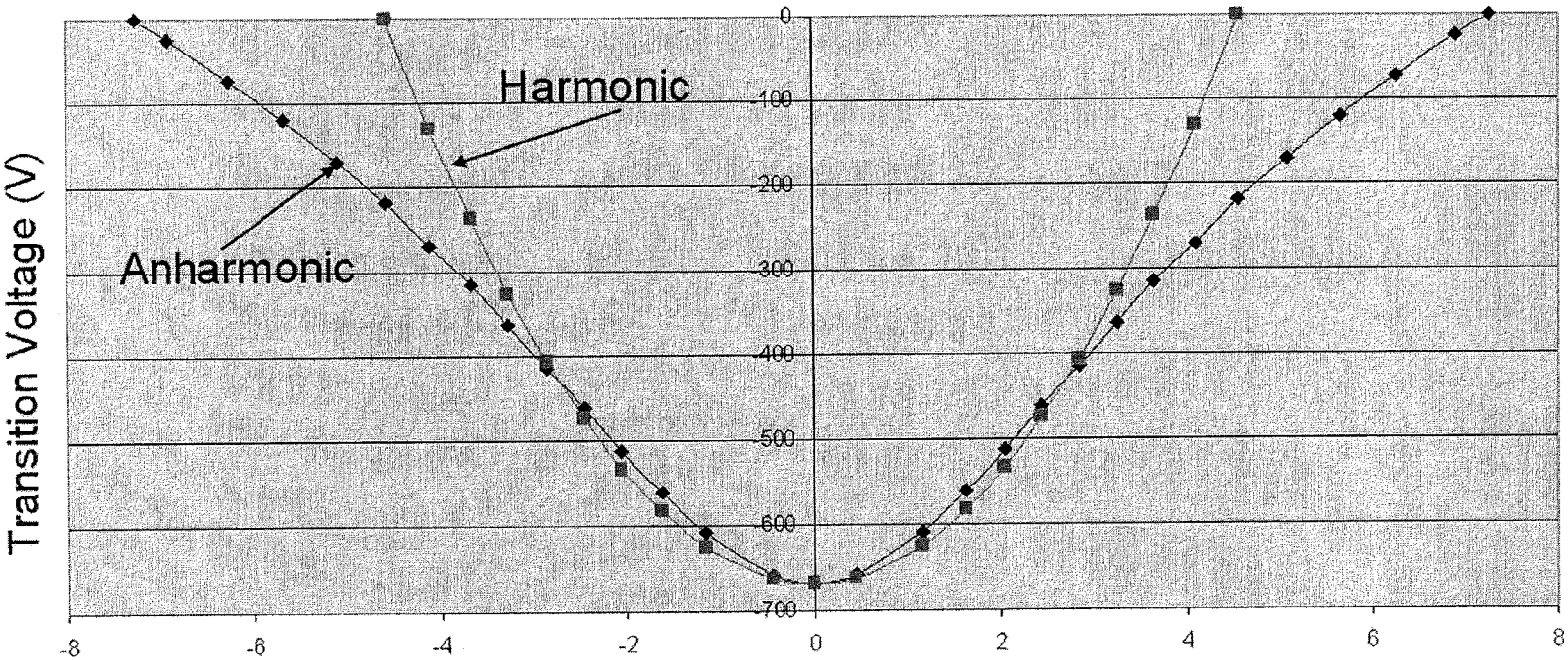
FIG. 2C is a drawing of a harmonic potential well and an anharmonic potential well.

FIG. 2A shows an example of an anharmonic potential with a negative nonlinearity sign as it is typically encountered in most of the preferred trap embodiments. FIG. 2C illustrates the difference between a harmonic potential profile and an anharmonic ion trap. Ions oscillating in this type of anharmonic potential trap will experience increasing oscillation trajectories and decreasing frequencies as they gain energy, for example, by autoresonance. However, this invention is not limited to traps with anharmonic potentials with negative deviations from linearity. It is also possible to construct electrostatic traps with positive deviations from harmonic (i.e., quadratic) potentials in which case the changes in trap conditions required to effect autoresonance will be reversed from those required for negatively deviated potentials. Such a potential can also be responsible for anharmonic oscillations of the ions, but with opposite relationships between ion energy and oscillation frequency as compared to the negatively anharmonic curve shown in FIG. 2C. It is possible to use positively deviated potentials in anharmonic traps in order to achieve specific relationships between ion energy and oscillation frequencies that might lead to improved fragmentation rates under autoresonance.

An advantage of the use of anharmonic potentials to confine ions in an oscillatory motion is that fabrication requirements are much less complex and machining tolerances are much less stringent than in harmonic potential electrostatic traps, where strict linear fields are a requirement. The performance of the trap is not dependent upon a strict or unique functional form for the anharmonic potential. Whereas the presence of strong anharmonicity in the potential trapping well is a basic prerequisite for ion excitation through autoresonance, there are no strict or unique requirements or conditions to meet in terms of the exact functional form of the trapping potentials present inside the trap. In addition, mass spectrometry or ion-beam sourcing performance is also less sensitive to unit-to-unit variations allowing more relaxed manufacturing requirements for an anharmonic resonant ion trap mass spectrometer (ART MS) compared to most other mass spectrometry technology. The anharmonic potential depicted in the curve of FIG. 2A is clearly presented for reference only, and it will be understood by those skilled in the art that various changes in form and detail can be made to the anharmonic potential without departing from the scope of the present invention.

The ion trap also includes an AC excitation source having an excitation frequency f that excites confined ions at a frequency of about a multiple of the natural oscillation frequency of the ions. The multiple of the natural oscillation frequency of the ions includes one, two, or more times the natural oscillation frequency. The AC excitation source can be connected directly to the cup electrodes 6 and 7 and entry plate 1 and exit plate 2, for example entry cup 6 and entry plate 1, or, preferably, to the transition plate 3 (central lens), as shown in FIG. 1. Turning to FIG. 1, AC excitation source 21 is connected to transition plate 3, and the applied RF is also distributed through optional capacitors 43 and 44 to cup electrodes 6 and 7, respectively. The application of the AC excitation source 21 directly to the transition plate 3 creates a symmetrical arrangement of the RF distribution, and, surprisingly, enables the efficient excitation of ions at twice their natural frequency of oscillation. When applied to the transition plate 3, the AC excitation source excites the ions when they are traveling toward the exit cup and on their return trip when the ions are traveling toward the entry cup.

The ion trap is also provided with a scan control 100 shown in FIG. 1, which mass selectively reduces a frequency difference between the AC excitation frequency and twice the natural oscillation frequency of the ions. In one embodiment, the scan control 100 sweeps the AC excitation frequency f at a sweep rate in a direction from a frequency higher than twice the natural oscillation frequency of the ions towards a frequency lower than twice the natural oscillation frequency of the ions to achieve autoresonance. In a typical electrostatic ion trap, with an anharmonic potential well, autoresonant excitation of a group of ions of given mass-to-charge ratio, m/q, is achieved in the following fashion:

1. Ions are electrostatically trapped and undergo nonlinear oscillations within the anharmonic potential with a natural oscillation frequency, $f_M$.
2. An AC drive is connected to the system with an initial drive frequency, $f_d$, above the natural oscillation frequency of the ions—$f_d > f_M$, or, alternatively, above a multiple, such as, for example, double the natural oscillation frequency of the ions—$f_d > 2f_M$.
3. Continuously reducing the positive frequency difference between the drive frequency, $f_d$, and the multiple of the natural oscillation frequency of the ions, $f_M$, until the instantaneous frequency difference approaches nearly zero, causes the oscillatory motion of the ions to phase-lock into persistent autoresonance with the drive. (In an autoresonant oscillator, the ions will then automatically adjust their instantaneous amplitude of oscillation by extracting energy from the drive as needed to keep their natural oscillation frequency phase-locked to the drive frequency.)
4. Further attempts to change trap conditions towards a negative difference between the drive frequency and the natural oscillation frequency of the ions then results in energy being transferred from the AC drive into the oscillatory system, changing the oscillatory amplitude and frequency of oscillation of the ions.
5. For a typical electrostatic ion trap with a potential such as depicted in FIG. 2C (negative nonlinearity), the oscillatory amplitudes become larger and the ions oscillate closer to the end plates as energy is transferred from the drive into the oscillatory system. Eventually, the oscillation amplitude of the ions will reach a point where the ion either hits a side electrode, or leaves the trap if a side electrode is semi transparent (e.g., a mesh).

The autoresonant excitation process described above can be used to 1) excite ions causing them to undergo new chemical and physical processes while stored, and/or 2) eject ions from the trap in a mass selective fashion. Ion ejection can be used to operate pulsed ion sources, as well as to implement full mass spectrometry detection systems, in which case a detection method is required to detect the autoresonance events and/or the ejected ions.

Figure 3:
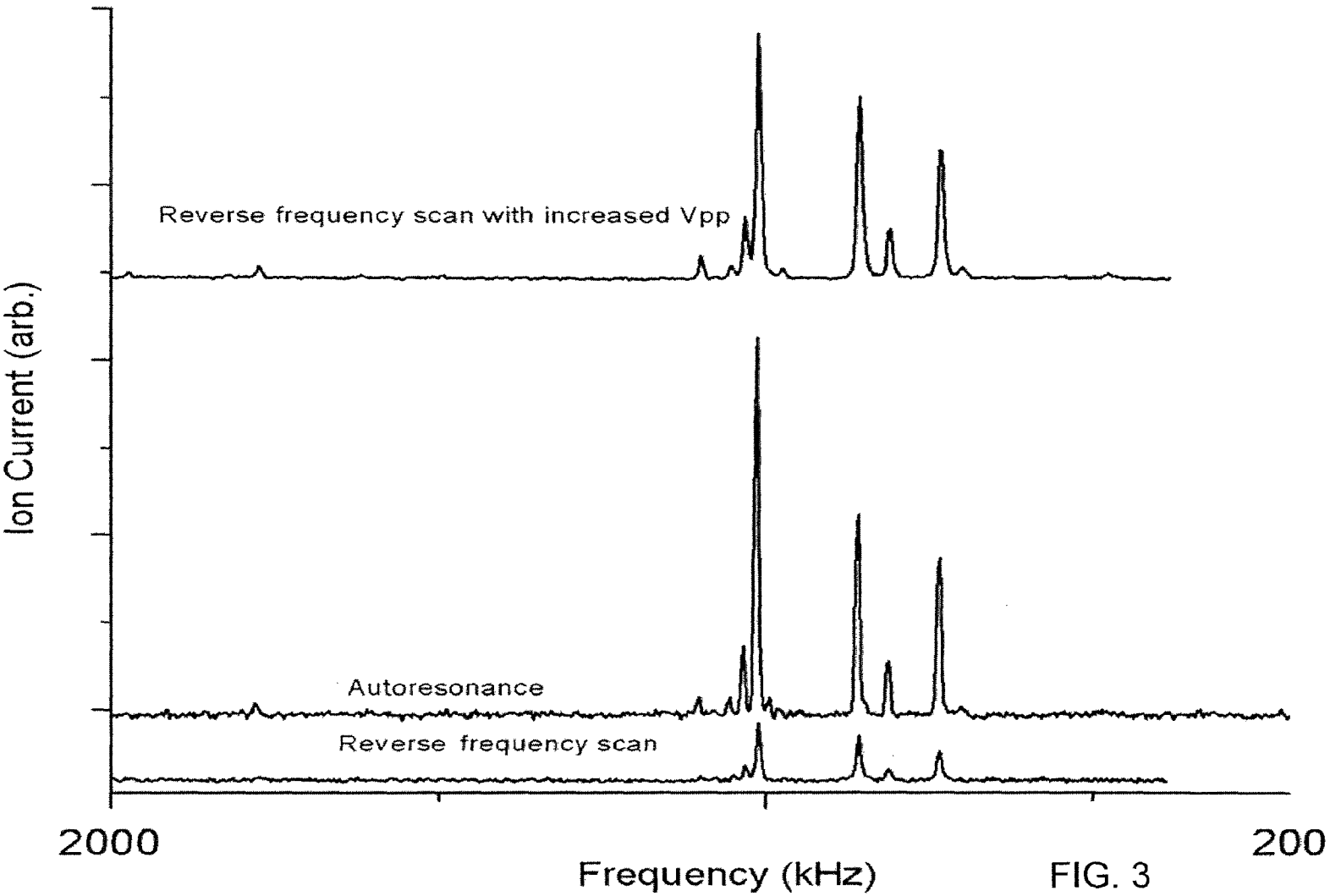
FIG. 3 is a drawing of mass spectra obtained by employing autoresonance and obtained by scanning the AC excitation frequency in the reverse direction.

Alternatively, the scan control 100 can sweep the AC excitation frequency f at a sweep rate in the reverse direction, that is, from a frequency lower than twice the natural oscillation frequency of the ions towards a frequency higher than twice the natural oscillation frequency of the ions. This reverse scan mode does not produce the persistent phase lock and autoresonance described above, but does yield moderately useful spectra, in most cases, as shown in FIG. 3.

Figure 4:
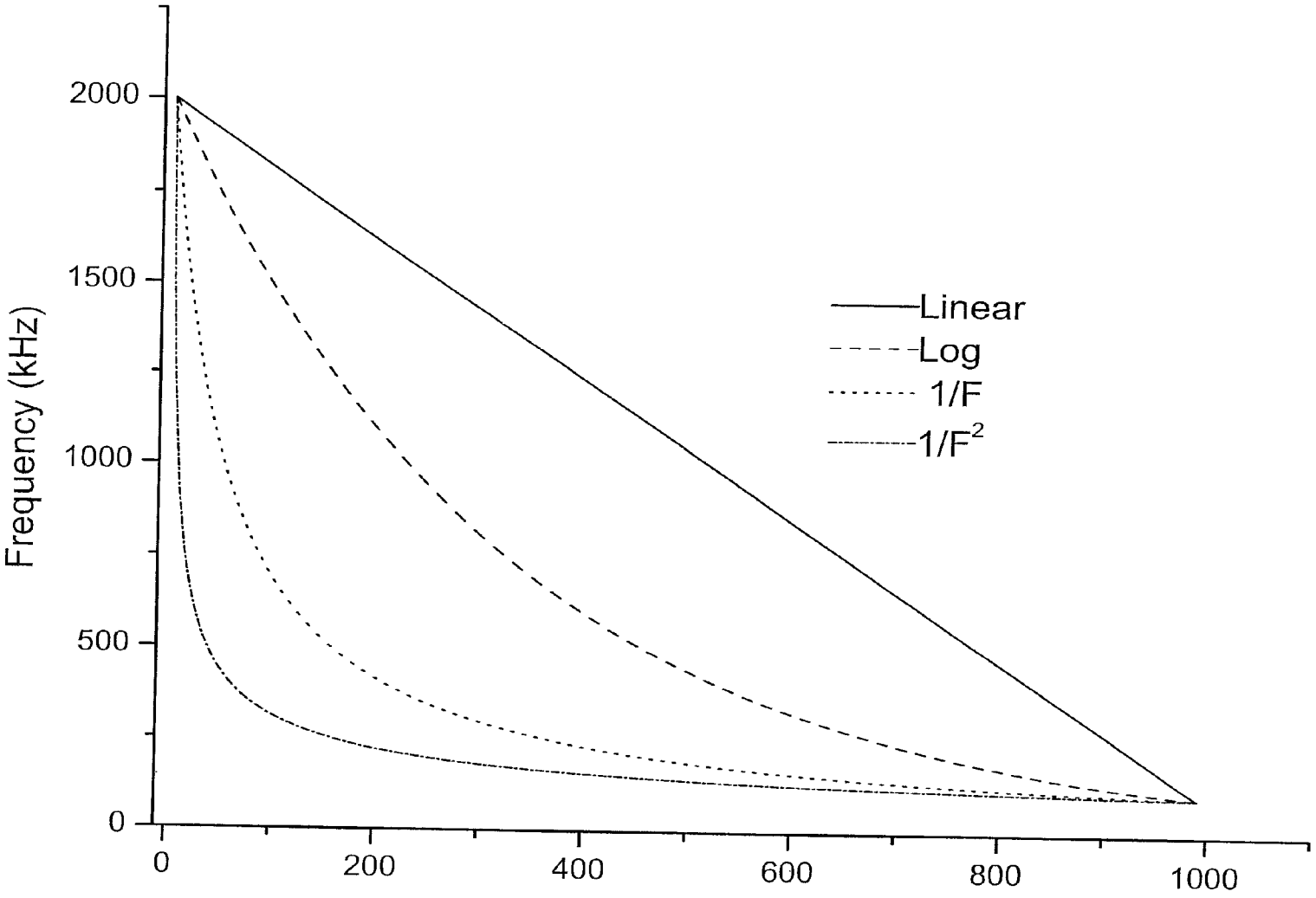
FIG. 4 is a drawing of AC excitation frequency as a function of sweep time for linear, log, 1/f, and $1/f^2$ frequency scans.

The sweep rate at which the scan control 100 sweeps the AC excitation frequency f can be a linear sweep rate (i.e., df/dt equal to a constant), or, preferably, a nonlinear sweep rate, most preferably set such that $d(1/f^n)/dt$ is equal to a constant and n is greater than zero. Several possible frequency scan profiles are shown in FIG. 4. For an ART MS trap to operate properly under autoresonance conditions, it is necessary to scan frequencies from high to low values. Linear frequency scans are compatible with ART MS excitation, but they do not provide the most efficient ion ejection over wide mass ranges. For ART MS to be properly implemented, the function generator used to provide the AC excitation must be a source of phase-continuous RF signal between the pre-specified frequency values, with the pre-specified voltage $V_{pp}$ and with the proper frequency scan time profile. For direct-digital frequency synthesis (DDS), it is important to also have a high-sample-rate digital-to-analog converter (DAC) output with adequate output filtering to assure the absence of distorted peaks and superharmonics. Most low-cost, commercially available DDS chips create frequency sweeps as a phase-continuous concatenation of discrete and small frequency increments. Small frequency steps, up to about 136 Hz per step, have produced good quality spectra in experiments with all the embodiments described herein.

Linear scans (df/dt=constant) have been used to operate anharmonic resonant ion trap mass spectrometers. Linear scans are convenient and easy to implement because they are supported by most commercial function/arbitrary waveform generators (FAWG). Linear scans are completely adequate, and generally preferred, for narrow mass range scans but do not perform well for large mass ranges because the frequency decreases at a constant rate, but the mass of the ions is inversely related to the square of the frequency, and therefore light ions are ejected early in the scan and the time interval between adjacent masses decreases with decreasing frequency. Linear scans, therefore, are not efficient in terms of scan time utilization. Linear scans are not recommended for large mass range scans, including low masses (i.e., <10 atomic mass units (amu)), because the relatively long scan time spent at low frequencies facilitates the ejection of ions at superharmonic frequencies (i.e., providing a very complicated spectrum). Linear frequency scans are also not recommended for large mass ranges because they cannot adequately eject both low and high molecular weight species with comparable efficiency. For a fixed frequency range, efficient ejection of heavier ions requires longer scan times than scan times for lighter ions. When applying linear scans, a scan time is selected that is ideal for the specific peak(s) of interest. Linear scans are generally recognized as not ideal for the operation of ART MS traps unless really narrow mass ranges (i.e., a few amu) are desired. A concatenated series of linear scans, optimized for each individual mass range, can be used to perform scans over large mass ranges, and multi-segment linear scans can be used to approximate the non-linear frequency scan profiles described below. Concatenation of linear scan profiles to provide an approximation to the ideal or preferred non-linear scan of an arbitrary waveform generator enables the development of ART MS systems based on inexpensive DDS chips without a substantial loss in instrument performance. For some of the lowest cost DDS chips for which phase continuity cannot be assured between consecutive linear segments, careful calculations of frequency ranges can be used to avoid phase discontinuities at mass peaks of interest.

A careful analysis has shown that the amplitude of the rate of change of frequency with time [df/dt] required to optimize the ejection of ions at all masses needs to decrease in inverse proportion to the mass of the ions. In other words, heavier ions are ejected more efficiently by slower scan rates (i.e., smaller [df/dt] values) than lighter ions. Heavier ions oscillate slower and therefore require more time to collect enough energy from the RF field oscillations. It is believed that for a given RF amplitude, a minimum number of oscillations are required before an ion can be ejected from the trap by autoresonance. Ideally, therefore, the rate of change of frequency with time, [df/dt], should decrease as ions of increasing mass are ejected from the trap. This scan profile makes the generation of a phase continuous RF signal more complicated, however, and requires the use of a fast arbitrary waveform generator to be successful. As described above, piece-wise linear fits have also been used to approximate ideal non-linear frequency profiles, enabling the use of low-cost DDS chips for the development of commercial instrumentation.

Logarithmic frequency scans (d(log f)/dt=constant), in which the logarithm of the frequency changes linearly with time can be produced with most commercially available FAWGs. Logarithmic scans provide, in general, better results than linear scans: 1) the spectra contain fewer superharmonic peaks (described below) at low masses, 2) the higher molecular weight compounds are more efficiently ejected from the trap for scan times comparable to those of linear scans. Logarithmic frequency scans are always preferred over linear scans for large mass range spectra collection; however, they are still not ideal since it is still necessary to adjust scan times carefully depending on whether light or heavier ions need to be ejected. To be able to eject heavier ions effectively, the scan times need to be increased and superharmonics (described further below) might still contaminate the spectra.

A preferred scan mode involves setting the frequency sweep rate such that $d(1/f^n)/dt$ is about equal to a constant and n is greater than zero, as shown in FIG. 4 for n=1 and n=2. "1/f" frequency sweeps provide frequency sweeps which decrease linearly with mass. That is exactly the sort of relationship that was empirically determined to be optimal for ion ejection. "1/f" scans have systematically provided the cleanest and most efficient spectra of all scan sweep modes. For example, a 70 millisecond frequency sweep provides optimal data output between 1 amu and 100 amu in 70 milliseconds in contrast with the 250 milliseconds required for an equivalent log scan. The scans are faster and, since relatively little time is spent at the higher frequencies, much cleaner in terms of higher harmonic contributions. In addition to 1/f scans, it might also be useful to consider $1/f^2$ scans, $(d(1/f^2)/dt=\text{constant})$. The most important advantage of this scan mode is that even though the frequencies are scanned in a non-linear fashion relative to time, the different mass peaks are ejected in a linear relationship of mass v. time. In a $1/f^2$ scan, ions are ejected from the trap at a time that is strictly proportional to their mass-to-charge ratio, i.e., there is a straight linear relationship between mass-to-charge ratio and ejection time: $\Delta m/\Delta t=\text{constant}$. With proper calibration against mass standards, it is simple to convert the ejection times into masses, and it does not require a lot of processing power to generate a mass spectrum from the collected mass ejection data.

Figure 5A:
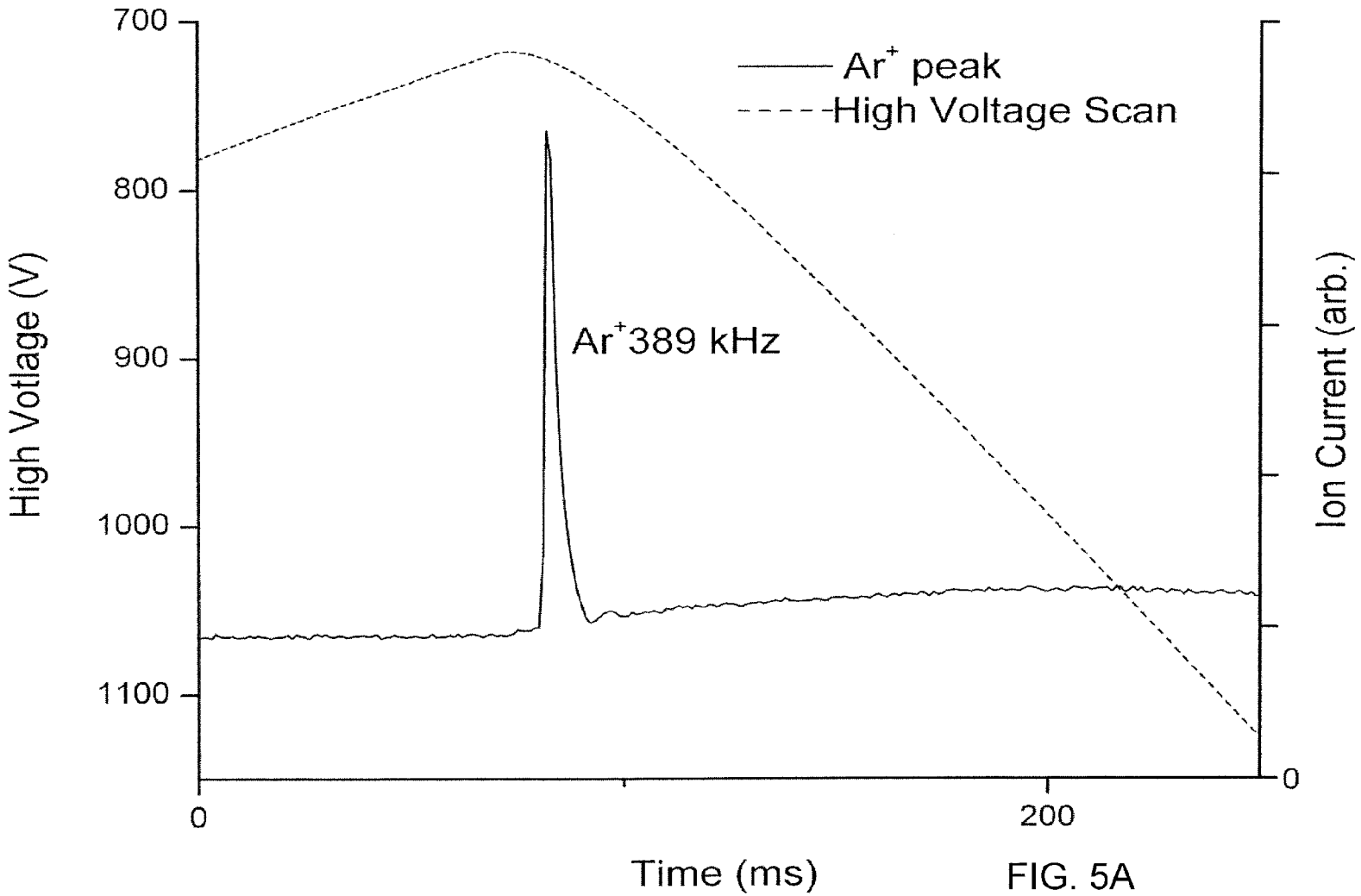
FIG. 5A is a drawing of a mass spectrum obtained by scanning the high voltage (HV) on the central lens at a fixed RF frequency of 389 kHz.
Figure 5B:
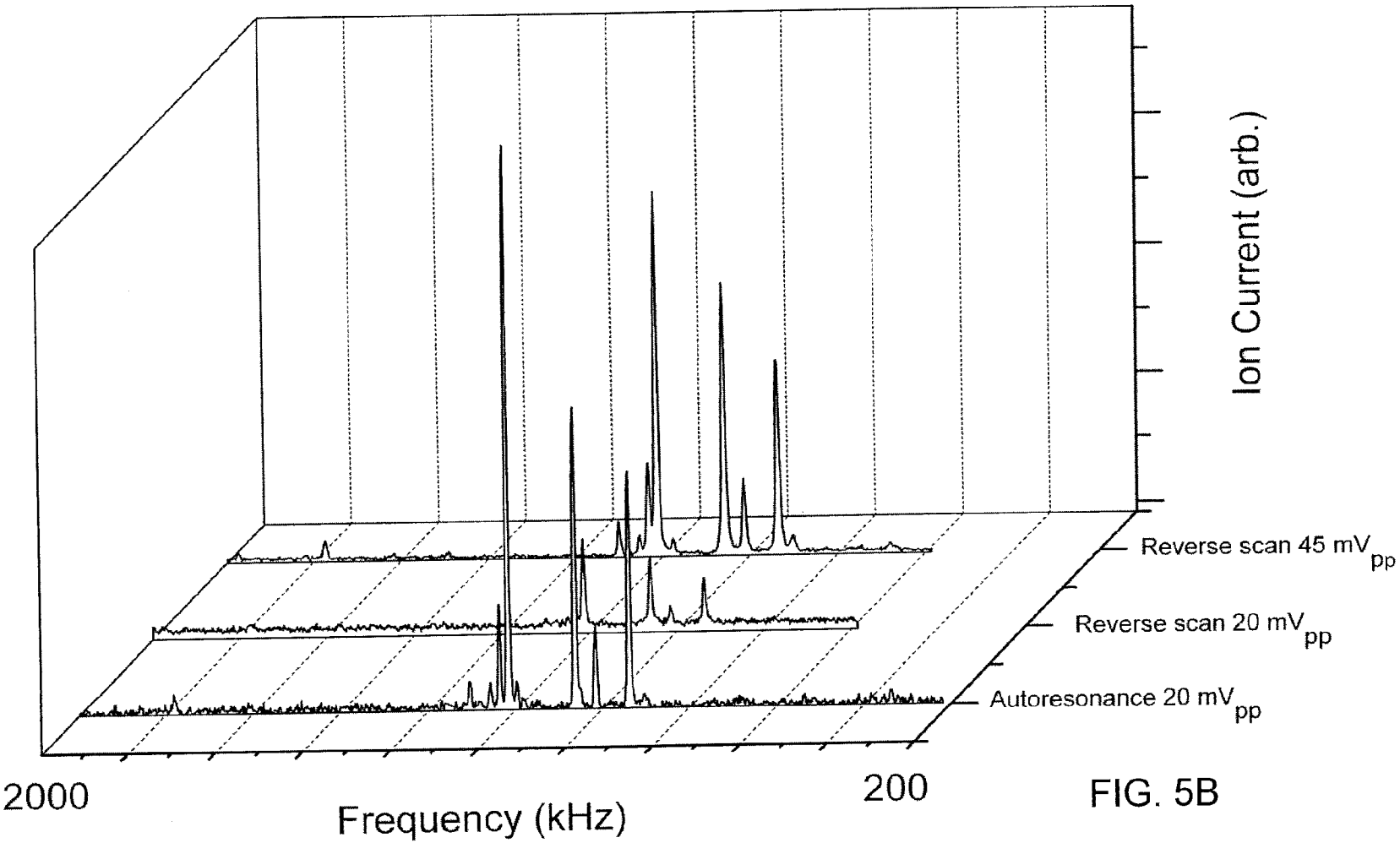
FIG. 5B is a drawing of mass spectra obtained by employing on-axis ionization and scanning the RF frequency autoresonantly, and in the reverse direction.
Figure 5C:
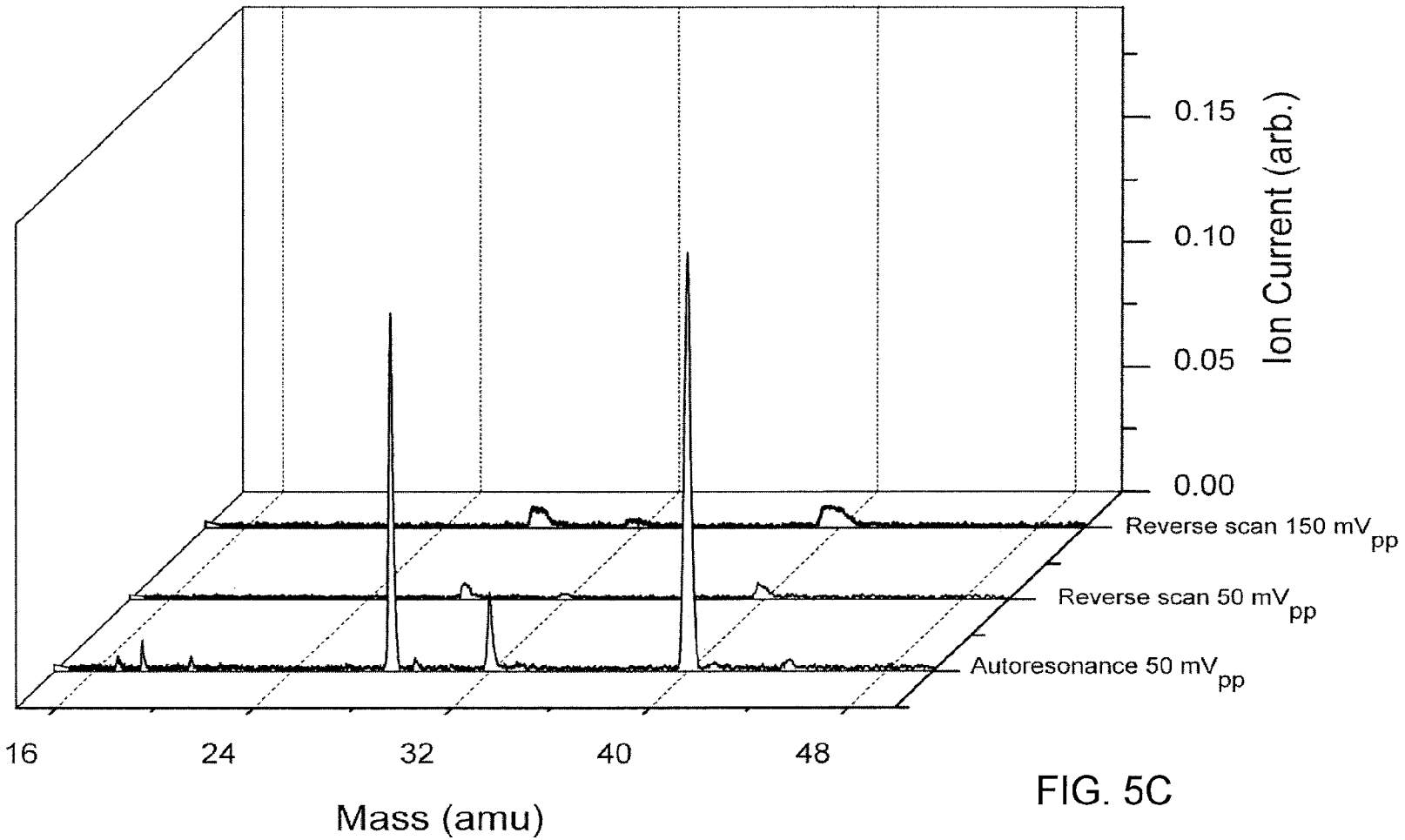
FIG. 5C is a drawing of mass spectra obtained by employing off-axis ionization and scanning the RF frequency autoresonantly, and in the reverse direction.

Alternatively, scan control 100, shown in FIG. 1, can be used to sweep a magnitude V of the electrostatic potential at a sweep rate in a direction such that twice the natural oscillation frequency of the ions changes from a frequency lower than the frequency of the AC excitation source towards a frequency higher than the frequency of the AC excitation source. The bias on transition plate 3 sets the voltage at the bottom of the electrostatic potential well shown in FIG. 2A. The natural frequency of oscillation of the ions is set by the depth of the trapping potential well. Any change in the transition plate bias voltage results in a shift in the natural frequency of oscillation of the ions. In fact, the roundtrip time for ions of a fixed mass-to-charge ratio is related to the square root of the trapping potential shown in FIG. 2A. As the trapping potential well gets shallower, the roundtrip for the ions gets longer and the natural frequency of oscillation gets smaller, i.e., the peaks in the spectrum move to lower frequencies as the transition voltage decreases. The sweep rate of the bias on the transition plate 3 can be a nonlinear sweep rate. The bias on the transition plate 3 can be swept in a direction from low to high values, such that twice the natural oscillation frequency of the ions changes from a frequency lower than the frequency of the AC excitation source towards a frequency higher than the frequency of the AC excitation source, employing autoresonance to mass selectively excite ions, as shown in FIG. 5A. Alternatively, the bias on the transition plate 3 can be swept in the reverse scan mode, in which case the bias on the transition plate 3 is swept in a direction from high to low values, such that twice the natural oscillation frequency of the ions changes from a frequency higher than the frequency of the AC excitation source towards a frequency lower than the frequency of the AC excitation source. Reverse scan mode does not employ autoresonance, but nevertheless can often produce good quality spectra, particularly with on-axis ionization (described below), as shown in FIG. 5B, illustrating a spectrum employing frequency sweeping in the reverse scan mode. As shown in FIG. 5C, reverse scanning of the frequency with off-axis ionization (described below) produces poor quality spectra. In one embodiment, the frequency of the AC excitation source and the bias on the transition plate 3 are both changed during a scan.

Figure 6A:
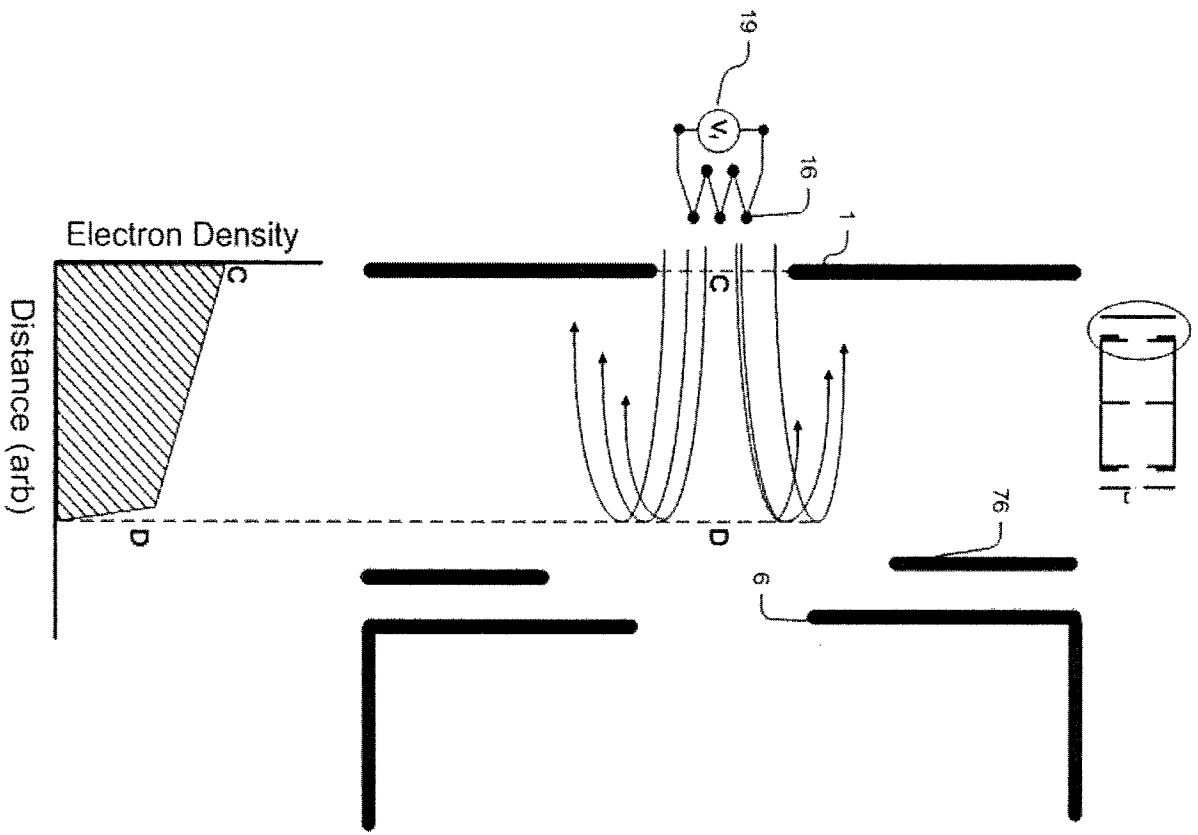
FIG. 6A is a schematic diagram of part of an electrostatic ion trap employing on-axis ionization and a drawing of the electron density as a function of distance.

In one embodiment employing on-axis ionization, partially shown in FIG. 6A, the first and the second opposed mirror electrode structures each includes a first plate-shaped electrode (entry plate) 1, with an axially located aperture and a second electrode 6 shaped in the form of a cup, open towards the central lens, with a centrally located aperture, and the central lens is plate-shaped and includes an axially located aperture. In this embodiment, as shown in the graph in FIG. 6A, the electron density produced by electron emissive source 16 is largest close to entry plate 1, where the electron energy is also larger than further away from entry plate 1. Therefore, most of the ions are created close to the entry plate 1 by impact with relatively high energy electrons, and the high energy ions are more likely to escape the electrode structure before being trapped, resulting in a large baseline offset in the spectra. FIG. 6A also illustrates that the electrons that enter the trap eventually turn around and are reflected back toward the entry plate 1. As they accelerate towards the back plane of the entry plate 1, more ions are formed in a second round of ionization. As the electrons reach the entry grid, some of them collide with grid wires and adjacent surfaces, releasing energetic ions through electron stimulated desorption (ESD). Some of the energetic ions released by ESD are also likely to escape the electrode structure without being trapped, providing an additional contribution to the baseline offset signal of the mass spectrometer.

Figure 6B:
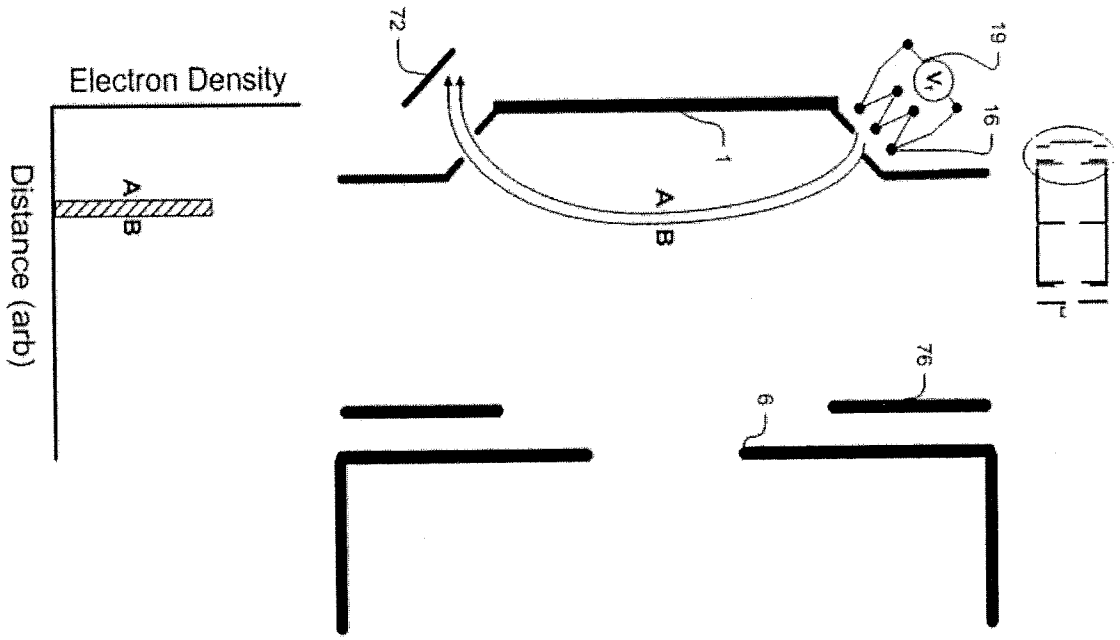
FIG. 6B is a schematic diagram of part of an electrostatic ion trap employing off-axis ionization and a drawing of the electron density as a function of distance.
Figure 7:
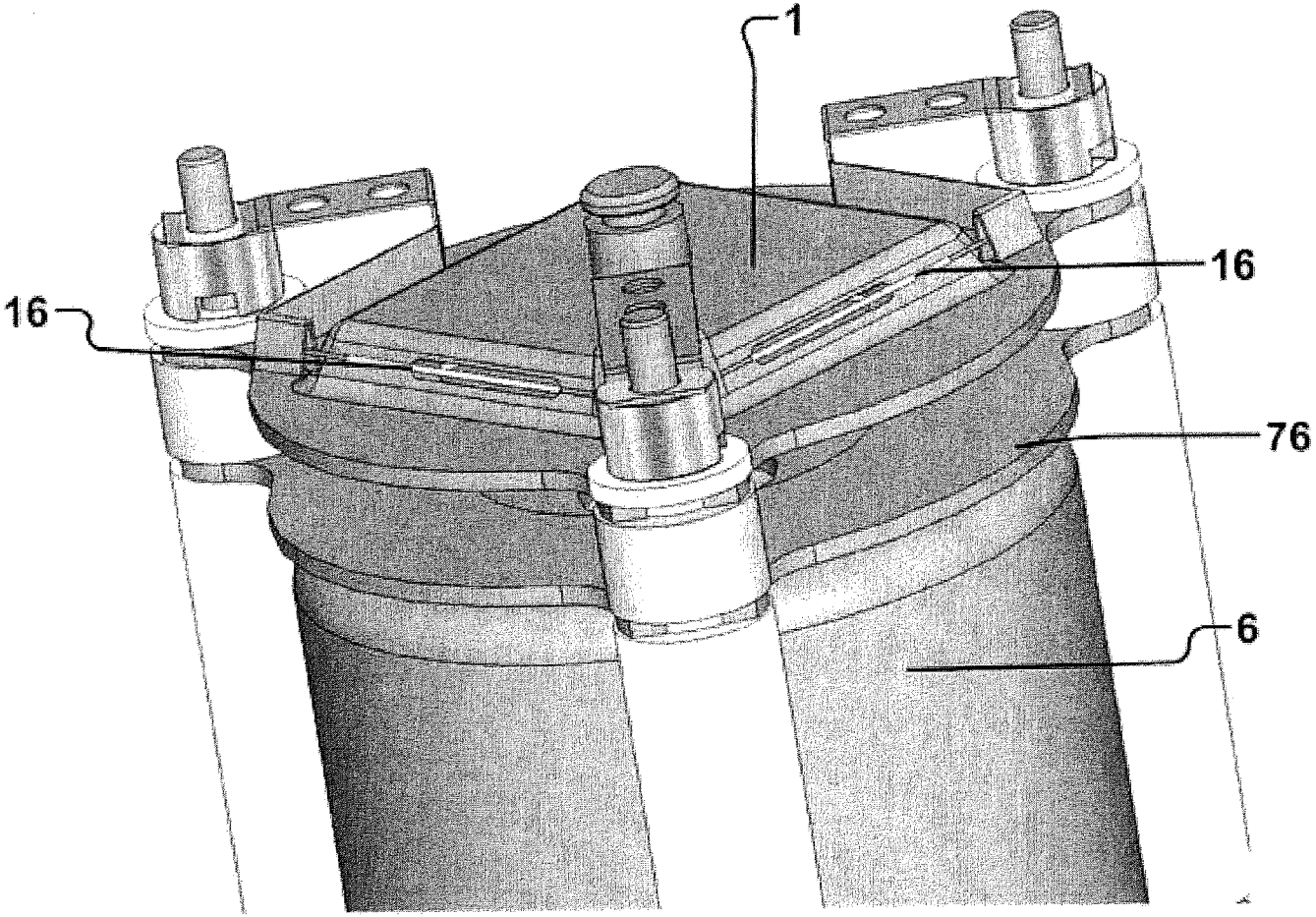
FIG. 7 is a drawing of an electrostatic ion trap with two electron emissive sources.
Figure 8:
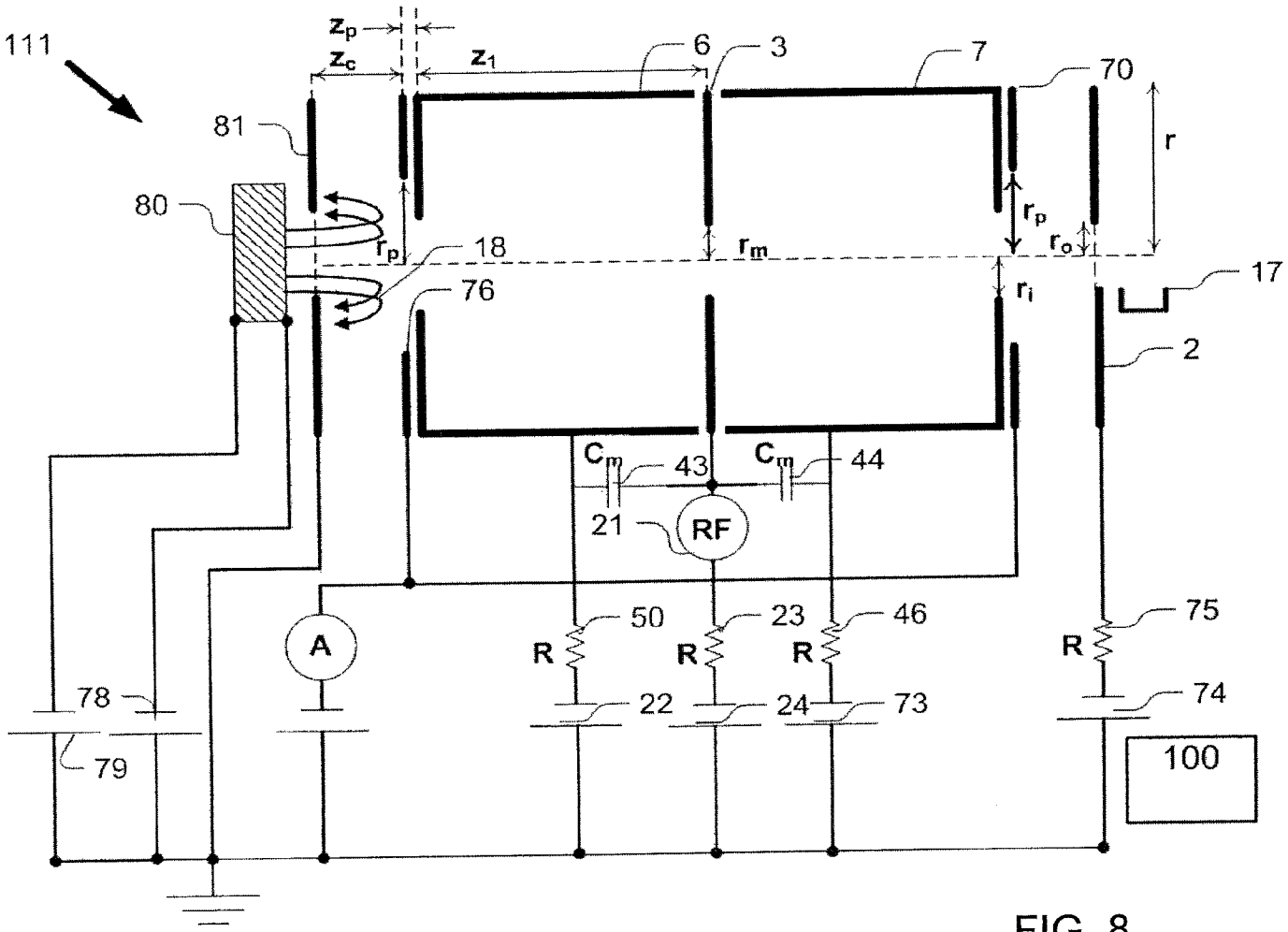
FIG. 8 is a schematic diagram of an electrostatic ion trap employing a cold electron emissive source.

In a preferred embodiment employing off-axis ionization, partially shown in FIG. 6B, the first plate-shaped electrode (entry plate) 1 includes at least one aperture located off-axis with respect to an axis of the opposed mirror electrode structure. In this embodiment, as shown in the graph in FIG. 6B, the electron density produced by electron emissive source 16 is localized deeper inside the trap, and away from entry plate 1, and therefore the ions created by impact with the electrons have lower energy and an increased probability of being trapped. Off-axis ionization also eliminates the generation of ESD ions in direct line-of-sight with the exit plate 2 of the trap as described in connection with on-axis ionization (i.e., FIG. 6A). As a result, ESD has a much diminished contribution to the baseline offset signal in the off-axis ionization scheme illustrated in FIG. 6B. Ions formed close to the entry plate 1 have sufficient energy to escape the trap without being trapped, and therefore those ions produce a baseline offset (increase) in the signal measured by an ion detector, that is independent of ion mass, and therefore is a substantial contribution to detector noise. Increased baseline noise compromises the lifetime of the ion detector, due to constant ion bombardment, requires additional signal processing for baseline subtraction, and increases (compromises) the detection limits of the sensor. The relative contribution of baseline offset to the output signal of the sensor also appears to increase as a function of the total pressure in the system when on-axis ionization is used. Off-axis ionization minimizes baseline offset and has been shown to effectively enhance the dynamic range in operating pressure of the ART MS instrument, i.e., the trap can be operated over a larger pressure range with less degradation in resolution as the pressure increases. An additional advantage of off-axis ionization is that two electron emissive sources 16 can be used, as shown in FIG. 7. The electrons generated by the at least one and preferably two electron emissive sources are injected at an angle of between about 20 degrees and about 30 degrees, preferably about 25 degrees, away from an axis normal to an axis along the electrode structure. The angle of electron injection is selected such that the electrons do not hit the pressure plate 76 (shown in FIG. 1) or any part of the adjacent electrode structures, otherwise the electron beam can generate secondary electrons and electrical noise in the resulting spectrum. In a preferred alignment of the electron emissive source, as shown in FIG. 6B, the electron beam from electron emissive source 16 is directed to an exit slit on the other side of entry plate 1, where the electron current can be measured by electrometer plate 72. Alternatively, the electron beam flowing out of the exit slit can be used as a source of ionization for an externally located ionization gauge structure as described below and illustrated in FIG. 26. The electron emissive ion source 16 can be a hot filament, as shown in FIGS. 6A and 6B, or a cold electron emissive source, such as, for example, an electron generator array (EGA) 80 as shown in FIG. 8. EGA's that operate as point sources of electrons are available, and suitable for use in off-axis ionization. Alternative off-axis ionization arrangements can include, for example, introducing ions through a side opening in the entry cup 6, or introducing ions created outside the instrument by using pulsed injection. The simple configuration illustrated in FIG. 1 was preferred because of its relative ease and low cost of manufacturing, compatibility with total pressure measurement, and compatibility with a design for a field replaceable filament assembly, wherein the filament was located at the very top of the electrode structure.

Figure 9:
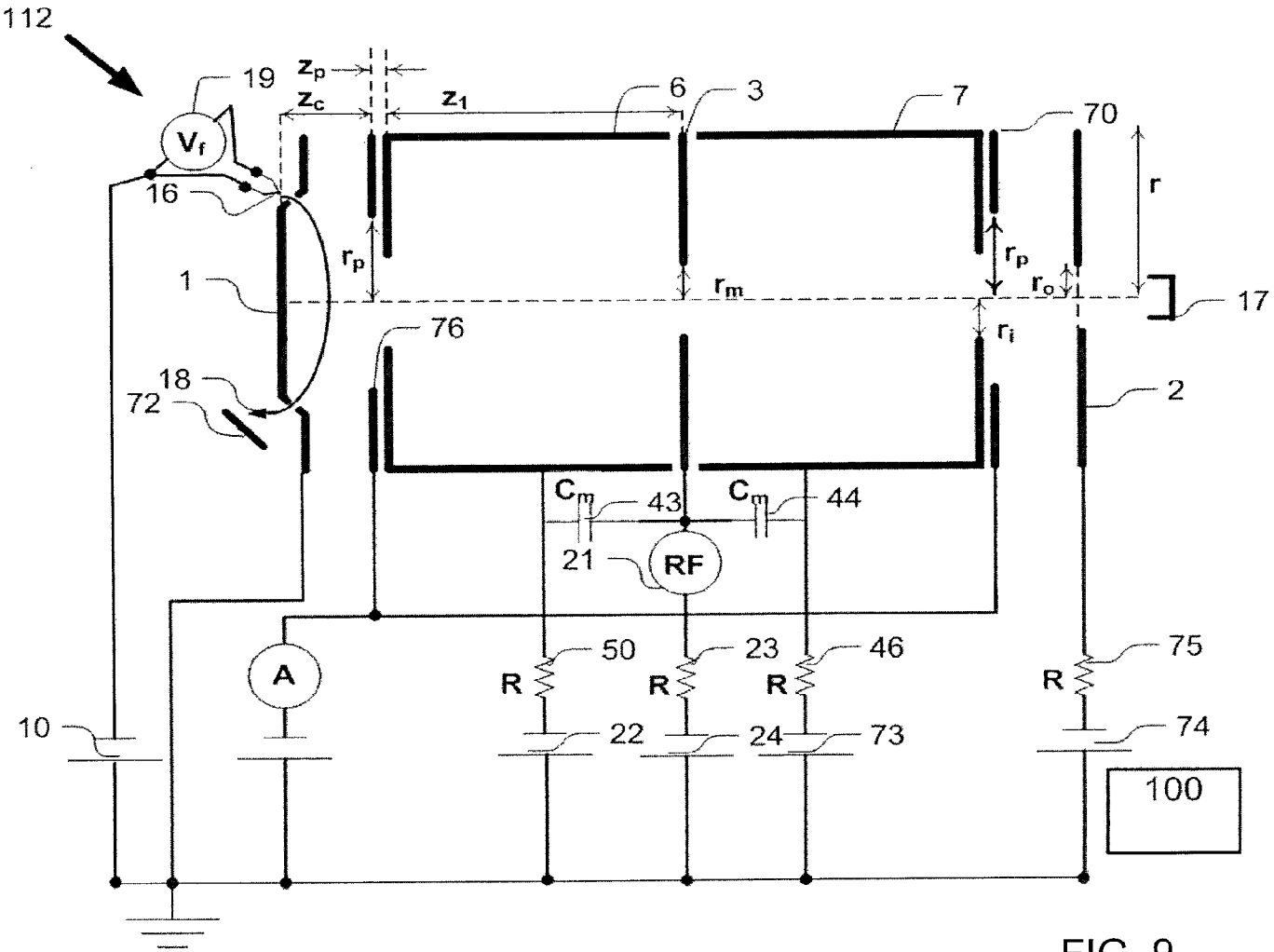
FIG. 9 is a schematic diagram of an electrostatic ion trap employing on-axis ion detection.
Figure 10:
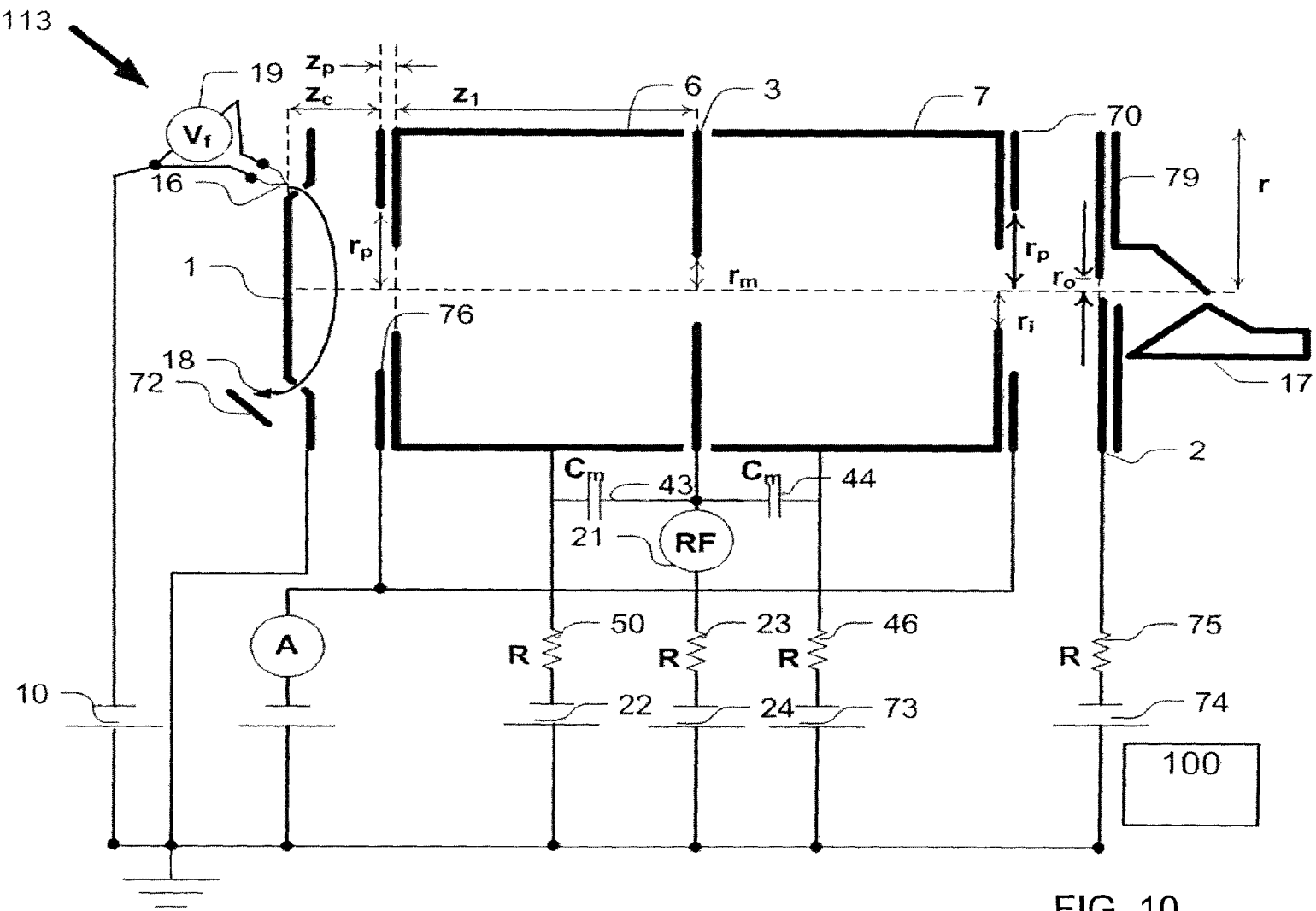
FIG. 10 is a schematic diagram of an electrostatic ion trap employing off-axis ion detection.

Configured as a mass spectrometer, the ion trap also includes an ion detector. In one embodiment, shown in FIG. 9, the ion detector 17 can be located outside the trap, on-axis relative to the electrode structure. In a preferred embodiment, shown in FIG. 10, the ion detector 17 is located off-axis relative to the electrode structure. The ion detector can be, for example, an electron multiplier device. Faraday cups can also be used to collect ion signals, however, the small available signals impose extreme demands on the design of fast electrometers compatible with picoamp level signal detection, in order to preserve the speed advantages of the sensor. Alternatively, the ion detector can include a plurality of electrically conductive structures disposed on a support element, as described in U.S. Pat. No. 7,511,278 issued on Mar. 31, 2009 to Scheidemann et al., the entire contents and teachings of which are herein incorporated by reference in their entirety. The structures are electrically insulated from one another and each structure can be electrically connected to an electronic read-out device. The structures receive a beam of particles in a direction forming an angle of incidence with the support element. A trough is disposed between each two successive structures as viewed in the beam direction, and at least partial overlap exists between each two successive structures. M. Bonner Denton has demonstrated the practical implementation and utility of such structures for mass spectrometry detection in U.S. Pat. No. 7,498,585 issued on Mar. 3, 2009 to Denton et al., the entire contents and teachings of which are herein incorporated by reference in their entirety. Even though most of the ion and electron detectors described herein have relied on transimpedance amplifiers specifically designed to measure ion and electron currents, it is also possible to perform ion and electron detection and measurement using charge sensitive amplifiers. Fast charge-sensitive transimpedance amplifiers, compatible with mass spectrometry and ion mobility spectrometers, have been demonstrated by several research group and a simple example is described in U.S. Pat. No. 7,403,065 issued Jul. 22, 2008 to Gresham et. al., the entire contents and teachings of which are herein incorporated by reference in their entirety.

Alternatively, ions can be mass-selectively detected by measuring electrical characteristics of the ion trap as the AC excitation source frequency varies, or as the magnitude of the electrostatic potential varies. The electrical characteristics include (1) the amount of RF power absorbed from the AC excitation source, (2) the change in electrical impedance of the electrode structure, and/or (3) the currents induced by image charges that develop at the end plates as the ions phase lock with the AC excitation source and oscillate closer to the end plates. The electrostatic ion traps described herein do not include tight control of ion energies and/or injection times, so that ions of the same mass-to-charge ratio can have a wide range of oscillation frequencies and phases. As a result, ions do not oscillate in isochronous fashion and inductive pickup of induced mirror-charge transients at the center plate (or tube), combined with fast Fourier transform deconvolution, has not been applied here. However, for electrostatic ion traps with carefully controlled ion energies and injection times, autoresonant excitation can be combined with a detection scheme in which the frequency of oscillation of the ions is monitored by following image charge transients at the central plate (or tube), as in most of the presently available non-autoresonant electrostatic ion traps.

Figure 11:
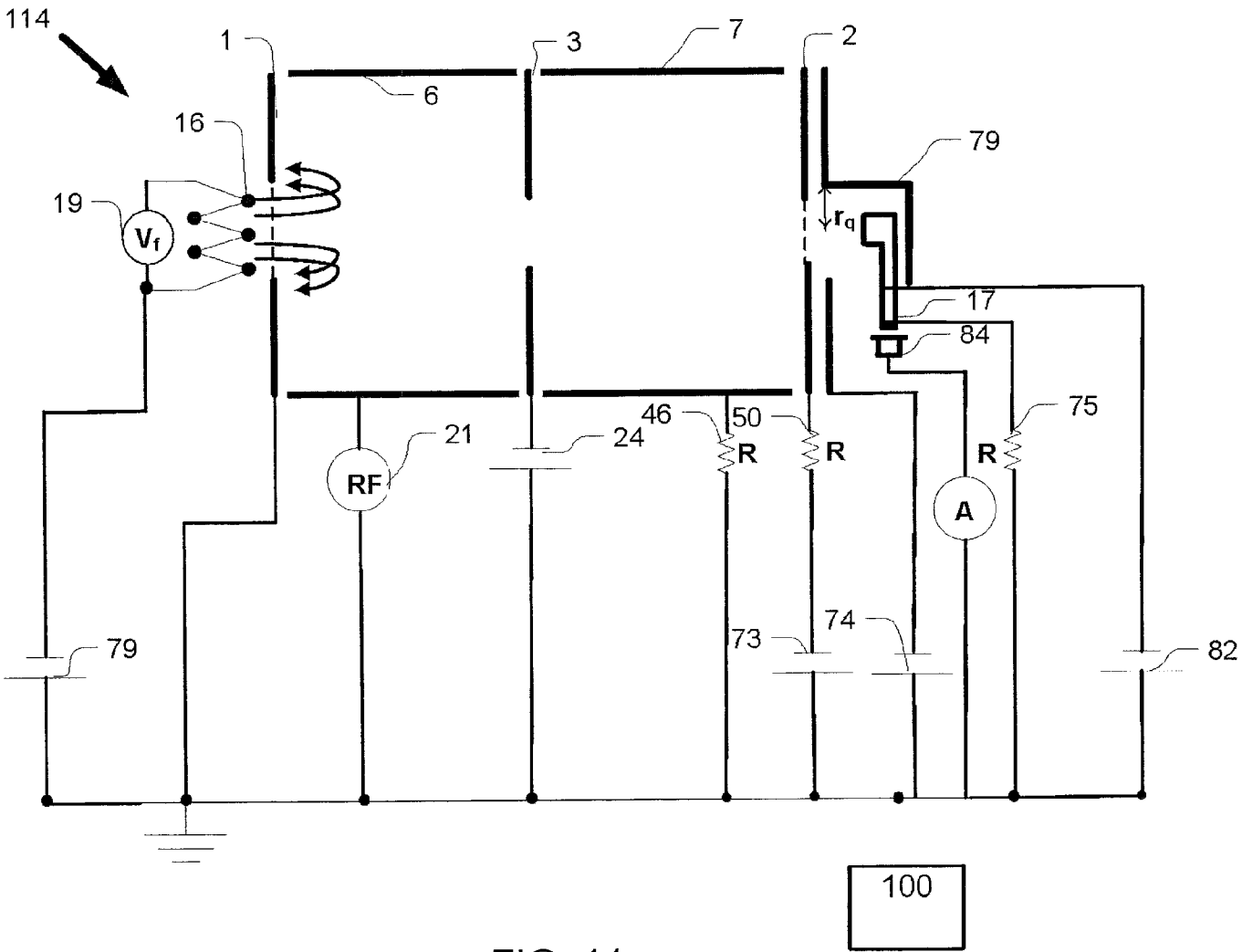
FIG. 11 is a schematic diagram of an electrostatic ion trap used to detect ions by measuring the amount of RF power absorbed from the AC excitation source.

Mass-selective ion detection can be performed by monitoring changes in the dissipation of RF power into the trap. As the frequency is scanned at fixed HV, or as the HV is scanned at fixed frequency, ions of different masses will come into autoresonance with the RF field and phase lock their oscillations with the RF field oscillations. The energy gained by the ions during autoresonant excitation is extracted from the RF field and it is possible to detect those abrupt changes in RF power consumption using dedicated circuits. For example, the RF power absorption can be detected and quantified with the help of "weakly-driven-oscillators" (WDO). WDOs have been used to detect energy absorption from RF fields in ion traps, such as, for example, for tracking ion oscillation in a Paul trap. See A. Kajita, M. Kimura, S. Ohtani, H. Tawara, and Y. Saito, *Anharmonic Oscillations of Mixed Ions in an RF Ion Trap*, J. Phys. Soc. Jpn., 59 (4) pp. 1127-1130 (1990). One embodiment of the ART MS ion trap used to detect ions by measuring changes in the electrical characteristics of the ion trap is shown in FIG. 11. The main differentiation from previous trap designs was that the entry/exit plate and cups were electrically insulated from each other. Having separate voltage bias controls for the cups and the plates was deemed necessary in order to better characterize the effects of image currents on the end plates. This trap was first characterized by applying the RF drive to the entry plate while grounding the entry cup through a 100 kOhm resistor. The ejection frequencies for water and Argon were measured for different transition plate voltages, and the following scan conditions: 1.25 MHz to 375 kHz, logarithmic frequency sweep, 12 msec scan time, 50 mV RF $V_{p-p}$.

Figure 12:
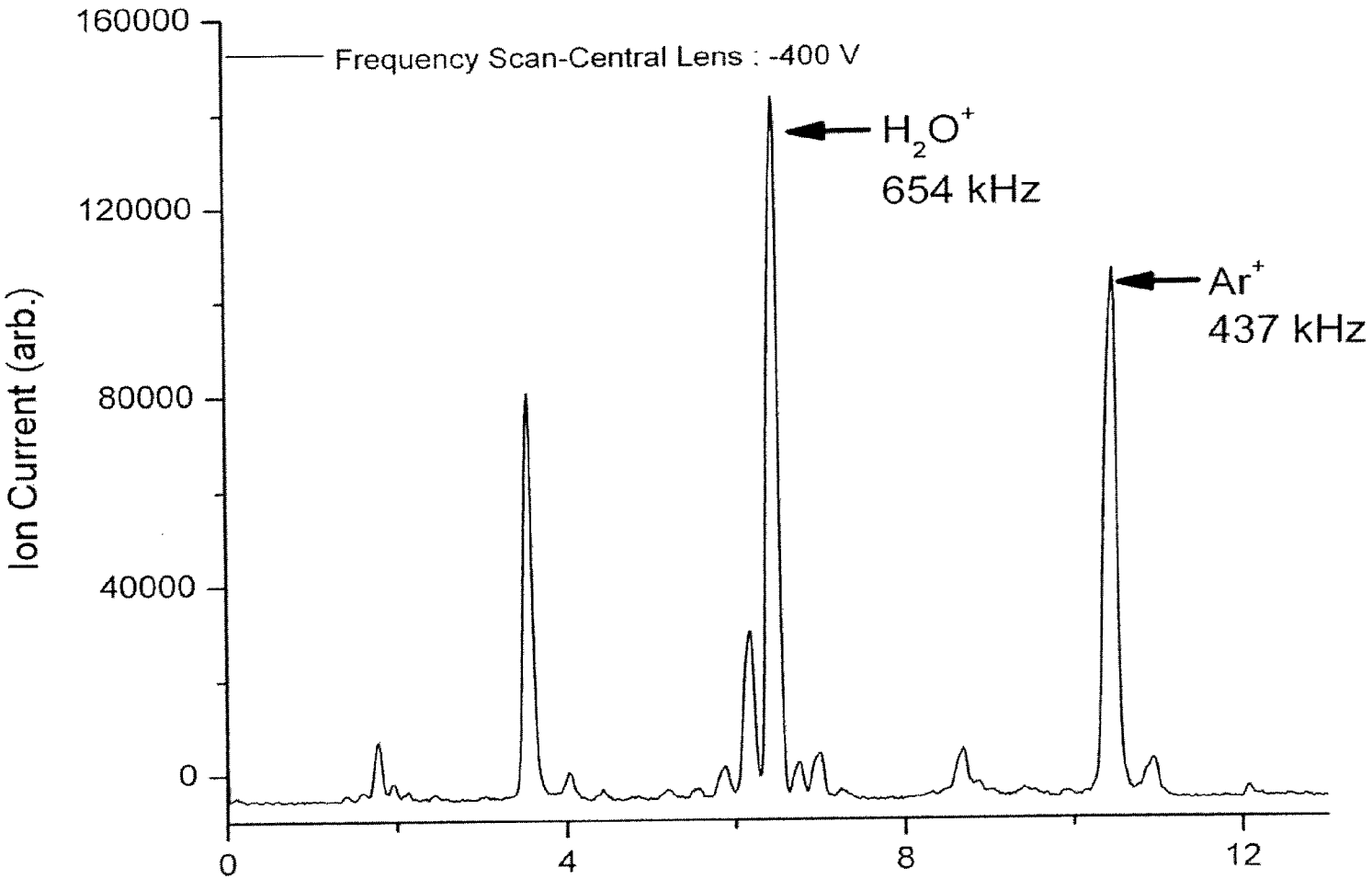
FIG. 12 is a drawing of a mass spectrum obtained with the ion trap of FIG. 11 and using a fixed central lens voltage of −400 VDC. The ejection frequency for water was 654 kHz and the ejection frequency for argon was 437 kHz. Ions were detected by an electron multiplier detector.

The ejection frequencies were compared to those calculated for the same two ions (water and argon) using SIMION. The data compiled in Table 1 shows that SIMION provided a very accurate measurement of the ejection frequencies for different voltages, showing that a) SIMION can be used to calculate ejection frequencies to within a few percent accuracy, and b) the ejection frequencies correspond to the oscillation frequencies of ions located adjacent to the entry/exit plates. Frequency scans were obtained between −1000 VDC and −300 VDC trapping potential. FIG. 12 shows a representative spectrum obtained at −400 VDC central lens trapping potential. The x-axis is the scan time as measured with a digital oscilloscope and the y-axis is the ion current in mV detected by electron multiplier 17 as provided by a SR 570 trans-impedance amplifier (Stanford Research Systems, Sunnyvale, Calif.). The observed Argon peak at 437 kHz compares well with the calculated ejection frequency of 448 kHz.

TABLE 1

Calculated and Experimental Ejection Frequencies

| Transition Voltage (-HV, Volts) | Water - Ejection Freq. kHz | Argon - Ejection Freq. kHz | Argon - Calculated Ejection Freq. kHz (from SIMION) |
|---|---|---|---|
| −1000 | 1033 | 692 | |
| −900 | 980 | 657 | |
| −800 | 924 | 619 | |
| −700 | 864 | 579 | |
| −597 | 800 | 536 | |
| −500 | 731 | 490 | |
| −400 | 654 | 437 | 448 |
| −300 | 568 | 380 | 386 |

Figure 13:
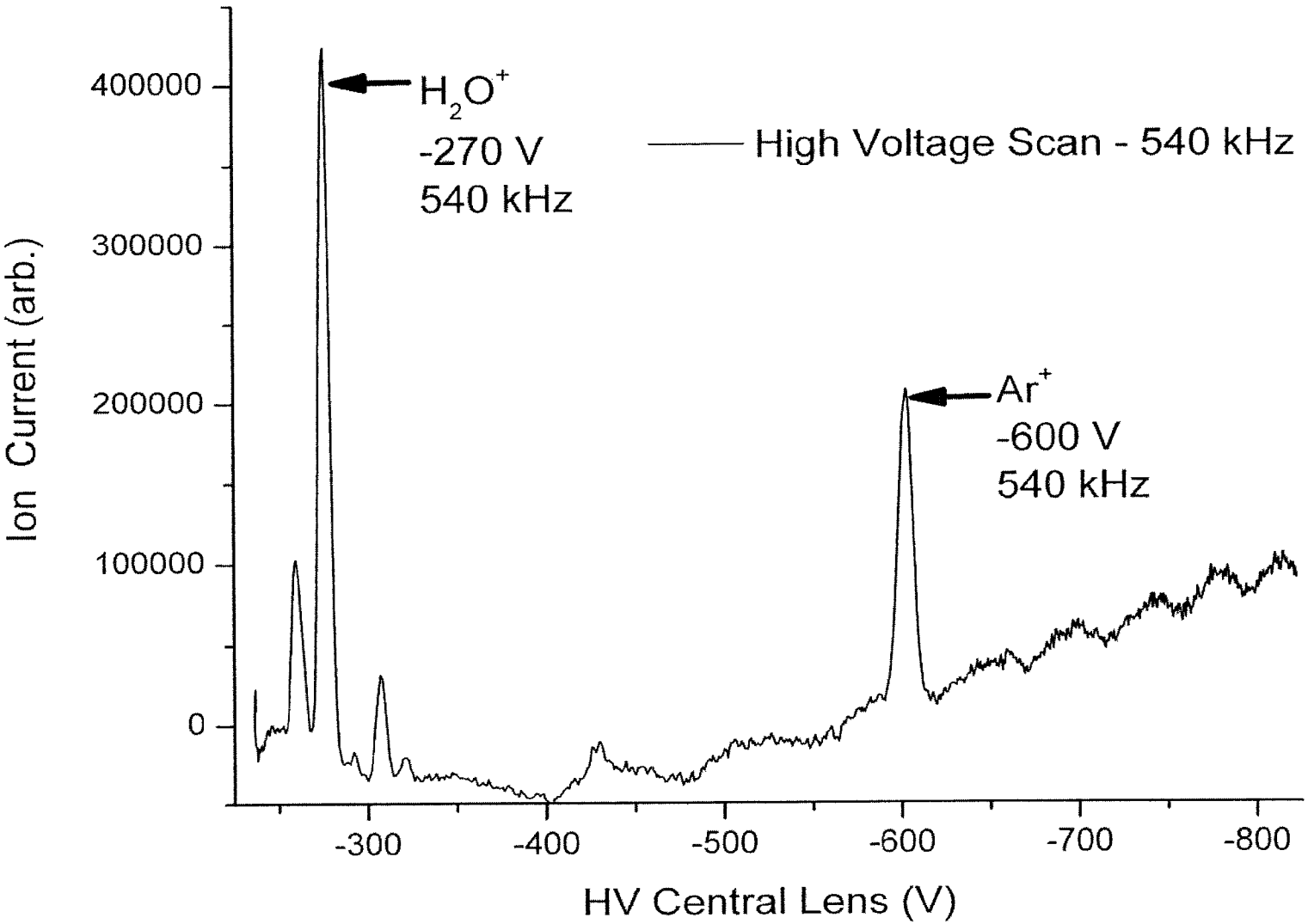
FIG. 13 is a drawing of a mass spectrum obtained with the ion trap of FIG. 11 by scanning the magnitude of the electrostatic potential, with a fixed RF frequency of 540 kHz. Water was ejected at −270 VDC, and argon was ejected at −600 VDC. Ions were detected by an electron multiplier detector.

The same trap shown in FIG. 11 was then reconfigured to perform HV scans (i.e., fixed frequency scans) using a HV multiplier circuit based on an EMCO HV module, model CA20N-5 (EMCO, Sutter Creek, Calif.). The HV on the central lens was scanned between approximately −200 VDC and −800 VDC while the AC excitation frequency was fixed at 540 kHz. Ion ejection was observed on both sides of the voltage sweep slope: autoresonant and reverse scans—i.e., ions were ejected whether the voltage was scanned upward or downward. The RF source was a FAWG, Agilent 33220 set to a frequency of 540 KHz with an amplitude of 120 $mV_{pp}$. The RF injection point for the RF was switched from the entry plate to the entry cup (as illustrated in FIG. 11) to avoid loading the output of the function generator with the electron current from the filament. Based on the previous frequency scan results (Table 1), Ar ions were expected to be ejected at a potential of approximately −600 VDC for the excitation frequency of 540 kHz. FIG. 13 shows the HV scan spectrum including water and Argon peaks, as detected by electron multiplier ion detector 17 (shown in FIG. 11). Argon was ejected at −600 VDC as predicted from Table 1. It is clear from FIGS. 12-13 that both frequency and HV scans can be used to generate mass spectra in this trap. FIG. 13 is an example of a HV sweep in which the HV was scanned in the direction of increasing amplitude—i.e., an autoresonant scan. Argon was ejected at −600 VDC whether the voltage was scanned in a direction of amplitude going up or down, that is, HV scans can be used for both autoresonant or reverse scan ejection.

Figure 14:
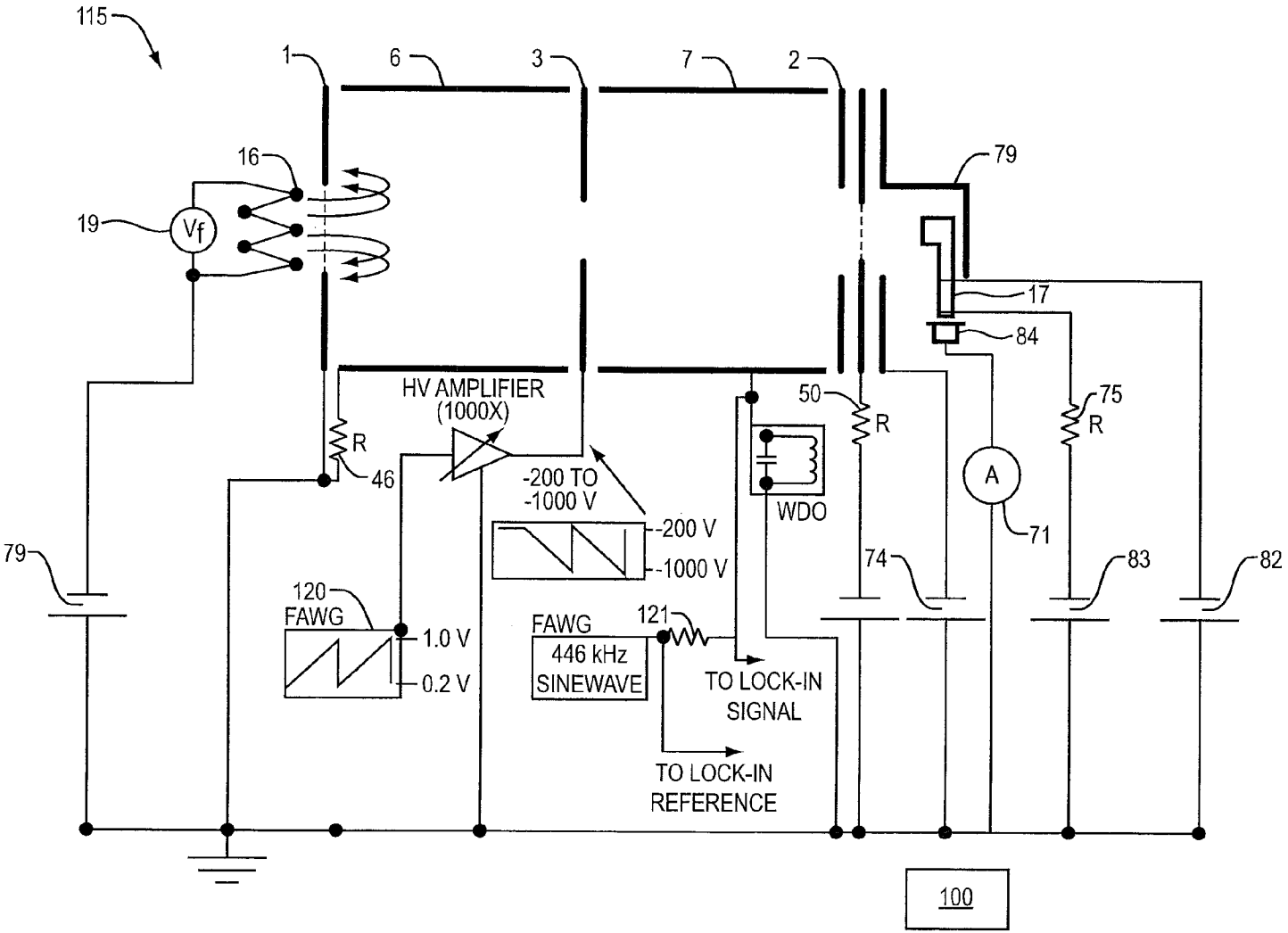
FIG. 14 is a schematic diagram of the ion trap of FIG. 11, with RF coupled into the exit cup 7, and configured to mass selectively detect ions by measuring the amount of RF power absorbed as the magnitude of the electrostatic potential varies.
Figure 15:
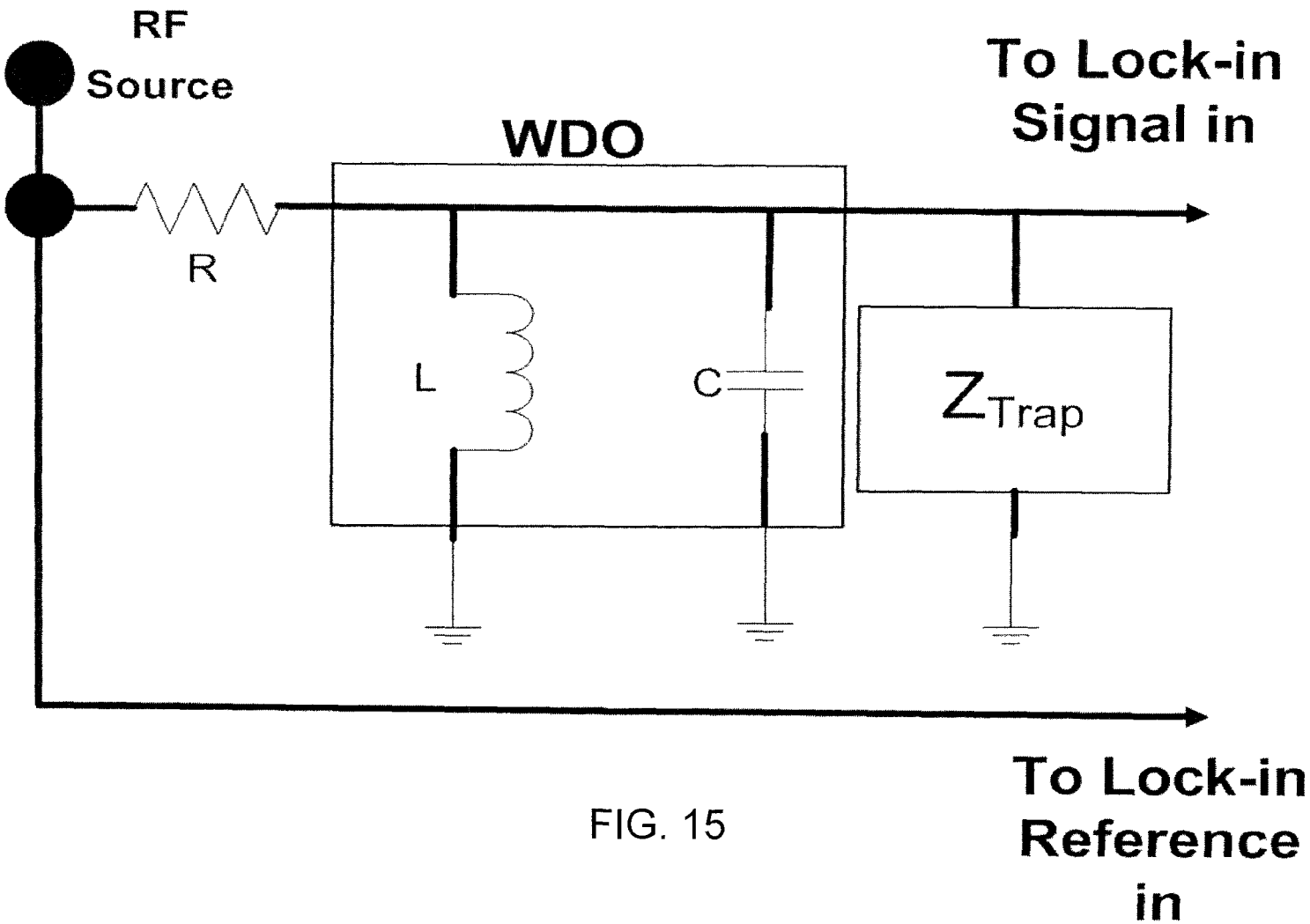
FIG. 15 is a schematic diagram of the equivalent electric circuit for the electrostatic ion trap and circuit of FIG. 14.

In another embodiment, the ART MS ion trap of FIG. 11 was modified as shown in FIG. 14. The RF was coupled into the exit cup 7 through a weakly-driven-oscillator (WDO) which resonated at a frequency of 446 kHz while physically connected to the trap. The WDO was designed as an LC tank circuit consisting of a 298 microH inductor and a 270 pF capacitor (ceramic) connected in parallel. A 500 KOhm resistor in series with the tank limited the amount of power the function generator could deliver to the LC tank so that the WDO delivered RF to the trap from its stored energy. The LC tank itself had a quality factor, Q≈100 at resonance, and provided a signal of 27 $mV_{rms}$ to the trap while the function generator output was set to 300 $mV_{pp}$. Connecting the tank to the exit cup, instead of the entry cup, provided much cleaner signals while monitoring the WDO output, as it prevented changes in the electron beam current from contributing to the phase locked output of the tank. The output of the WDO was monitored with a SR844 lock-in amplifier (Stanford Research Systems, Sunnyvale, Calif.). Ch1 (X) and Ch2 (Y) outputs of the lock-in amplifier were configured to display the amplitude (R) and phase (θ) of the WDO signal and connected to separate inputs of a digital oscilloscope. The resonant tank delivered AC signal to the trap, providing detectable drops in RF amplitude every time energy was absorbed from the RF field (i.e., tank losses). The lock-in amplifier monitored the amplitude of the WDO signal using the output of the function generator as the reference signal. In this simple electrical circuit, the trap could be electrically represented as an impedance load connected in parallel to the LC tank, shown as $Z_{trap}$ in FIG. 15. Measuring the RF signal in this phase-sensitive fashion provided two alternative ways to detect autoresonant excitation: 1) measuring power absorption from the trap by measuring drops in the amplitude of the WDO output, and 2) measuring the X and Y components of the RF signal, i.e., the change in the electrical impedance ($Z_{trap}$ shown in FIG. 15) of the electrode structure as RF power is absorbed by ions trapped inside the electrode structure.

Figure 16:
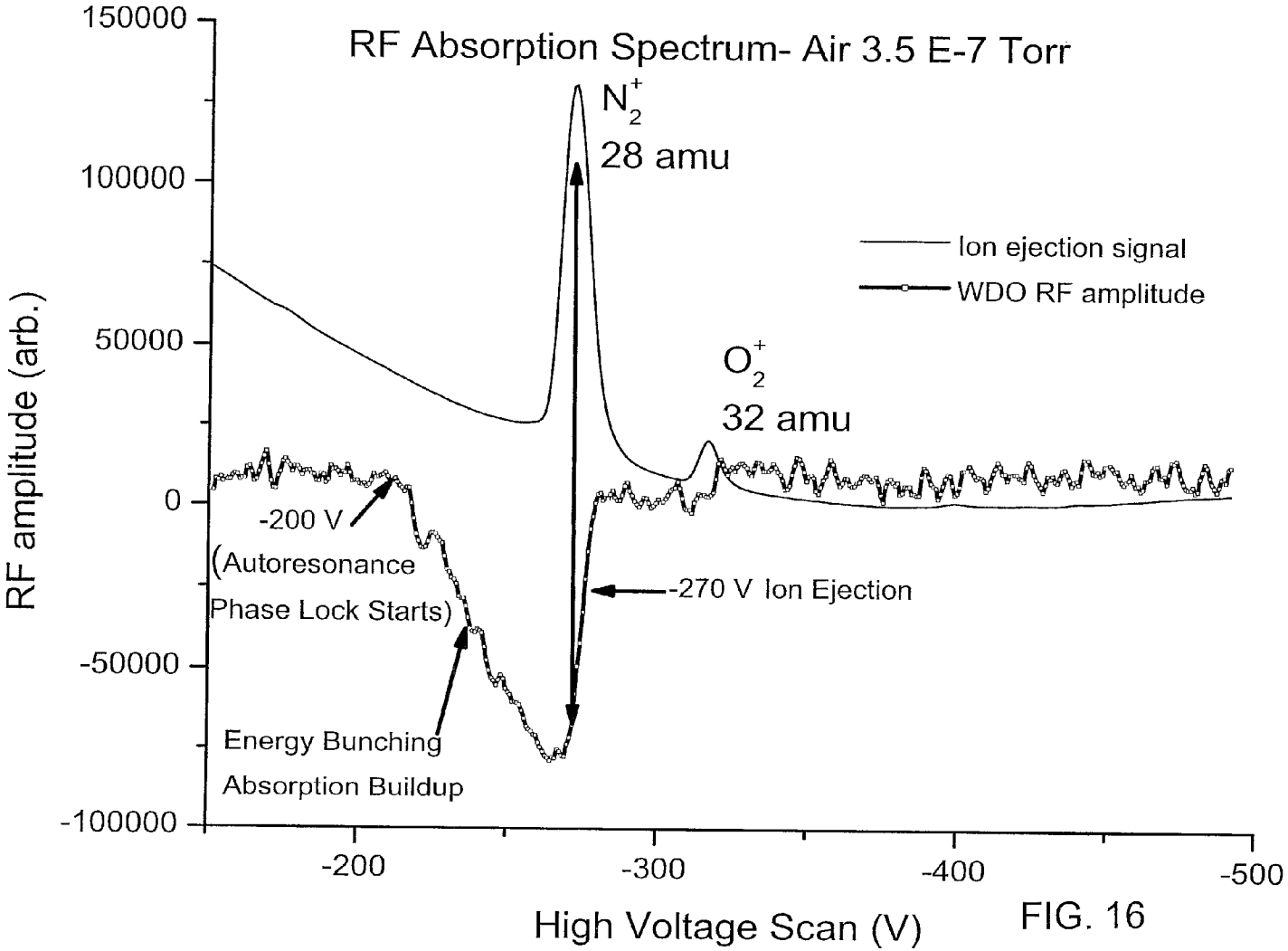
FIG. 16 is a drawing of a mass spectrum obtained by measuring the change in amplitude of the RF signal from a weakly driven oscillator source, as the magnitude of the electrostatic potential varies.

FIG. 16 shows an RF power absorption spectrum for air at 3.5E−7 Torr. Linear HV sweeps were generated with a high power HV amplifier (Trek Inc., Model 623B-L-CE) connected to the sawtooth output of a function generator. The AC excitation frequency was 446 kHz, the scan rate was 30 Hz, and the HV was scanned from −100 VDC to −600 VDC. The trace showing an upward peak corresponds to the ion ejection signal, i.e., multiplied ion current detected by the electron multiplier 17 (shown in FIG. 11). As expected there are two ejection peaks, one for nitrogen (−270 VDC, 28 amu) and one for oxygen (−310 VDC, 32 amu). Note that the electron multiplier 17 used in this trap design was only included to determine the exact voltage at which ions were ejected from the trap, whereas it will be described below that power absorption was all that was required to detect the presence of specific mass-to-charge ratios within the trap (i.e., the electron multiplier is not required for this detection method). The lower trace corresponds to the amplitude, R, of the RF output of the WDO as the HV is scanned. As expected, the RF amplitude drops as autoresonance starts (at HV=−200 VDC). The amplitude continues to decrease as the ions gain energy and ions of higher energy join them in an "energy bunching" process which is characteristic of autoresonant excitation in anharmonic electrostatic ion traps. The RF intensity decrease comes to an end as soon as the ions start leaving the trap and RF absorption can no longer take place. Ejection of nitrogen ions takes place at about −270 VDC (in agreement with SIMION model calculations), and, as expected, the RF amplitude returns to full intensity as soon as the phase-locked ions leave the trap or are absorbed by the walls of the exit plate. There are two ion ejection peaks and also two RF absorption transients, as would be expected for $N_2$ and $O_2$ ions. The fact that RF absorption starts at a HV amplitude much lower than the ion ejection voltage is a manifestation of the anharmonicity of the potential, and the fact that the drop in intensity is very gradual as the HV increases confirms that there is an energy bunching process in place, in agreement with current autoresonant excitation theories. The fact that the RF absorption ends abruptly when the ion ejection peak appears indicates that the ions are effectively ejected from the trap and/or absorbed by the walls of the entry and exit plates. RF power absorption has been applied to detect ions at pressures as high as $10^{-4}$ Torr, effectively increasing the pressure range for ART MS applications. RF power absorption is still detectable even if the conditions of the trap are adjusted so that no ion ejection is observed by the electron multiplier: i.e., RF power absorption was observed even if the RF amplitude values were adjusted to below the ejection threshold, or if the voltage of the exit plate was elevated to the point where ions could no longer exit the trap. Power absorption measurements are not affected by ion leakage out of the trap so that on-axis ionization is completely compatible with this detection scheme. It is possible to envision the use of RF power absorption detection to confirm the presence of certain species in a trap prior to excitation for collision-induced fragmentation.

Figure 17:
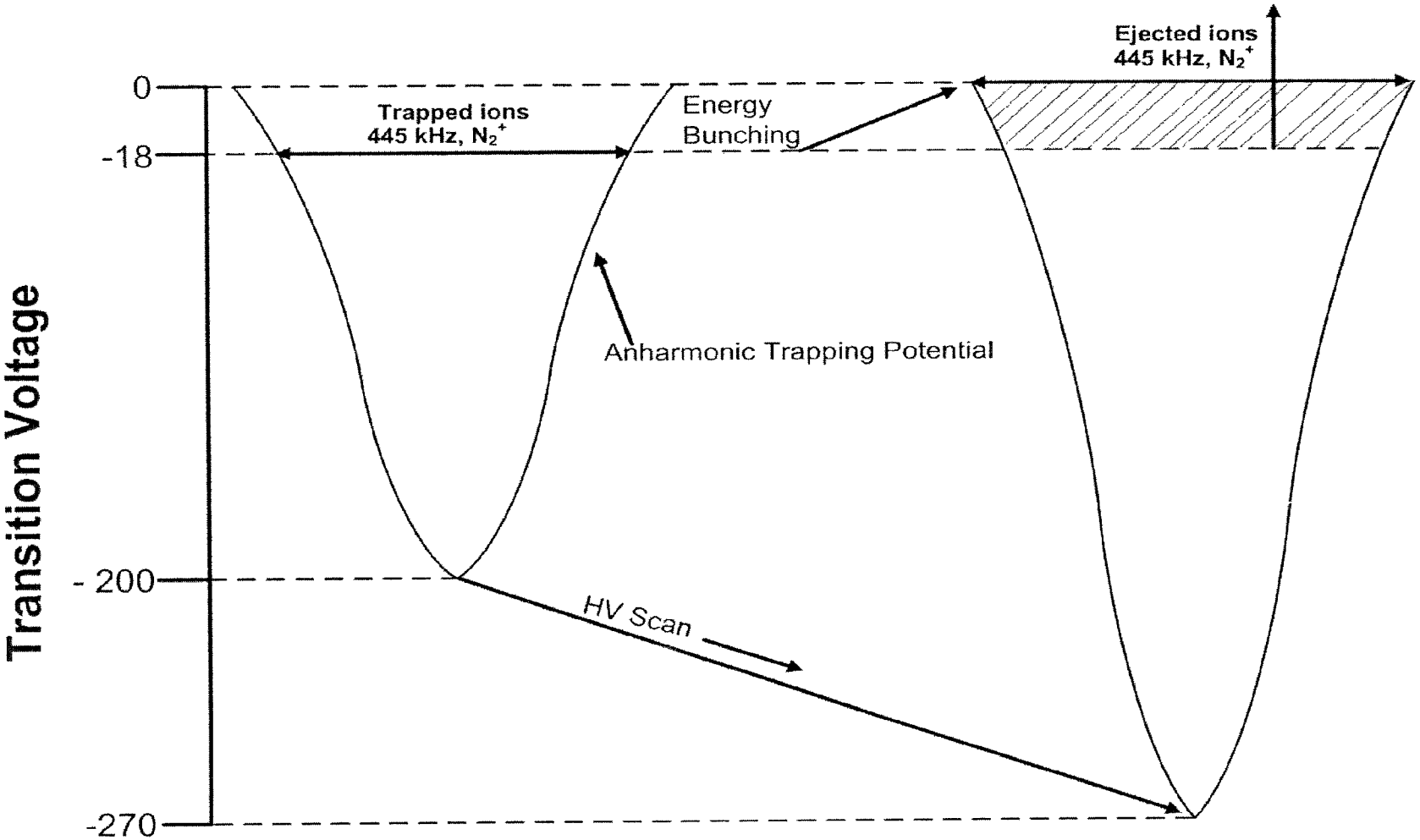
FIG. 17 is a drawing of potential energy wells at two points during a scan of the magnitude of the electrostatic potential, indicating the energy of nitrogen ions oscillating at 445 kHz at −200 VDC and −275 VDC transition plate voltage.
Figure 18:
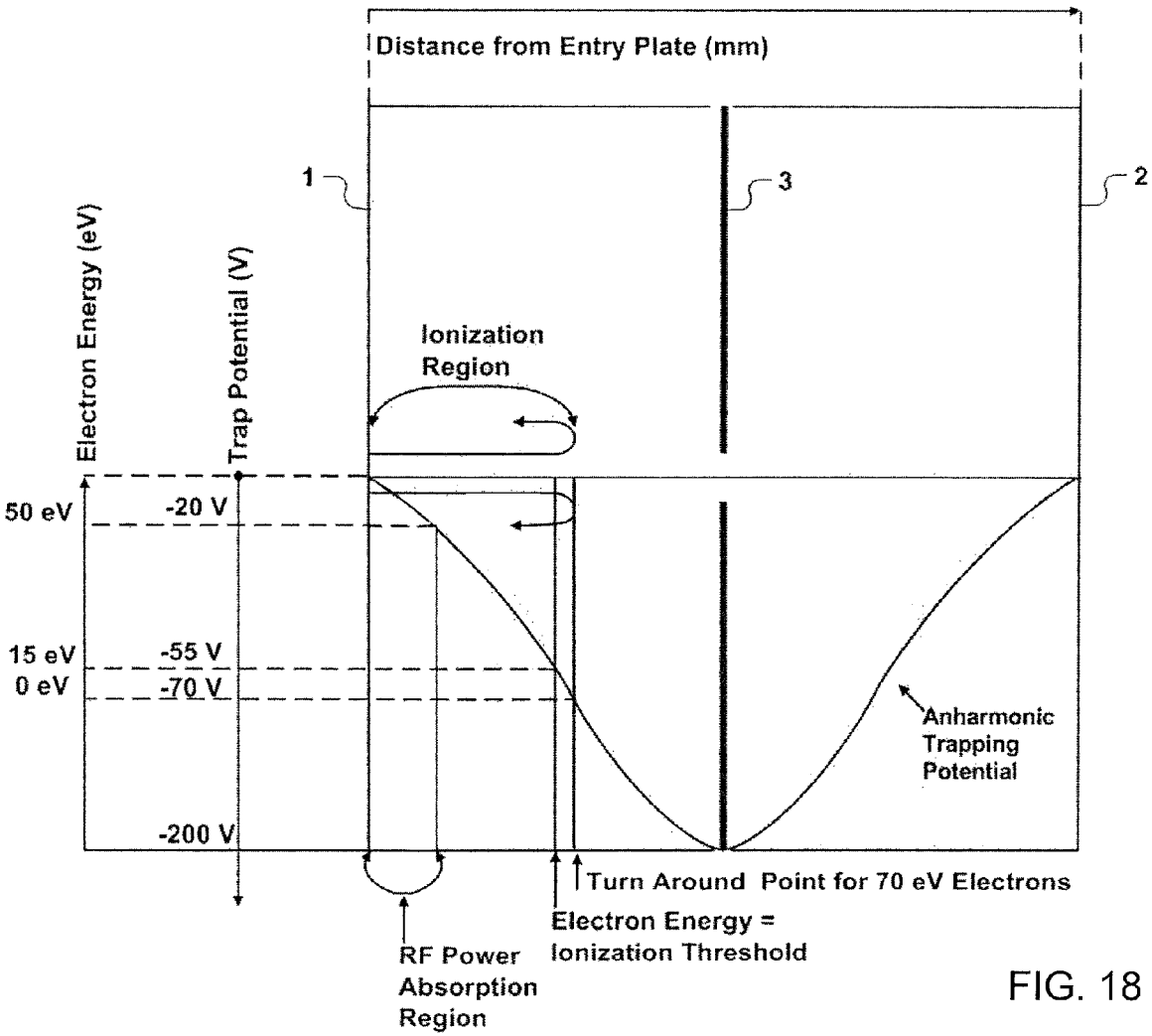
FIG. 18 is a drawing of electron energy as a function of distance in an electrostatic ion trap.

Since RF power absorption in FIG. 16 starts to be detectable at −200 VDC, SIMION was used to calculate the energy of the ions that first produce a detectable absorption signal as they phase-lock with the RF field. As calculated, using SIMION, for a −200 VDC trapping potential, nitrogen ions at the −18V equipotential oscillate with a natural oscillation frequency of 440 kHz, and are the first ones to provide detectable RF absorption levels for this detection scheme (see FIG. 17). It seems that using 70 eV electrons only produces significant (i.e., detectable) RF absorption signal for ions starting at the ≈−20 VDC equipotential. Ions at lower potential energies are present at lower concentrations (i.e., due to the lower efficiency of ionization of electrons penetrating further inside the trap), and do not produce a significant decrease in the RF signal as autoresonant phase-locking takes place. FIG. 18 shows the energetics of ions and electrons inside the trap. The electrons enter the trap with 70 eV of kinetic energy (KE) and turn around at the −70 VDC equipotential where they have zero kinetic energy. Since the electrons need at least 15 eV of KE to ionize nitrogen, no significant ion concentration is expected beyond (i.e., to the right of) the −55 VDC equipotential—i.e., the ionization volume starts at the entry plate grid and ends at the −55 VDC equipotential. Within the 0 VDC and −55 VDC equipotentials, the electrons have kinetic energies between 70 eV and 15 eV, which are all above the ionization threshold for nitrogen. However, ionization efficiency above threshold scales with electron energy and the density of ions formed by the electron impact ionization is expected to decrease as one moves away from the entry plate grid and into the trap (i.e., moving to the right in FIG. 18). Electrons with at least 50 eV of kinetic energy are needed in this trap to get a critical concentration of phase-locked ions that will provide a detectable drop in RF amplitude with this experimental setup.

Figure 19:
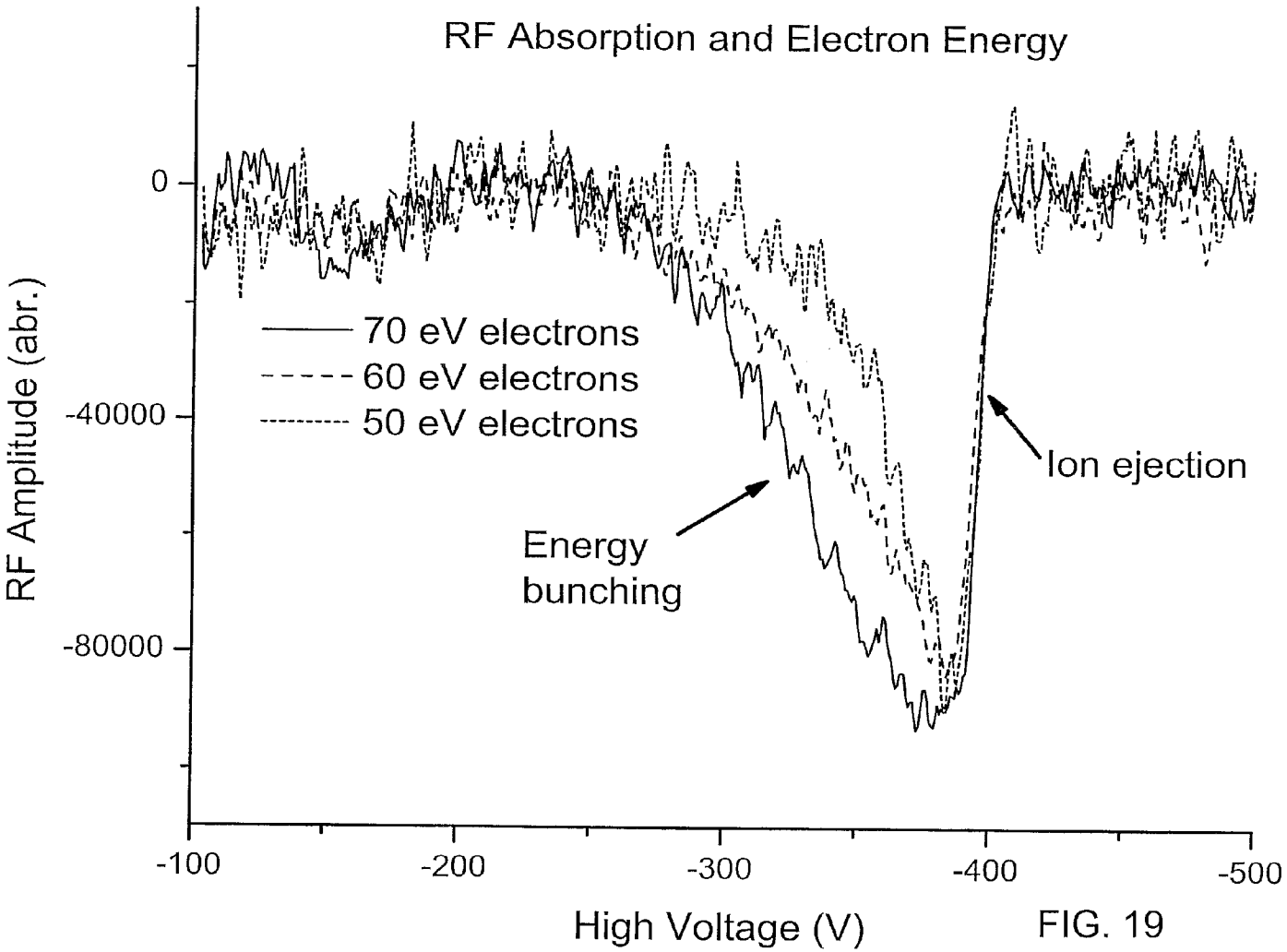
FIG. 19 is a drawing of mass spectra obtained by using 50 eV, 60 eV, and 70 eV electrons to create ions and measuring the change in electrical impedance of the electrode structure as the magnitude of the electrostatic potential varies.

As shown in FIG. 19, the width of the RF absorption band scales with the electron energy. As the energy of the electrons entering the trap decreases, the ionization volume also decreases and the range of energy of ions that can absorb RF power is reduced, causing the slope of the amplitude drop to be steeper as the electron energy is decreased from 70 eV to 50 eV, as shown in FIG. 19. The three curves in this plot were normalized in amplitude to highlight the difference in HV ranges. Changing the electron energy has no effect on the ejection voltage, but has a substantial effect on the range of voltage over which RF absorption takes place. As the electron energy increases, and the ionization volume inside the trap increases, the range of HV's over which RF absorption can be detected also increases. As shown in FIG. 19, the onset of RF absorption seems to change from roughly −250 VDC for 70 eV electrons to −300 VDC for 50 eV electrons. A similar reduction in the range of HVs over which RF absorption was observed also occurred as the gas pressure was increased.

Increasing the voltage on the exit plate to the point where no ions could escape did not negate the absorption signal and had minimal effect on the onset threshold. However, it generally reduced the slope of the abrupt ejection transient that is typically observed when the ions are allowed to escape the trap. When no ions are allowed to leave the trap the slope of the ejection curve is no longer as steep as seen in FIG. 19.

In HV scans, the ions of a specific mass-to-charge ratio lock up (phase lock) with the RF field at a certain threshold high voltage and, as the high voltage amplitude increases, those ions start gaining energy as additional ions (at higher energies) join the phase-locked bunch. The phase locked bunch of ions increases in population as the ions go up in energy, which is described as energy bunching. The increase in ion population is easily seen in FIG. 19 as a slow rise in RF absorption that starts at a HV amplitude much lower than the ionization energy voltage. As the ion bunch gains new ions and the bunch climbs in energy, the ions oscillate back and forth between the end plates with increasing oscillation amplitudes. A convenient way to visualize this event is by thinking about the center of mass of the group of ions oscillating back-and-forth between the two plates and getting increasingly closer to its walls. As the center of mass (CM) of the autoresonant ion bunch oscillates back and forth between the end plates, this dipolar oscillation is expected to induce image currents on the end plates. Since the dipole oscillation increases in amplitude, and the ions get closer to the walls as the HV increases, the image currents are also expected to increase as the HV is scanned. This increase in induced image current is also compounded by the fact that the accumulated charge in the CM also increases as additional ions are picked up through the energy bunching process which results from autoresonant excitation. Frequency dependent image currents are expected to provide a complementary detection scheme for mass spectrum generation in ART MS traps. Image current pickup can be accomplished in a variety of ways including end plate detection, center plate detection and even through the positioning of auxiliary induction coils and rings inside the trap volume. Inductive pickup has been used in the past for ion detection in mass spectrometers; however, prior art implementations have generally required the production of isochronous and isoenergetic ions in order to provide the required coherence for image current spike detection. ART MS traps have the advantage that ions can be introduced anywhere inside the trap and with no isoenergetic or isochronous requirements. Phase locking of the ion bunches of the RF field generated the coherent CM motion required to realize sensitive image current detection.

Figure 20:
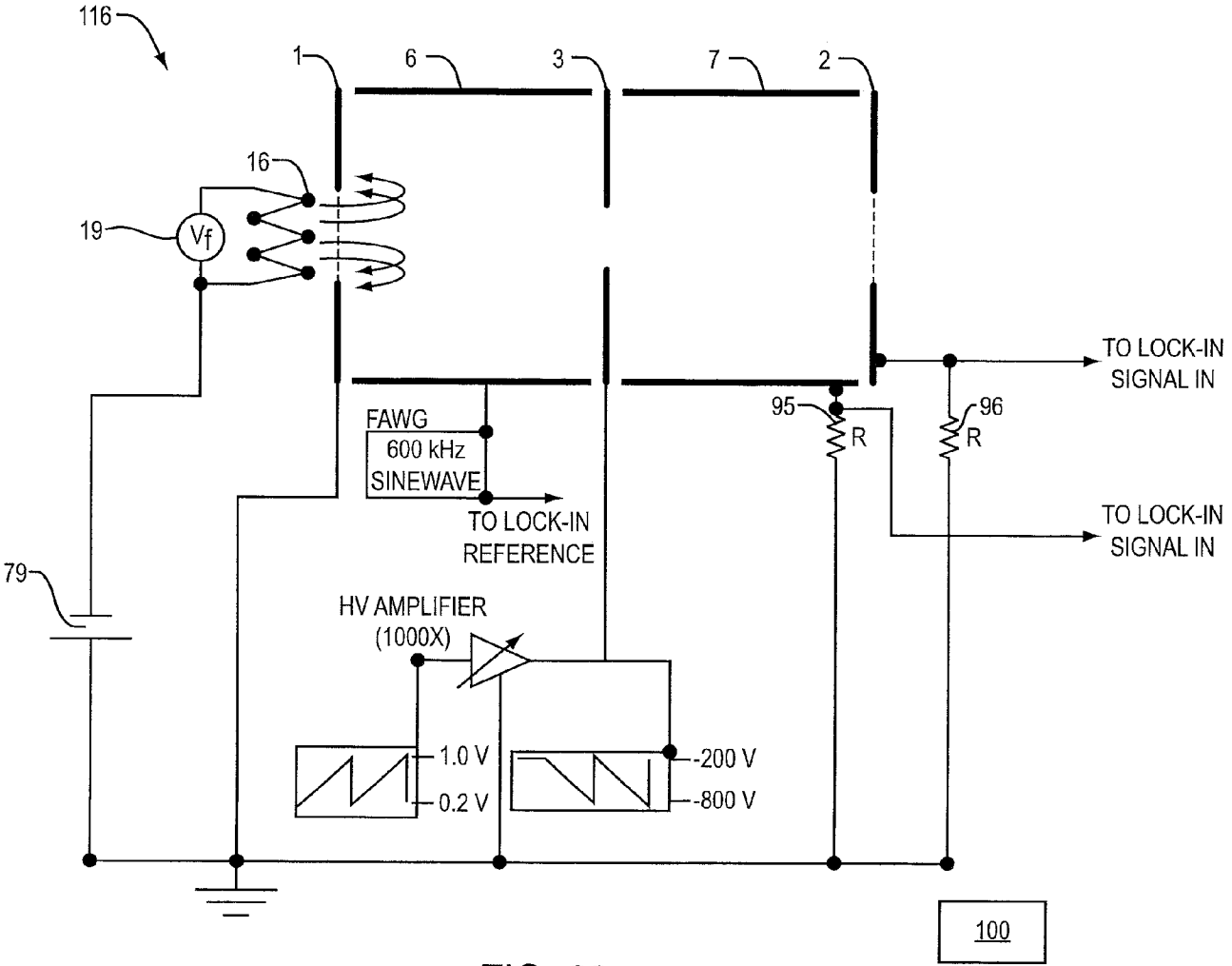
FIG. 20 is a schematic diagram of an electrostatic ion trap used to detect ions by measuring the change in coupled RF amplitude as the magnitude of the electrostatic potential varies.
Figure 21:
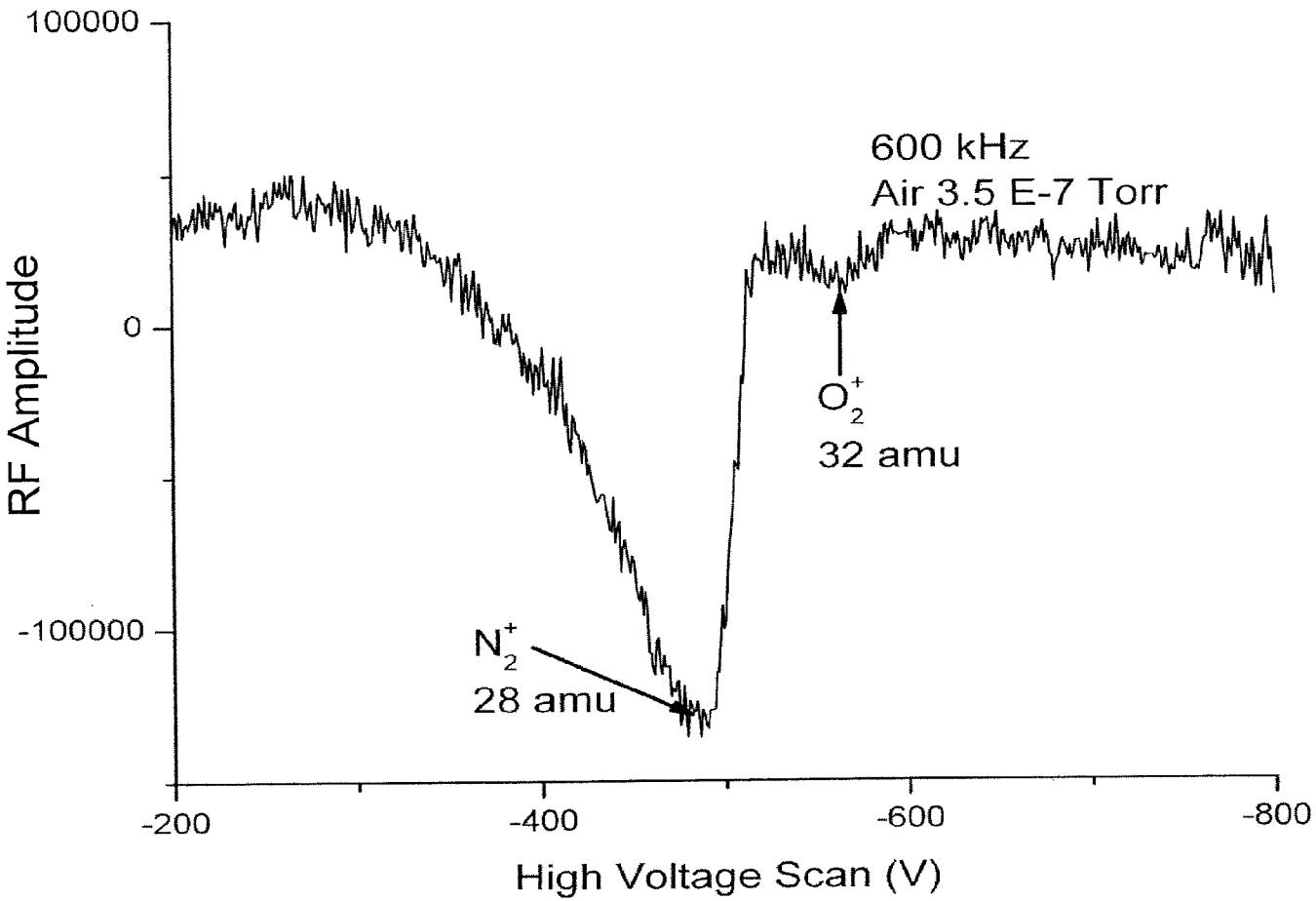
FIG. 21 is a drawing of a mass spectrum obtained by measuring the drop in coupled RF amplitude as the magnitude of the electrostatic potential varies.

A simple way to detect RF power absorption in a trap, which does not require a WDO, is to detect frequency dependent drops in "RF rms amplitude" at electrodes capacitively coupled to the RF source plate. RF power absorption inside the trap reduces the RF field intensity inside the trap and in turn diminishes the amplitude of RF capacitively coupled to adjacent electrode structures. From a purely electrical viewpoint, the drop in RF amplitude can be interpreted as a change in the impedance of the trap that affects the amount of RF coupling into electrode plates adjacent to the RF source plate. Therefore, using the embodiment of the ion trap shown in FIG. 20, slight changes in RF Field amplitude, or trap impedance, can be detected at the end plates, as the HV is scanned. Notice that this is a very simple implementation of a measurement relying on measurement of changes in the impedance of the trap. The RF from the FAWG was applied directly to the entry cup without a WDO. The RF signal from the FAWG was split and connected to the REF input of the lock-in for phase sensitive detection of image currents. The input of the lock-in was then used to phase-sensitively detect induced currents on the exit cup and on the exit plate. A lock-in amplifier is the ideal detector for this type of measurement since the coupled RF amplitude is phase locked to the RF excitation signal. First, the RF voltage applied to the entry cup was carefully monitored to make sure no dips in amplitude were observed as energy was absorbed from the FAWG by the phase-locked ions: the FAWG kept up with the power demands and no detectable changes in amplitude were observed at the entry plate. Then, the lock-in signal input was connected to the exit plate and a significant change in the amplitude of RF signal was observed while scanning at the frequency corresponding to the autoresonant excitation of ions. The amplitude changes observed at the exit plate are caused by the reduction of RF field intensity (i.e. or impedance changes) inside the trap. The signal is relatively easy to detect and measure, and follows the shape of the absorption signals collected with a WDO, as shown in FIG. 21, which shows an example of RF amplitude detection. The RF frequency was 600 kHz and the voltage was 100 $mV_{pp}$ connected into the entry cup. The nominal capacitively coupled RF amplitude on the exit plate was 0.5 mV with a +15 degree phase shift relative to the RF source (measured in the absence of gas load). The signal transient originated from $3.5\times10^{-7}$ Torr level of air, and both $N_2$ and $O_2$ signals are evident. The drop in RF amplitude at the exit plate is easily detected, and the shape of the curve shown in FIG. 21 is in good agreement with the power absorption curves described above, such as, for example, FIG. 19. In other words, the RF amplitude drops in association with the rate at which power is absorbed from the RF field. Both nitrogen and oxygen are clearly visible in the absorption spectrum shown in FIG. 21, demonstrating ion detection without ion ejection or electron multipliers. Once again, the abrupt edge at −500 VDC corresponds to the voltage at which nitrogen ions are ejected from the trap. The slower decrease in RF amplitude to the left of the ion ejection edge corresponds to the gradual buildup of charge density as the energy bunching effect takes place. The simple detection scheme implemented in FIG. 21 relied on the use of a lock-in amplifier to perform RF amplitude measurements; however, it is also possible to perform identical measurements, at very low cost, using modern RMS sensing methodologies and chips.

The decrease in the RF field intensity inside the trap as autoresonance takes place can also lead to interesting effects when a trap is operated with RF amplitudes very close to the ejection threshold. For example, mass peaks have been observed to disappear from a spectrum as the concentration of gas molecules corresponding to those peaks is increased and their RF power absorption inside the trap brings the RF field below the ejection threshold. In its most common manifestation, the main peak in the spectrum suddenly disappears from the spectrum as the gas concentration for that species increases, and the peak reappears as soon as the RF amplitude is increased bringing the RF field back above threshold.

Figure 22:
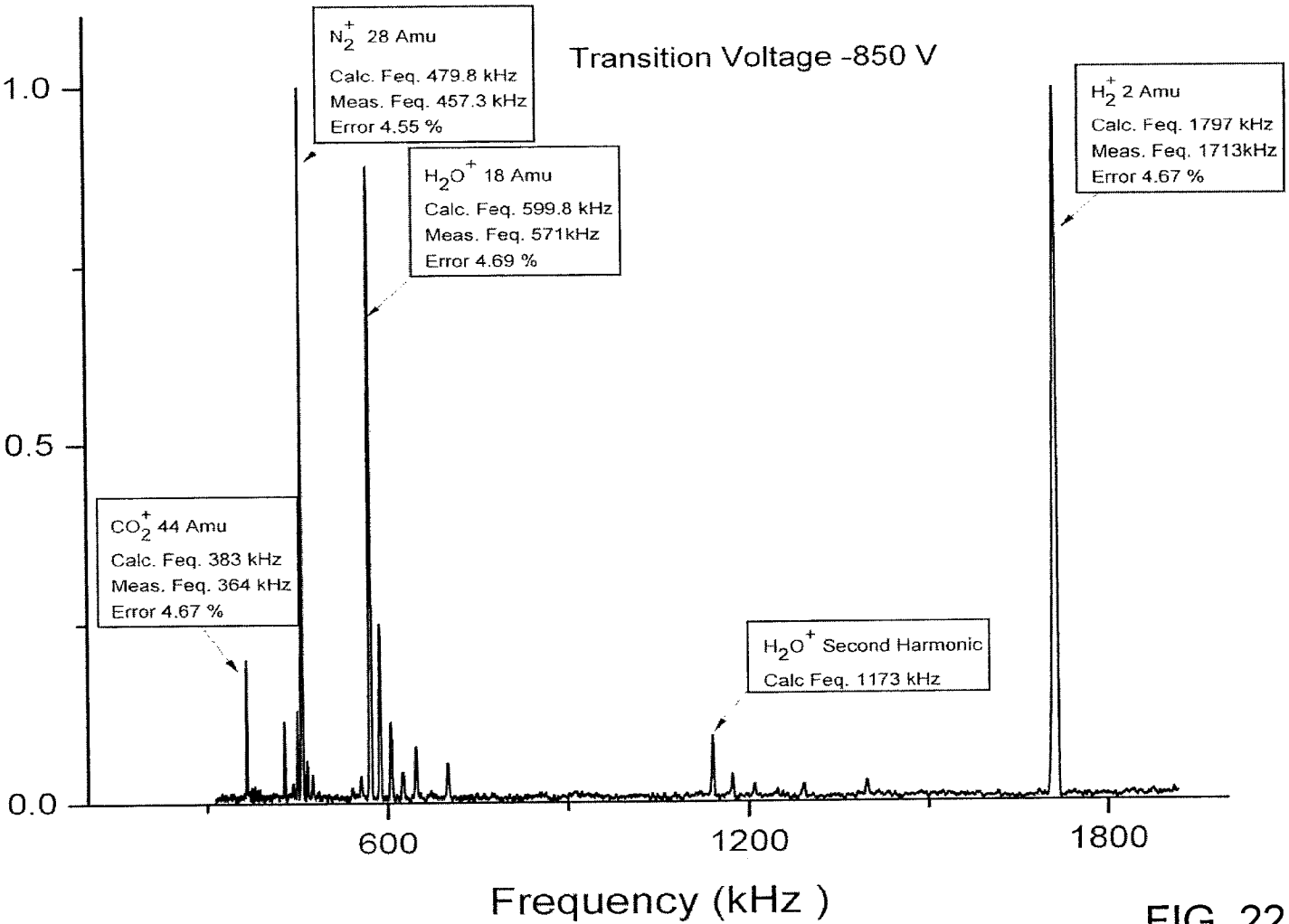
FIG. 22 is a drawing of a mass spectrum with calculated and experimental ejection frequencies.

As described above, ART MS traps rapidly and simply identify the masses of the molecules present in a gas mixture. As long as the gas can be ionized by the electrons, the corresponding ions will be detected in strict order of their mass-to-charge ratio. If the resolution is high enough at their mass, or in the absence of similar weight molecules, their presence will be easily identified by isolated peaks in a mass spectrum. In fact, ART MS devices are superior in terms of mass axis calibration to quadrupole mass spectrometers because they only require single gas calibrations, due to the strict and deterministic linear relationship between ejection frequency and mass, as shown in FIG. 22. ART MS devices are also excellent ratiometric devices. The relative amounts, i.e., relative concentrations, of the different species present in a gas mixture are generally adequately represented by the ratio of peak amplitudes in a spectrum. ART MS devices are also free of the zero-blast effect that affects the operation of small quadrupole mass spectrometers at low masses, making ART MS sensors excellent candidates for isotope ratio mass spectrometers. The zero-blast signal corresponds to a mass independent signal that floods and overwhelms the ion detector of a quadrupole mass spectrometer at low masses, while the RF/DC fields are too low to stop all ions from reaching the detector.

Figure 23:
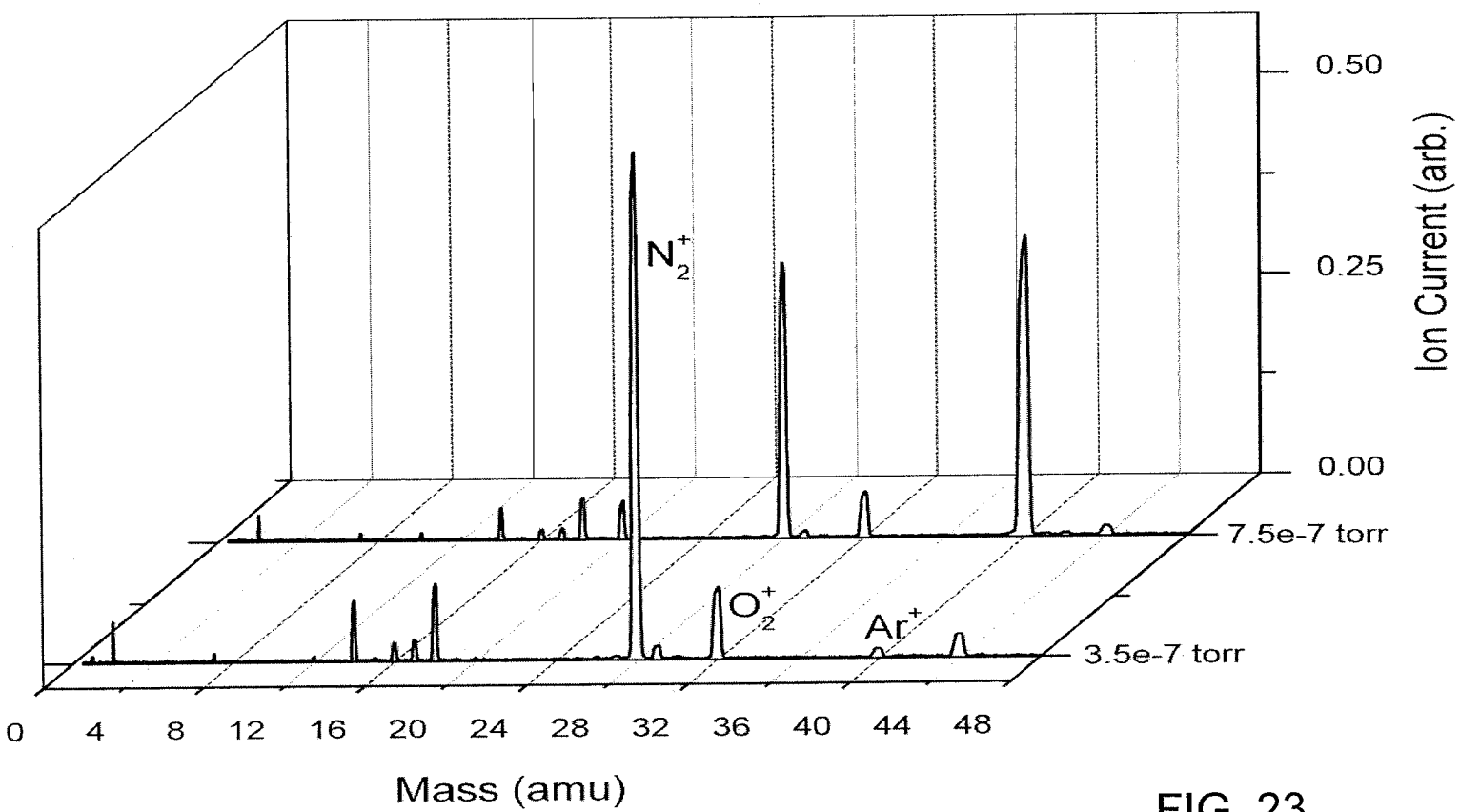
FIG. 23 is a drawing of mass spectra at $3.5\times10^{-7}$ Torr of essentially pure nitrogen and $7.5\times10^{-7}$ Torr of a 1:1 mixture of $N_2$:Ar by volume.

ART MS traps, however, do not provide ion peak signal amplitudes that scale with the absolute partial pressures of those components in the mixture, due to space charge limits on the ion trap that are difficult to calculate, and that set an upper limit to the number of ions of any m/q that can be stored in the oscillating ion beam. FIG. 23 shows an example of the charge density saturation effects that occur in ion traps. The front trace corresponds to a spectrum of air at a pressure of 3.5E−7 Torr. The rear trace corresponds to a spectrum obtained for the same air sample, but with an additional 4E−7 Torr of Argon added to the gas mixture. The two gases are detected in proper ratios, but the addition of argon ions to the trap displaced nitrogen and oxygen ions from the trapped beam in order to keep the ion density at the same total level. As a result of this charge saturation effect, quantitative operation of an ART MS device requires knowledge of the absolute total pressure in the system in order to normalize the ratiometric information provided by the mass spectra and to provide absolute partial pressure readings. There are at least two possible ways to acquire total absolute pressure readings with ART MS traps, in addition to independently measuring the total pressure in the vacuum system with an auxiliary pressure gauge, such as, for example, an ionization gauge.

Figure 24:
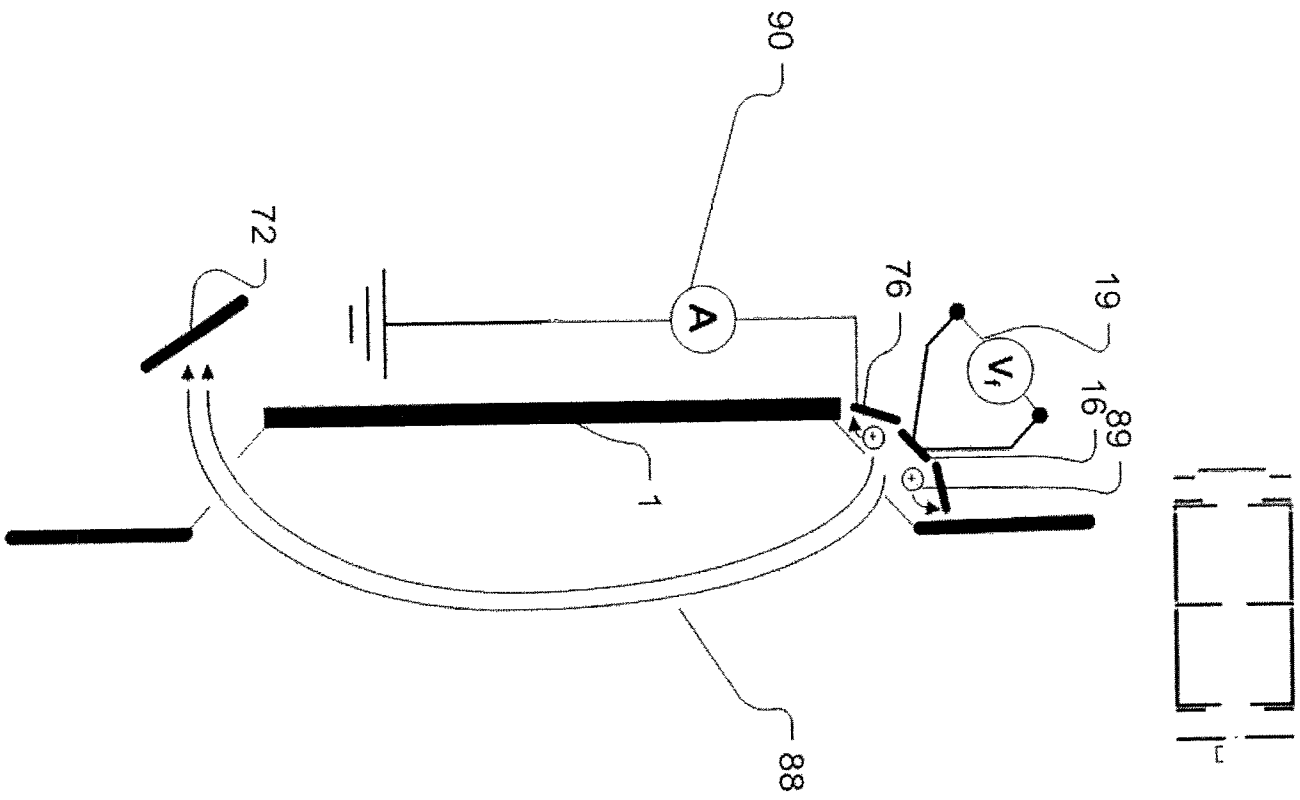
FIG. 24 is a schematic diagram of an ion collector that surrounds an electron emissive source.
Figure 25:
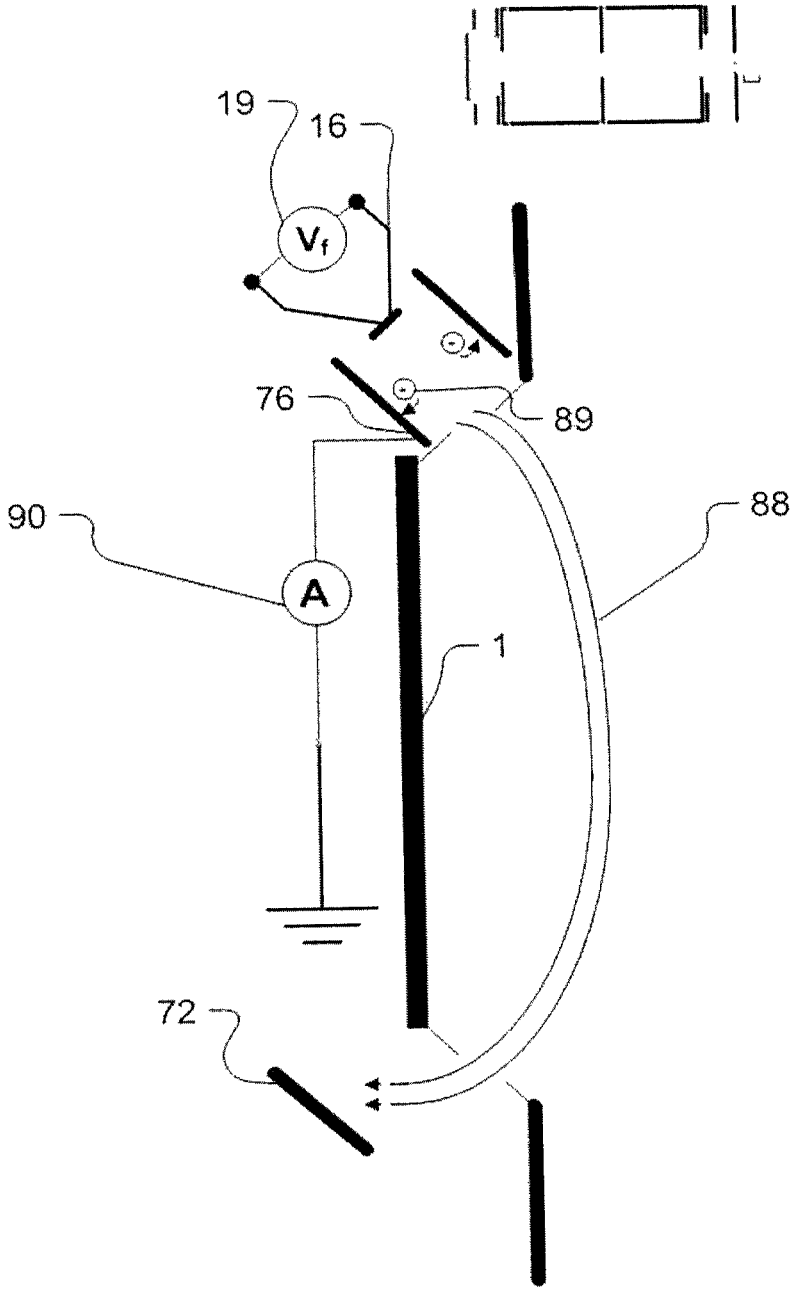
FIG. 25 is a schematic diagram of an ion collector shaped as a ring electrode adjacent to an electron emissive source.
Figure 26:
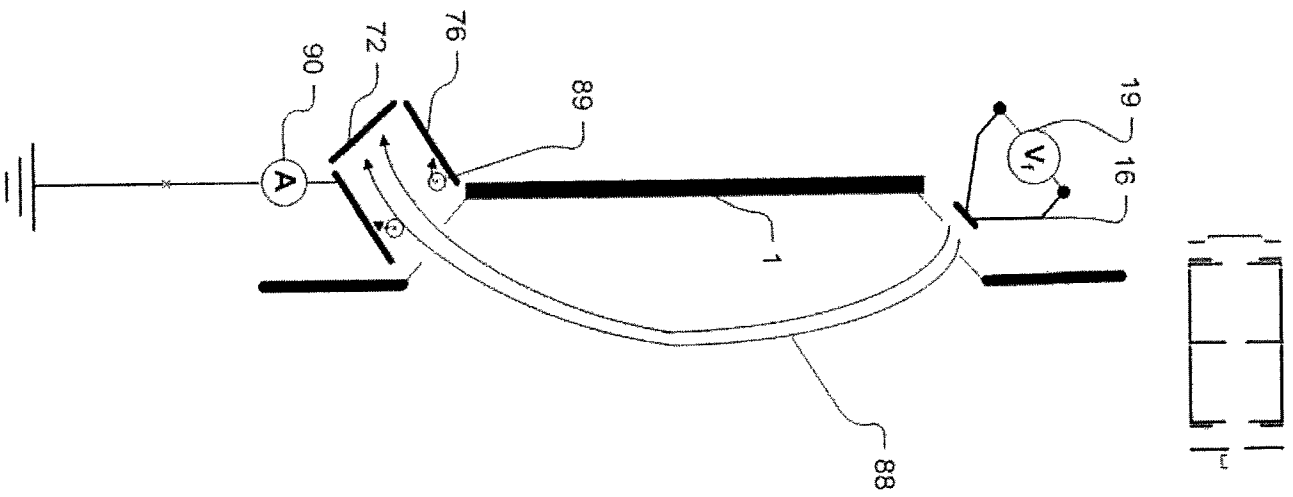
FIG. 26 is a schematic diagram of an ion collector shaped as a ring electrode located outside the entry plate.
Figure 27:
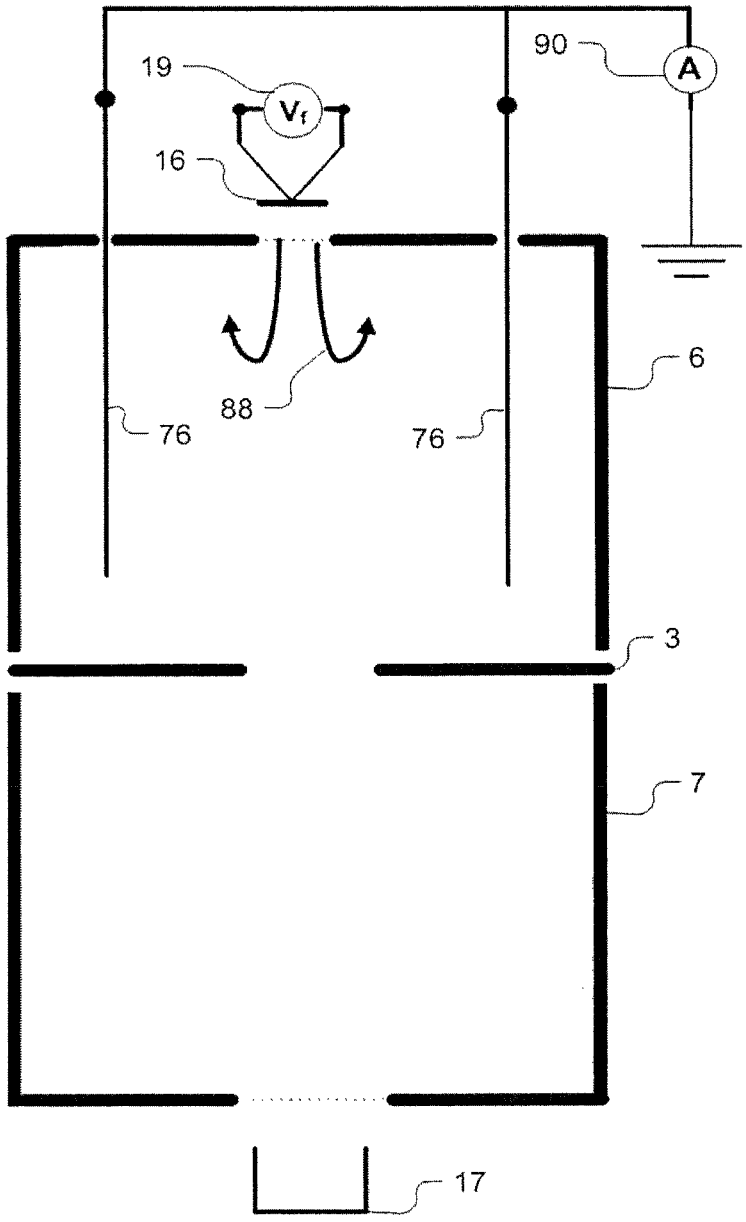
FIG. 27 is a schematic diagram of an ion collector located inside the electrode structure of the electrostatic ion trap.
Figure 28:
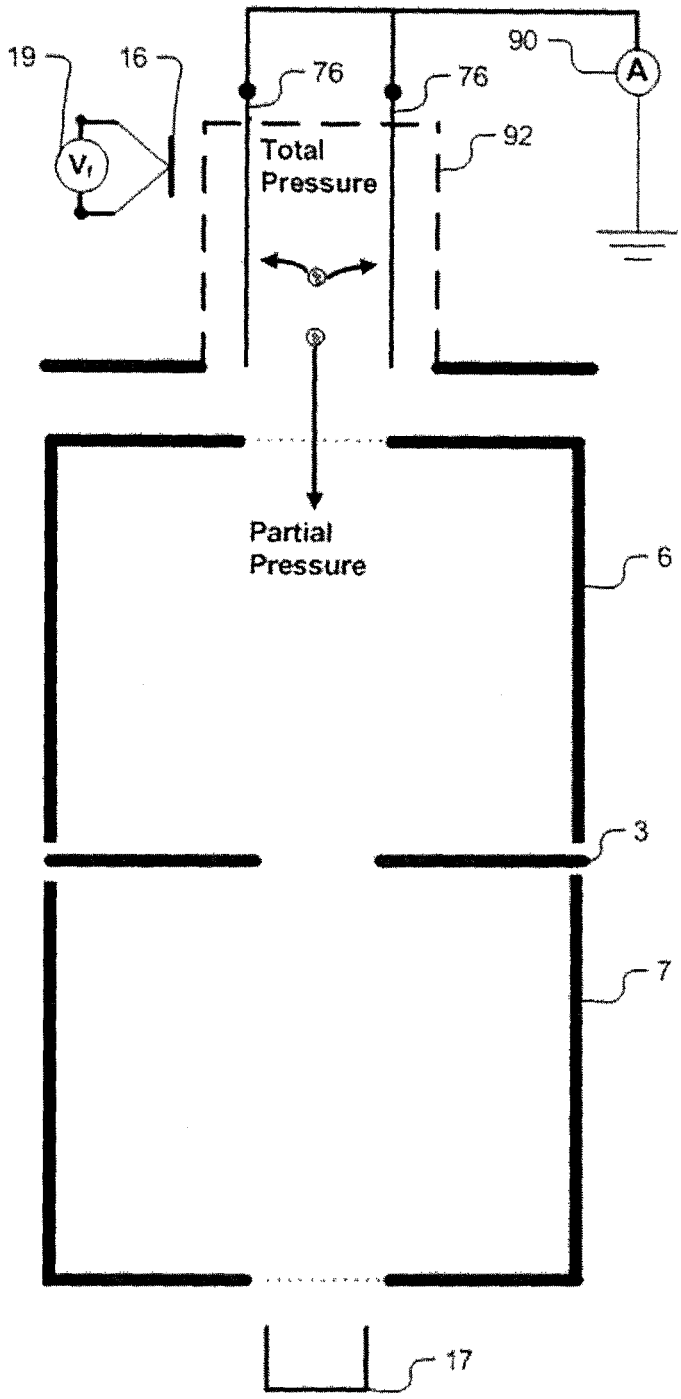
FIG. 28 is a schematic diagram of a combination total pressure measurement and partial pressure measurement apparatus employing an electrostatic ion trap.

The first approach is to measure ion currents collected by appropriately biased ion collector surfaces located inside or outside the electrostatic ion trap structure. Depending on the location and biases of the collector electrodes, the total pressure measurements can take place in parallel with the partial pressure readings, or can require transient interruption of the partial pressure readings in order to collect total pressure readings. Turning to FIG. 24, the external ion collector surface 76 can surround the electron emissive filament 16, wherein ions 89 formed by the electrons on their way into the trap are collected by the ion collector 76 formed of a surrounding shield or tube, to provide an ion current 90 that is proportional to the absolute total pressure. Alternatively, the ion collector 76 can be a ring or tube electrode, as shown in FIG. 25. The external ion collector surface 76 can also be located at the exit slit of entry plate 1 for the electron beam, as shown in FIG. 26, where the electron collector 72 is used to provide a measurement of the electron emission current. In another embodiment, shown in FIG. 27, the ion collector surface 76 can be located inside entry cup electrode 6. In this mode of operation, the entry cup 6 and the transition plate 3 are momentarily biased at the same voltage, preferably +180 VDC, and the ion collector electrodes are preferably grounded (0 VDC) so that ions are effectively captured by the collection surfaces 76. In yet another embodiment, shown in FIG. 28, a Bayard-Alpert ionization gauge can be connected in tandem to the trap. In this embodiment, the total pressure measurement is external to the trap, and only interrupted momentarily as a fraction of the ions is transferred into the trap volume for partial pressure analysis. During total pressure measurement, the bias voltage on ionization grid 92 is +180 VDC, same as for the entry cup 6. One or two grounded collectors 76 pick up the ions formed inside the grid by electron impact ionization providing an ion current that is proportional to the total pressure of gas in the system. In order to inject a fraction of the anode grid ions into the trap volume, the voltage on the entry cup is momentarily decreased from about +180 VDC to about +170 VDC to pull some grid ions into the trap, and then raised back up to +180 VDC to trap the injected ions and perform a partial pressure analysis using ion detector 17, operating the ART MS trap in pulsed mode. The electron emissive source 16 is located off-axis relative to the electrode structure as in a typical Bayard-Alpert ionization gauge. An advantage of this approach is that the total pressure measurement can be combined with the partial pressure (mass) analysis, providing a high quality total pressure gauge capable of delivering both quantitative and qualitative partial pressure compositional analysis in a vacuum system. A tandem configuration, such as that illustrated in FIG. 28, is an excellent example of the combination gauge sensor configurations that are possible for ART MS technology. This type of configuration is also a good example of an instrumentation setup in which ions are formed outside the trap volume and injected into the trap using electrostatic gating pulses. For example, a similar setup can be envisioned to transfer ions exiting an ion mobility spectrometer (IMS) into an ART MS trap.

In a preferred embodiment, shown in FIG. 1, the ion collector surface 76 can be a plate, located inside the trap volume between the entry plate 1 and the entry cup 6, and includes an axially located aperture in line with the electrode structure. During a total pressure measurement, the ion collector surface 76 is biased at a voltage more negative than the bias of the filament 16, to attract and collect all ions formed between entry plate 1 and entry cup 6 while repelling any electrons from the filament.

The second approach to measuring total pressure is to bias the exit plate sufficiently unequally such that substantially all the ions escape the trap and are collected by an ion detector to form a total pressure reading. The ion collector can be a simple electrode operated as a Faraday cup collector, or an electron multiplier, as shown in the preferred embodiment illustrated in FIG. 1. If a voltage of about −15 VDC is applied to exit plate 2 shown in FIG. 1, then the anharmonic potential shown in FIG. 2A is sufficiently asymmetric, as shown in greater detail in FIG. 2B, that substantially all ions of all m/q ratios escape the trap together and are collected by ion detector 17 shown in FIG. 1. In practical applications, it is possible to rapidly switch the voltage on the exit plate to momentarily eject all ions formed inside the trap and to provide a fast total pressure reading with minimal interruption of partial pressure operation. Total pressure readings in the microsecond time scale are possible under this mode of operation. Such fast total pressure readings benefit from the use of an electron multiplier detector which provides the higher current levels required for high-speed electrometer readings (i.e., larger electrometer bandwidth). It has been observed that it is generally convenient to first raise the exit plate voltage momentarily before lowering its value to eject ions. Increasing the voltage on the exit plate forces the ion cloud further into the trap and avoids the large transient ion current spike that typically exits the trap when the exit plate voltage is switched down. Large current spikes can overwhelm the electron multiplier detector and cause the electrometer to take extra time to dwell into steady state ion current readings after the exit plate voltage switches down.

In yet another approach, it is also possible to obtain useful total pressure readings from auxiliary gauges, simultaneously present in the vacuum system, using their independent readings to scale the ratiometric partial pressure measurements of ART MS to provide absolute partial pressure readings. A common implementation is to build analog input ports into the ART MS electronics control unit (ECU) and use the analog and digital output signals from the auxiliary gauges to provide reliable, accurate and real time pressure measurement readings to the ECU's microprocessor and its control software. Digital and analog input ports can be added to the ECU to acquire pressure readings from the digital and analog output ports of the auxiliary gauge controller. A flexible I/O interface is the key feature required to interface with the wide range of commercial gauge technologies presently available and compatible with the pressure range of ART MS traps. External pressure readings can also be used to protect the filament and electron multiplier of ion traps as well as to decide the proper time in a process to activate the trap operation. It is also possible to envision synergistic interactions between external total pressure gauges and ion traps in which ratiometric partial pressure information delivered from the trap is used by the total pressure gauge controller in order to adjust and correct its gas-species-dependent pressure readings.

A partial pressure analyzer based on ART MS technology and including a total pressure measurement facility (internal or external) is capable of delivering total pressure measurements, ratiometric partial pressure concentrations and, with the proper computational capabilities built into the ECU, can also deliver absolute partial pressure readings. The calculations and algorithms required to derive absolute partial pressure readings from the combination of ratiometric partial pressure and absolute total pressure information can include varied levels of complexity and assumptions but are well understood in the art. The complexity level of the calculations involved depends on whether all ionic fragments, all molecular species and all ionization, extraction and detection efficiencies are known and/or considered for the multiple molecular species present in the vacuum environment. For the most common applications, including contamination analysis, leak detection and vacuum monitoring, a simple ratiometric representation of the abundance of the different peaks in the mass spectrum will suffice. However, some of the process oriented applications might require real time calculation of absolute partial pressure levels in order to keep process chemistries under strict control.

The first factor that needs to be considered when dealing with ART MS traps is that there is a limited charge capacity in the electrostatic trap—i.e., there is a limit to the number of ions that can be stored inside an ART MS trap. Any attempt to introduce new ions into a trap that is already at its charge saturation limit results in (1) the excess ions being ejected from the trap in order to make room for new ones and (2) a change in the chemical composition of the ion charge. This means that adding a new gas component into a gas mixture does not result in an increase in the amount of total charge inside the trap, but rather a shift in the relative concentration of ions for the species stored inside the trap. The total charge remains the same but the ratio of charge between the different species changes to reflect changes in gas composition. Changes in chemical composition of an ART MS trap are very fast and closely track changes in gas composition in the surrounding gas environment. The charge capacity limit of an ART MS trap is a complex function of: (1) the physical and (2) the electrostatic characteristics of the trap. The net charge content during operation depends dynamically on multiple factors including: (1) the electron emission current, (2) the total pressure, (3) the scan rate, (4) the RF amplitude, etc. For the electrostatic trap used in the ART MS trap, full charge (i.e. charge saturation) is achieved at pressures as low as 1E−7 Torr (i.e. assuming emission currents above 100 μA, ≈40 mV RF Vpp, and typical 80 msec scan times).

Figure 33:
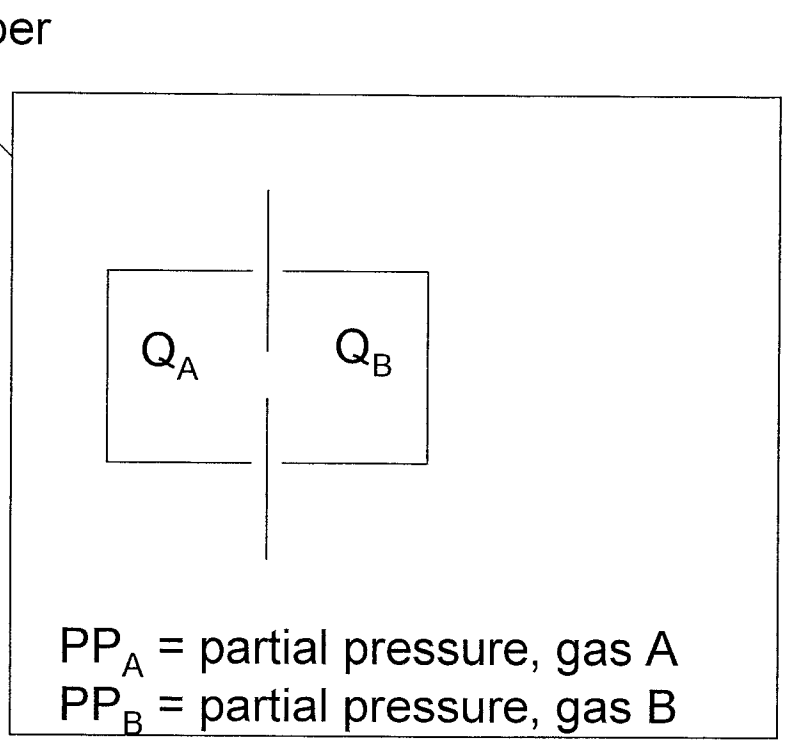
FIG. 33 is an illustration of two gases present in a vacuum chamber.

Gas molecules are ionized inside the trap in proportion to their partial pressures, but their relative contribution to the total charge is weighted by their relative ionization efficiencies. For example, for a 50/50 mixture of two gases, the gas with the larger ionization efficiency will contribute relatively more charge inside the trap—i.e. in proportion to the ratio of ionization efficiencies between the two species. FIG. 33 shows an example in which two gases are present in a vacuum chamber. Gas A is present in a partial pressure $PP_A$ and gas B is present in a partial pressure $PP_B$. The two partial pressures add up together to the actual total pressure in the system which, as we will see below, is different from the total pressure reading reported from the ionization gauge. In this example gas B is assumed to have an ionization efficiency that is $X_{AB}$ times larger than A. For simplicity, we assume that each gas ionizes without fragmentation (i.e. only a main peak in the spectrum due to the parent molecule). At the charge limit, the ratio of charge between both gases is:

$$Q_B/Q_A=(PP_B/PP_A)*X_{AB}$$

Also notice that at the charge limit, the total charge inside the trap, $Q_T$, is a constant and equal to:

$$Q_T=Q_A+Q_B.$$

Figure 34:
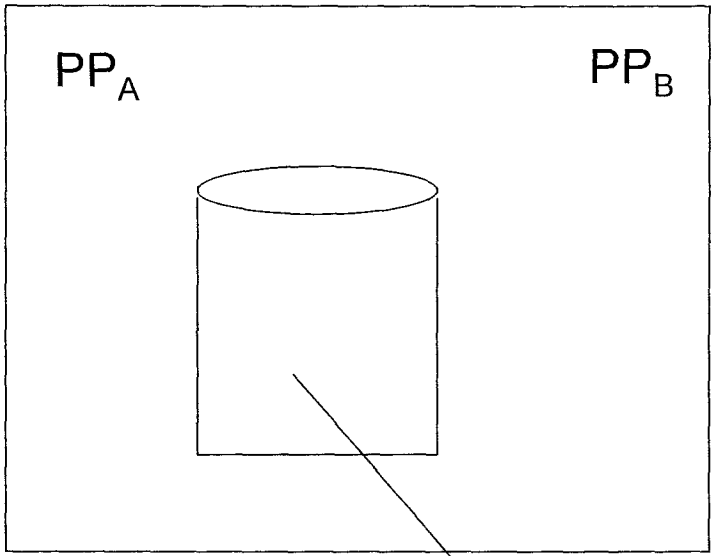
FIG. 34 is a derivation of the total pressure reported by an ionization gauge.

In a similar fashion, the ion current measured with an ion gauge for the same gas mixture is also weighted by the relative ionization efficiencies of both gases, as shown in FIG. 34.

The total pressure reported by the ionization gauge is:

$$P_T=PP_A+X_{AB}*PP_B$$

Notice that this is not the actual total pressure in the system ($PP_A+PP_B$), but rather the total pressure reported by the ionization gauge and weighted by the ionization efficiencies of the two gases.

Notice also that a common sensitivity factor, α, is used in the above calculation which is assumed to be the same for both gases: $X_{AB}$ acts as a correction factor which adjusts for the dependence of the sensitivity factor of the gauge on the ionization efficiency for the two gases. This is a very reasonable assumption since ions formed inside the anode grid of an ionization gauge are generally collected with the same efficiency independent of mass, but ionize at different rates proportional to their ionization efficiencies.

Figure 35:
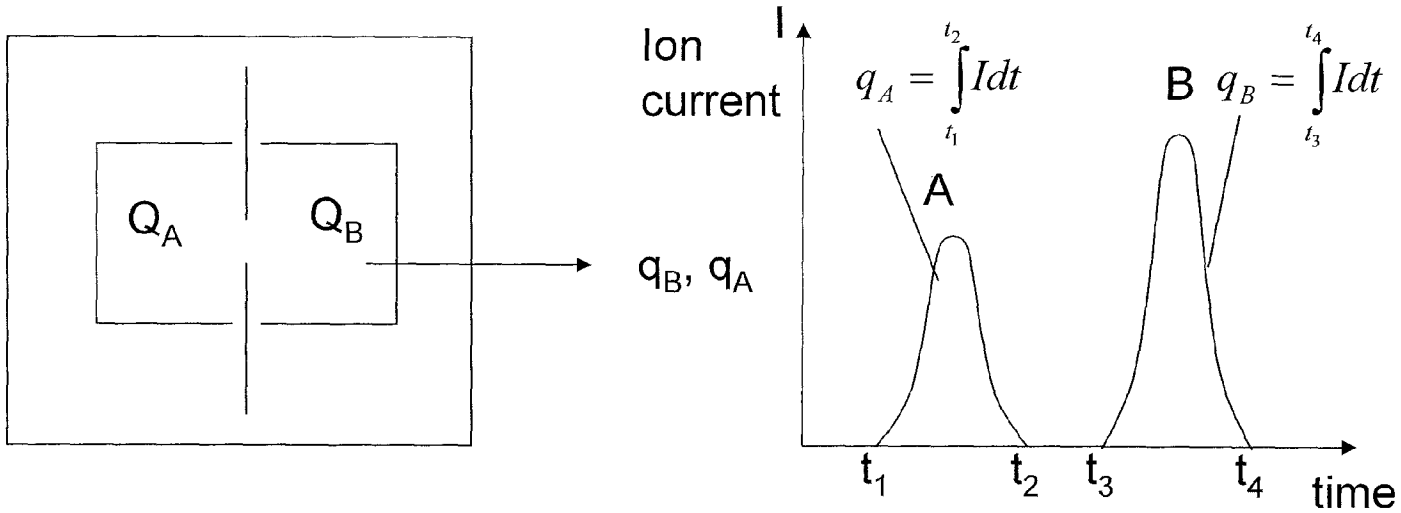
FIG. 35 is a derivation of the amount of charge ejected for each mass.

The mass dependent charge ejected from the trap during a scan is expected to be proportional to the amount of charge stored in the trap for each gas species. The amount of charge ejected for each mass can be calculated by integrating the mass dependent ion current as shown in FIG. 35. Notice that in this first example we assume a very simple case in which gases A and B result in a single peak (i.e. no fragmentation) and no spectral overlap exists between those two peaks. However, the same arguments can be extended if the entire fragmentation pattern package is considered in the calculations for each species.

The amount of charge stored in the trap for species A and B is proportional to the charge ejected from the trap for species A and B. The charge ejected is calculated integrating the ion current vs. time for the mass peaks corresponding to species A and B. In this example $q_A$ and $q_B$ are the charges ejected as part of the mass peaks in the spectrum corresponding to gases A and B.

In order to measure absolute partial pressures for gases A and B in the present example, a user must measure:

1. Total Pressure: $P_T$

2. Ejected charge for A and B: $q_A$ and $q_B$.

Calculation of peak charge requires: peak identification, peak integration and gas assignment.

The actual calculation of partial pressures is then very simple as it requires simple multiplications:

$$P_T*(q_A/(q_T))=PP_A$$

$$P_T*(q_B/(q_T))=X_{AB}*PP_B$$

This very simple calculation provides the breakdown of the ionization gauge current into its gas dependent constituents. Once the constituents are identified (i.e. through gas fitting) and the relative ionization efficiency factors are applied, it is then possible to remove the effect of ionization efficiency on the total pressure readings provided by the ionization gauge. In other words, once A and B are identified, and their contributions to the ion current are identified, then their actual partial pressures, $PP_A$ and $PP_B$, can be calculated and displayed. The "corrected" partial pressures can then be added up to provide a species-independent total pressure reading. The combination of an ART MS mass spectrometer sensor with a total pressure ionization gauge provides a very synergistic combination of sensors with ultimately leads to the ability to calculate absolute partial pressures and to report species-independent total pressures in real time.

The mathematical derivation is shown in FIG. 36 for gas A, and as described before, the effect of the relative ionization efficiencies cancels out when the ion current is combined with the relative charge.

For a more complicated gas mixture, with multiple gases, the calculations remain the same. The mass peaks for each species are detected and associated to the different gases present in the mixture. The charge contribution from each gas is obtained from deconvolution of the mass peaks and ion current integration. Once the charge contribution from all the gases is determined, the partial pressure of each component is calculated by multiplying the total pressure reported by the ionization gauge by the charge contribution (i.e. % contribution) of each gas species.

There are several assumptions implicit in the above calculation:

1. The trap is assumed to operate near, at or above its charge limit. This is not a big assumption especially considering the fact that saturation in small size ART MS traps is evident at pressures as low as 1E−7 Torr in the ART MS sensor. The integrated charge ejected from ART MS sensors operated above 1E−7 Torr seems to be independent of gas composition. The onset of charge saturation can also be adjusted by changing parameters such as trapping potential, scan rate and emission current. In addition the above calculations do not strictly depend on the trap operating at the charge limit, in fact, it is expected that this also works below such limit.

2. The charge ejection efficiency is not a strong function of mass under carefully selected frequency scan profiles. This assumption has not been strictly proven through focused experiments but seems to be validated by the accuracy of our absolute partial pressure calculations. The efficiency of ion detection is highly dependent on RF amplitude and on the scan profile selected. Strong mass dependence in ion ejection efficiency has been observed for linear sweeps and logarithmic sweeps. However, the ART MS trap operated with 1/f frequency sweep profiles seems to offer an ejection efficiency that is much less dependent on mass. Even if mass dependence were observed in the ejection efficiency, that could be included into the calculations as a mass dependent adjustment factor that could be easily calibrated. The number of ions of each gas species ejected from the trap is proportional to the number of ions of that species stored inside the trap—i.e. it is expected that the ratio of charge for ions ejected from the trap closely reflects the ratio of ion charges inside the trap. As a scan proceeds, a fraction of the ions stored in mass selectively ejected after each RF sweep. If continuous ionization is used, the trap is refilled during the rest of the mass scan since the trap is continuously loaded with new ions. Even though this assumption has not been strictly verified through experimentation, the accuracy of the absolute partial pressure measurement results supports this assumption.

3. The example presented above was based on a simple mass spectrum in which no fragmentation of parent ions takes place and no peak overlaps are observed. In reality, fragmentation is generally present for complex molecules. In that case it is necessary to account for charge by adding the contribution from all fragments corresponding to each species. This is very easy to do when no spectral overlap is present but gets more complicated when spectral deconvolution of the spectra is required. The total charge contribution from a gas species needs to be determined based on the contribution of the parent molecule ion plus the charge contribution from all its fragments. For example, nitrogen contributes ion charge at masses 28 and 14 amu, and both masses must be considered in order to determine the total contribution of nitrogen gas to the total charge stored inside the trap. In order to calculate the absolute partial pressure of the component in the gas mixture, it is necessary to account for the total charge contributed by that component to the ion trap stored charge, and that requires considering the contribution from all its fragments.

4. The mass dependence of the multiplier gain needs to be considered in this model as well. However, for the simplest calculations, no mass dependence for amplification is taken into account.

5. The collection efficiency of the ionization gauge is the same for all ions regardless of their mass. The correction factors needed to adjust sensitivity factors of ionization gauges for the other gases are related strictly to the ratios between ionization efficiencies for the different gases.

6. All the species stored inside the trap are swept out during each scan. In other words, for $q_T$ to be an adequate representation of $Q_T$, a scan of the entire mass range for the species stored inside the trap is needed.

The amount of charge that is ejected from the trap for each gas species needs to be measured in order to determine the amount of charge corresponding to each gas that is stored in the trap. If the gas molecule ionizes with no fragmentation, then its contribution to the total charge can be easily calculated, integrating the charge for its only mass peak over time for each scan. Since the ions are mass selectively ejected, and the ejected ion current is collected vs. time, this requires integrating the current under the peak vs. time in order to calculate the contribution of the peak to the total charge. This also means that it is necessary to integrate the ion currents generated during the scan for each peak detected in the spectrum in order to determine the contribution of each peak to the total charge. Notice that the amplitudes of the peaks are not an adequate representation of the relative charge for each peak, since higher masses have wider peaks and the charge gets distributed over their wider area of the peak. Fragmentation of the parent ions during electron impact also causes additional complications. If the gas ionizes with fragmentation, then the area for all of the fragmentation peaks needs to be identified and integrated. In cases where spectral overlap is present between the different gas species it will also be necessary to deconvolve the contribution of each gas to the overlapped mass peaks using spectral deconvolution techniques.

Once the contribution of each gas to the total charge inside the trap is calculated, the absolute partial pressure contribution from each gas component can be calculated by multiplying the total pressure by the relative contribution of each gas species to the total charge. Since the ionization efficiency weights the contribution of each gas species to both the ion current in the ionization gauge and the stored charge in the ion trap, the effect of the ionization efficiency is cancelled out in this process. This is an advantage of ART MS traps which is not shared by quadrupole mass spectrometers. The combination of the ionization gauge current readings and the ART MS charge integration makes it possible to remove the gas dependence from the absolute partial pressure calculations.

In order to perform an accurate absolute partial pressure calculation, the following steps must be followed:

1. A mass spectrum is collected and stored in memory. This can be a single spectrum or an average spectrum, depending on speed and dynamic range requirements for the data.

2. A peak finding algorithm is executed to identify all the mass peaks in the spectrum. Peak identification can be performed through a wide variety of peak finding algorithms and methodologies well documented in the literature. The exact way in which the peaks are detected and tagged is inconsequential to this methodology.

3. If peak overlaps are present at higher masses, then a peak deconvolution algorithm must be applied to break the broad peaks into individual components. For example, it is not unusual for small traps to provide unresolved isotopic envelopes for Xenon gas at approximately 130 amu. In that case, a peak deconvolution algorithm can be used to break the broad unresolved isotopic envelope peak into its individual integer mass components based on the known resolution of the device. Peak deconvolution algorithms are well known by mass spectroscopists and are part of many commercially available mass spectrometry analysis packages.

4. As shown in FIG. 35, the areas under the identified peaks are integrated against time to determine their contributions to total charge. The integration of ion current must be done over time to provide the measure of charge ejected from the trap at that particular mass.

5. All the identified peaks and their contributions to the total charge are then fed into a gas identification engine which assigns the peaks in the spectra to individual gases and resolves issues such as complex fragmentation patterns and spectral overlaps. Spectral identification relies on an accurate gas spectral library which includes the masses and abundances of the parent molecules and fragments for gases commonly found in vacuum systems. Most commercial libraries also allow user editing to include more rare gases that might be of interest to the user. Matching mass peaks to a spectral library can be performed through a variety of mathematical statistical procedures that are well known in the mass spectrometry industry.

6. The identified gasses and their individual relative contributions to the total charge are then used to calculate partial pressures.

7. Once the charge contribution, in percentage, is determined for each gas species identified, then those percentages are multiplied by the total pressure data as shown in the simple example above to yield the partial pressure contribution from each gas to the total pressure.

8. Once the contribution from each gas to the total pressure reading from the ionization gauge is determined, then ionization efficiency factors associated to the gases identified are used to eliminate the gas dependence for the partial pressure readings and to provide a gas species independent partial pressure reading.

Clearly there are many different ways to carry out peak identification, peak deconvolution, spectral deconvolution and gas identification. However, this application does not adhere to or prefers any particular procedure. The process of identifying peaks, resolving peak overlaps at high masses, calculating their contribution to total charge and identifying gases and determining their contribution to total charge is described very generically in order to drive the point that the details of implementation are not that important to this application.

One of the advantages of this general methodology is that it can provide accurate absolute partial pressure readings even if gas calibrants are not available. This is a big difference from quadrupole mass spectrometers where the unpredictable mass dependent throughput of quadrupole filters makes it impossible to calculate partial pressures without the aid of gas reference cylinders. An ART MS trap can provide accurate partial pressure numbers even if a calibrant is not available thanks to the uniformity of its mass ejection efficiency across the mass range and the cancellation of the ionization efficiency effects when the trap charge is combined with the ion current output of the ionization gauge.

The exact details of the peak identification algorithm are not critical to this application. Examples include Gaussian fitting, and Wavelet Analysis. The complexity and sophistication of the peak finding algorithm will depend on the hardware available to implement the algorithms and the amount of time available to complete the analysis before a new spectrum becomes available. The main requirement for this methodology is that most of the peaks be properly identified and spectral overlaps be resolved so that an accurate charge contribution calculation can be performed for each gas.

The exact details of the peak integration algorithms required to calculate charge are non-critical to this application. In its simple implementation, the area of a peak is calculated by multiplying the amplitude of the peak by the FWHM (full width at half maximum) in time. In more advanced calculations, the identified and fully resolved peaks are fitted with functional forms (i.e. such as Gaussians or Lorentzians) and the areas calculated mathematically. Gaussian fitting offers the additional advantage that it can be used to deconvolve multiple peaks buried under a common peak. Spectral overlap is expected to increase at higher masses as the FWHM of the peaks increases. For example, whereas most small ART MS trap have no problem fully resolving peaks 1 amu apart below 100 amu, the peak overlaps become serious above 100 amu and peak deconvolution is required to resolve isotopic envelopes and to resolve overlaps between species very close in mass. Peak deconvolution techniques can be applied in that case to fit the spectra and estimate the contribution of each isotope or gas to the total charge. In general, the width of the peak provides a first indication that there might be a spectral overlap that needs to be resolved.

Figure 37:
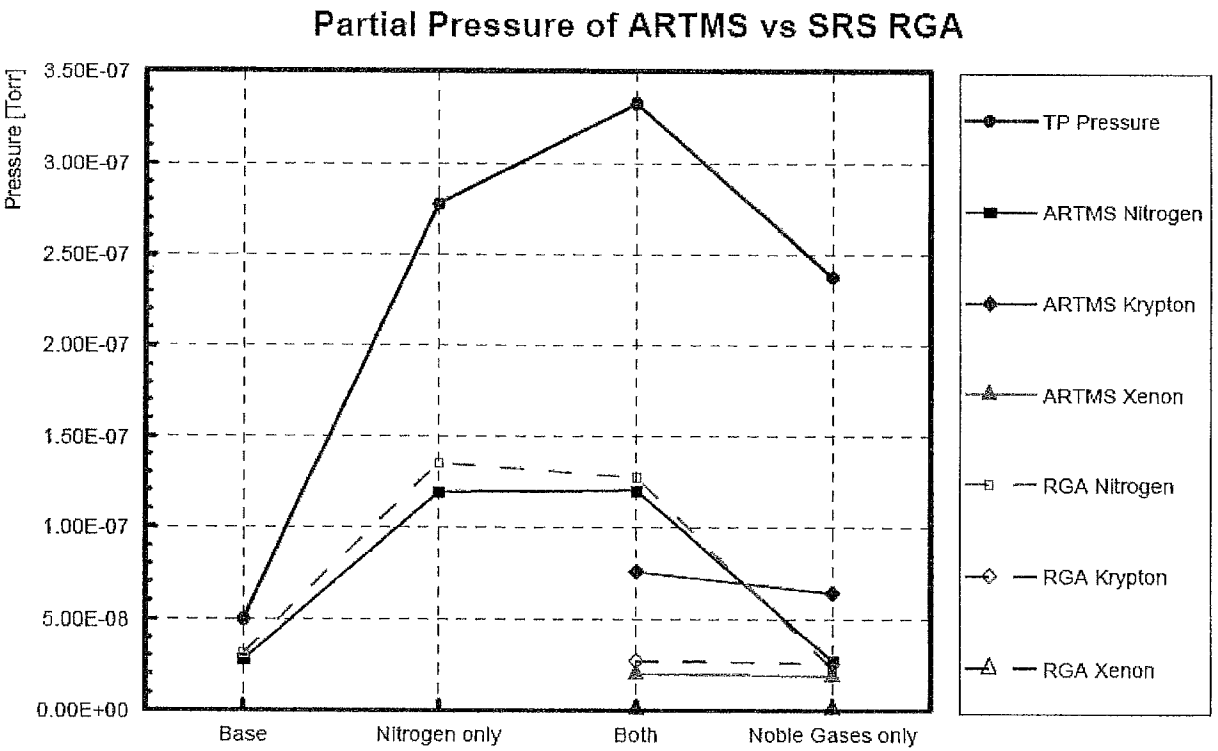
FIG. 37 is a graph of partial pressure of nitrogen and noble gases measured by ART MS and an SRS RGA.

This basic methodology has been applied to the analysis of gas mixtures. In general, very accurate representations of the partial pressure compositions of complex gas mixtures have been possible even in the absence of gas calibration standards. FIG. 37 shows an example of a system in which two independent gas sources were used to leak gases into a system.

FIG. 37 demonstrates some of the advantages of ART MS traps over quadrupole based residual gas analyzers in terms of absolute partial pressure calculations. It also demonstrates the accuracy of the methodology described above. The total pressure measurements were performed using a 390 ionization gauge module (Granville Philips, Longmont, Colo.) connected to the ART MS trap controller. The RGA data was obtained with a 200 amu range quadrupole residual gas analyzer (RGA) in Faraday cup (FC) mode of operation (Stanford Research Systems (SRS), Sunnyvale, Calif.). Starting from the left side of the graph, the system was pumped down to a base pressure of 5E−8 Torr, and the partial pressure for the peak at 28 amu was calculated with both the SRS RGA (peak intensity at 28 amu) and with the ART MS device (contribution to total charge from the 28 amu peak). Even though most of the signal at 28 amu in this case is due to CO, both the SRS RGA and the ART MS sensor provided very similar partial pressure results for the species responsible for the mass peak at 28 amu. Moving to the right, the system was exposed to the pure nitrogen gas source. The SRS RGA and the ART MS sensor provided similar partial pressure values for $N_2$ under a total pressure of 2.6E−7 Torr clearly dominated by nitrogen gas. Moving further to the right, the system was exposed to a second source of gas containing both Kr and Xe. The addition of two more gases to the mixture increased the total pressure in the chamber to roughly 3.2E−7 Torr. The ART MS sensor showed no change in nitrogen levels as expected; however, the SRS RGA showed a small dip in the nitrogen signal at 28 amu as the new ions displaced some of the nitrogen ions from the ionizer. The krypton and xenon levels reported by the ART MS device were very close to the actual partial pressures in the vacuum system, while the SRS RGA completely underestimated its levels by as much as a decade. Moving further to the right, the nitrogen gas source was shut off. As expected, very small change was observed in the levels of Kr and Xe. Both the SRS RGA and the ART MS sensor showed a small decrease in inert gas levels, and the SRS quadrupole RGA continued to under-report the heavier gases by as much as a decade.

The above results demonstrate the ability of an ART MS gauge to adequately report absolute partial pressure levels for species spread out over a wide mass range. The combination of data from the ART MS sensor and the ionization gauge enables the decomposition of the raw total pressure readings from the ionization gauge into the contributions from the different gas components. It also demonstrates that quadrupole RGAs consistently and dramatically under-represent heavy gases as their throughput decreases with increasing mass. In this particular case, the only way for a user to obtain adequate partial pressure values for Kr and Xe using an SRS RGA would be to resort to calibration gas references to adjust partial pressure readings though gas correction factors. FIG. 37 was obtained using custom software developed under the LabVIEW Programming environment and used many of the peak finding, functional fitting and integration functions built into that programming environment.

The ion trap can be provided with nonvolatile memory storing control parameters. The nonvolatile memory can be (1) associated to the sensor head (i.e., electrode structure) separate from the ECU (for example, a memory chip attached to the air-side of the connector flange), (2) it can be part of the ECU's infrastructure, either integral with the sensor head or remote (3) it can also be a detachable flash card or chip provided separately, or (4) can be a combination of all of the above. The ECU can be integral with the sensor head or remote from the sensor head and operatively connected to it by, for example, a cable or wireless. Control parameters can include configuration and calibration parameters and sensitivity factors. Configuration parameters include magnitudes of electrostatic potentials applied on the electrode structure that produce the electrostatic potential in which ions are confined, amplitude and frequency settings for the AC excitation source, and even electron emission currents for ionization sources. Calibration parameters pertain to voltage and current inputs and outputs of the ion trap electronics, and sensitivity factors include a conversion factor from natural frequency of oscillation of ions to ion mass-to-charge (m/q) ratio. Configuration parameters are used to properly configure the trap during operation. For example, (1) the trap needs to be biased with factory selected electrostatic potentials, (2) electron emission currents need to be delivered and maintained at proper levels, (3) RF scan parameters need to be adjusted based on the scan conditions selected by the user, and (4) the proper functional form and scan time need to be selected for the RF sweep, depending on the selected mass range. Configuration parameters for ART MS include the bias voltages and frequencies required to produce a mass spectrum. Calibration Parameters are required (1) to assure that the accurate voltages are output by digital-to-analog converters, (2) to assure that accurate voltage readings are delivered by all analog-to-digital converters, (3) to assure that accurate current readings are generated with all built-in electrometers, (4) to assure that the proper RF scans (frequency, amplitude, profile and time) are delivered by the direct digital frequency synthesizer during the generation of mass spectra, and (5) to assure that the proper electron emission currents are established during measurement. Calibration parameters are generally considered to be specific to the ECU's electronics. Sensitivity factors are required to convert the calibrated voltage, current and frequency readings of the controller into (1) mass-to-charge ratios, (2) total pressures and (3) partial pressures. Sensitivity factors are specific to the sensor and are affected by trap geometry as well as configuration choices.

Setting up a mass spectral scan requires setting the following configuration parameters:

1. Electron emission current, mA;
2. Electron Energy, eV;
3. Entry plate Bias, VDC (typically 0 VDC);
4. Pressure plate bias, VDC. Two values depending on whether total pressure (typically −40 VDC), or partial pressure (typically equal to entry cup bias) readings are being performed;
5. Entry Cup bias, VDC, (typically −90 VDC);
6. Central Lens HV, VDC (typically −850 VDC);
7. Exit Cup bias—generally the same as entry cup bias;
8. Exit plate bias, VDC, depends on pressure, RF amplitude, and scan rate;
9. Electron Multiplier Shield plate bias, VDC (between −136 VDC and +136 VDC, depending on detector geometry and location);
10. Electron Multiplier Input Voltage;
11. Electron Multiplier output voltage;
12. Electrometer Gain, A/V;
13. RF amplitude $V_{pp}$;
14. RF scan Profile: linear, Log, 1/f″; and
15. RF scan time.

Depending on the application, it might also be convenient to float the biases in the entire trap. For example, it might be useful to use positive biases for the electron emitters in order to avoid the loss of electrons to grounded surfaces and to minimize interference with adjacent ionization devices. Storing ions in an ion trap includes the step of producing an anharmonic electrostatic potential in which ions are confined to trajectories at natural oscillation frequencies, in an electrode structure that includes a first and a second opposed mirror electrodes and a central lens therebetween. Peak resolution on ART MS ion traps is related to at least two main factors, trap design and trap size. In general, resolution increases with trap size. The embodiment shown in FIG. 1 operates at a typical resolution of about 100× (measured as peak height divided by full width at half maximum), in a trap that is about two inches long and about one inch in diameter. A similar but smaller trap of about 0.6" diameter and 1" in length has demonstrated a resolution of about 60×. A larger trap of about 3" in length has demonstrated a resolution of about 180×. In general, smaller traps have also enabled faster scan rates. The principles of autoresonance described above apply to the aforementioned ion traps as well.

Resolution can also be improved in trap designs that include entry and exit plates, 1 and 2, respectively, in FIG. 1. Simple cup designs that include only entry and exit cups 6 and 7, respectively, as shown in FIG. 11, have consistently shown lower resolving powers than traps including plates 1 and 2. It is believed that resolution in ART MS traps is determined by the uniformity of the trapping potential wells sampled by a group of radially spread ions as the amplitude of their oscillatory motion reaches the exit grid. In traps including entry/exit plates the electrostatic equipotential lines between the plates and the cups are flatter (i.e., the potential is independent of the radial location) and all ions oscillating close to the end plates experience similar potential wells during their axial oscillations, independent of their initial radial location. In traps without plates, the ions are formed inside the cups and large differences in the shapes of the potential wells experienced by ions oscillating at different radial locations are observed. The spread of potential well shapes results in different natural oscillation frequencies for ions originated from different radial locations and yields a spread of ejection frequencies for ions of a single mass and, of course lower resolution mass spectra. SIMION calculations have been used successfully to optimize the dimensions and geometrical shapes of the plates and cups in ART MS traps and also to define the proper biasing conditions leading to effective ion trapping and adequate spectral resolution. The simple plate/cup design of FIG. 1 is only one of the many design options available to manipulate equipotential lines within the trap and to provide uniform electrostatic potentials across the radial dimension of the trap. FIG. 1 is presently considered a preferred embodiment simply because it provides substantial resolution improvements over single cup designs, while still preserving the advantages of low cost manufacturing as well as compatibility with off-axis ionization and total pressure measurement.

Producing the anharmonic electrostatic potential to confine ions to trajectories at natural oscillation frequencies involves setting the bias voltages of the electrode structure. The two cups, entry and exit, are preferably biased to identical voltages in all current ART MS trap implementations, although the exit cup can also be set to an adjustable negative offset relative to the entry cup.

The two cups (entry and exit) preferably are AC coupled to the transition plate by high voltage (HV) capacitors. The use of capacitors to couple the RF from the transition to the cups can be optimized through experimentation by finding the values that provide the highest signal with the least amount of RF Vpp and the least amount of mass peak contributions from superharmonics. The trap illustrated in FIG. 1 has also been operated without coupling capacitors between the transition plate and its adjacent cups, although performance was not as efficient as compared to the preferred embodiment.

The voltage on the cups is adjusted to assure maximum signal and resolution in the spectra. The voltage on the cups is usually a fixed fraction of the transition plate voltage. In fact, it is usually desirably to maintain a fixed ratio between the transition plate and cup voltages as the transition plate voltage is changed to a new value. Preserving a constant ratio between the transition plate and cup voltages is definitely required while performing HV scans over a large voltage range. In the preferred embodiment, the cup voltage is typically around 1/10th of the transition bias voltage (assuming the entry plate is at ground). The proper voltage on the cups is generally tuned to assure stable ion trajectories and a large and stable signal. There is generally a narrow range of voltages that leads to proper trap operation. Generally the ideal voltage is selected by adjusting the cup potential until the maximum intensity is achieved for all signals in the mass spectrum. Cup voltage affects both intensity and resolution and in some cases, signal might be sacrificed for an increase in resolution.

The entry cup voltage also affects the arch trajectory described by the electrons inside the trap and it might be required to readjust the electron energy when the entry cup voltage is adjusted. In general, there is no reason to adjust the cup voltage at any value other than the one that provides the maximum signal, unless higher resolution is needed.

The preferred embodiment uses about −850 VDC on the transition plate, and the cup voltage is generally adjusted at around −90 VDC to provide maximum signal. The cup voltage can be adjusted somewhere between −80 and −100 VDC with different results in terms of intensity v. resolution. Changing the cup voltage not only affects the amplitude and resolution of the peaks but also affects their ejection frequency. Since changing cup voltages changes the shape of the anharmonic potential curve, it is expected that it will also affect the natural oscillation frequency. As a consequence the mass axis of the ART MS device needs to be recalibrated every time a cup voltage is changed, even if the transition bias voltage does not change.

During normal setup, the transition bias voltage is the first to be selected. In the preferred embodiment, the preferred transition plate voltage has been −850 VDC and the cups have been operated between −80 and −110 VDC. The highest resolution is generally obtained at the −100 VDC end of the range. The actual voltage used in the trap is the result of optimization, although it can generally be predicted accurately using SIMION models. Peak amplitude and resolution are the figures of merit that are tracked during optimization. In general, one looks for the sharpest peaks and the largest amplitudes possible. As it is often the case in mass specs, there is always a compromise to make between the two figures-of-merit as the peak intensity tends to decrease as the peaks get narrower. As the cup voltage is adjusted, the calibration will need to be adjusted as the ejection frequencies will change.

The transition plate bias sets the voltage at the bottom of the electrostatic potential well. The natural frequency of oscillation of the ions is set by the depth of the trapping potential well. Any change in the transition plate bias voltage results in a shift in the natural frequency of oscillation of the ions. In fact, the roundtrip time for ions of a fixed m/q ratio is related to the square root of the trapping potential. As the trapping potential well gets shallower, the roundtrip for the ions gets longer and the natural frequency of oscillation gets smaller, i.e., the peaks in the spectrum move to lower frequencies as the transition plate voltage magnitude decreases (becomes less negative). The transition plate bias voltage is generally selected and set based on the geometrical design of the trap and is rarely changed during frequency scans. Voltages between −200 and −2000 VDC have been used to successfully operate ART MS traps and all of them have provided useful spectra. The preferred transition plate bias voltage for the embodiment illustrated in FIG. 1 is −850 VDC, because it provides adequate performance without requiring expensive HV insulation components, cables, and connectors. In general, the transition plate voltage is selected such that the electrons entering the trap do not travel too far into the trap—this is particularly important if the trap includes entry/exit plates in addition to entry/exit cups. The ions should be formed between the entry plate and the entry cup, if an entry plate is present in the design.

The depth of the trapping potential well also influences the minimum value of the RF $V_{pp}$ that is required to eject ions. The RF $V_{pp}$ "threshold" is the minimum RF peak-to-peak amplitude required to eject ions from the trap. In general the RF $V_{pp}$ threshold increases in amplitude as the potential well gets deeper, i.e., the ions need to be "kicked harder" in order to eject them from the trap. As the potential well gets shallower, the amplitude of the RF $V_{pp}$ required to eject ions gets smaller. As the potential well gets deeper and the frequency of oscillation of the ions increases, the scan times can also be reduced in the trap as the ions move faster.

Operating the ART MS ion trap can also include the step of exciting confined ions at a frequency of preferably about twice the natural oscillation frequency of the ions with an AC excitation source having an excitation frequency f, the AC excitation source preferably being connected to the central lens. An advantage of ART MS ion traps is that autoresonance created by the anharmonic electrostatic trapping potential enables exciting confined ions with relatively low amplitude RF amplitudes, RF $V_{pp}$. An advantage of coupling the AC excitation source into the transition plate is a more symmetric RF coupling, minimizing the contribution to the spectra from higher harmonic components, as compared to RF coupling into the entry or exit plates. As described above, an additional surprising result of coupling the AC excitation source into the transition plate is that the ions are ejected from the trap at twice their natural frequency of oscillation.

The main parameters that define the AC excitation during operation of an ART MS trap are:

1. Frequency range. Determined by the mass range desired. The ejection frequency is strictly related to the square root of the ion mass. In the preferred embodiment, with a −850 VDC transition voltage, the ejection frequency corresponding to water is roughly 570 to 600 KHz which is twice the natural oscillation frequency of the water ions between both end plates.
2. Amplitude—RF $V_{pp}$. The amplitude of the RF $V_{pp}$ is important due to the trade-off of needing the amplitude to be above threshold for the ejection of ions but below threshold for the ejection with superharmonics. Once the threshold is reached, the amplitude of the mass peaks increases with RF $V_{pp}$. High RF $V_{pp}$ values, however, result in spectra with higher contributions from superharmonics and with reduced resolving power as compared to operating just above the RF $V_{pp}$ threshold.
3. Scan time: This is the time that it takes the electronics to scan from the upper frequency (low mass) to the lower frequency (high mass). Higher scan rates usually require larger RF $V_{pp}$ to remain above threshold, and display reduced resolution.
4. Sweep Functional Form: this is the functional form of the frequency sweep. In general, the following functional forms have considered for scans: linear, log, 1/f, $1/f^2$ and the more general $1/f^n$ with n greater than or equal to 1.
5. RF Waveform: Both sine wave and square wave RF excitation are routinely used for ion excitation. Sine waves are preferred for practical reasons, but square waves can be very useful, because such a design does not require a dedicated direct digital synthesis source, and enables the use of pulse width modulation (PWM) output modules that are already built into standard microprocessor electronics boards, or field programmable gate arrays, or application specific integrated circuits, thus reducing cost, power consumption, complexity, and size.
6. AC Coupling scheme: The AC excitation can be applied to several different electrodes within the trap, such as, for example, the entry cup or plate, transition plate, or exit cup or plate. Transition Plate coupling is the preferred excitation method.

Amplitude—RF Vpp

The AC excitation of the preferred embodiment is coupled into the transition plate using a balanced/unbalanced (BALUN) transformer, typically terminated into a 50 Ohm resistor. BALUN transformers are commonly used in Cable TV splitters, due to their low cost and large bandwidth. Coupling the RF into the center plate is preferred because it simplifies the electrical scheme required to distribute the RF through the trap and also has been shown to eject ions at twice the natural frequency of oscillation of the ions. Center plate excitation has also been shown to produce fewer spurious peaks due to superharmonic excitation in the preferred embodiment.

The AC excitation amplitude needs to be kept above the autoresonance threshold for ions to be ejected. The ejection threshold depends on the scan speed the initial energy of the ions, the depth of the potential, the symmetry of the trapping potential, and the total pressure. The amplitude of the RF needs to be set above threshold in order to obtain any signal. Generally, operation close to threshold provides the highest mass resolution. As the RF $V_{pp}$ increases, the amplitude of the signal also increases until a plateau is achieved. At that point increasing the RF intensity causes the peaks to broaden (i.e., loss of resolution) without any significant intensity gains. Increasing the RF Vpp also usually leads to the appearance of spurious peaks due to excitation by higher harmonics.

A typical trap in the preferred embodiment, with a −850 VDC trapping potential, operates with roughly 50 mV of RF $V_{pp}$ scanned between 2 MHz and 100 KHz. Higher RF $V_{pp}$ values are required for faster scan rates and also for higher pressures. RF $V_{pp}$ values have never exceeded 250 mV in the preferred embodiment. The RF $V_{pp}$ needs to be adjusted dynamically in order to adapt to:

1. higher pressures,
2. changes in scan rate/scan speed,
3. different transition/cup bias voltages,
4. changes in trapping potential symmetry, and
5. adjustments on the functional form of the frequency scan.

The RF $V_{pp}$ adjustments are designed to control the interplay between resolution, intensity and the relative contribution from superharmonics to the spectrum. The RF $V_{pp}$ can also be adjusted during a scan, for example, by increasing the RF $V_{pp}$ amplitude with decreasing frequency. Dynamic adjustment of the amplitude during frequency scans can better match ART MS spectra to those from other mass separation instruments such as quadrupole and magnetic sector mass spectrometers.

As the pressure in the system increases, the signal amplitude and resolution is often improved by an increase in RF $V_{pp}$ voltage. The idea is to reduce the time required for the ions to be ejected from the trap before scattering collisions prevent them from being effectively extracted. "Kicking the ions harder" with higher RF values forces them to exit the trap sooner and without losses to scattering collisions.

Figure 29:
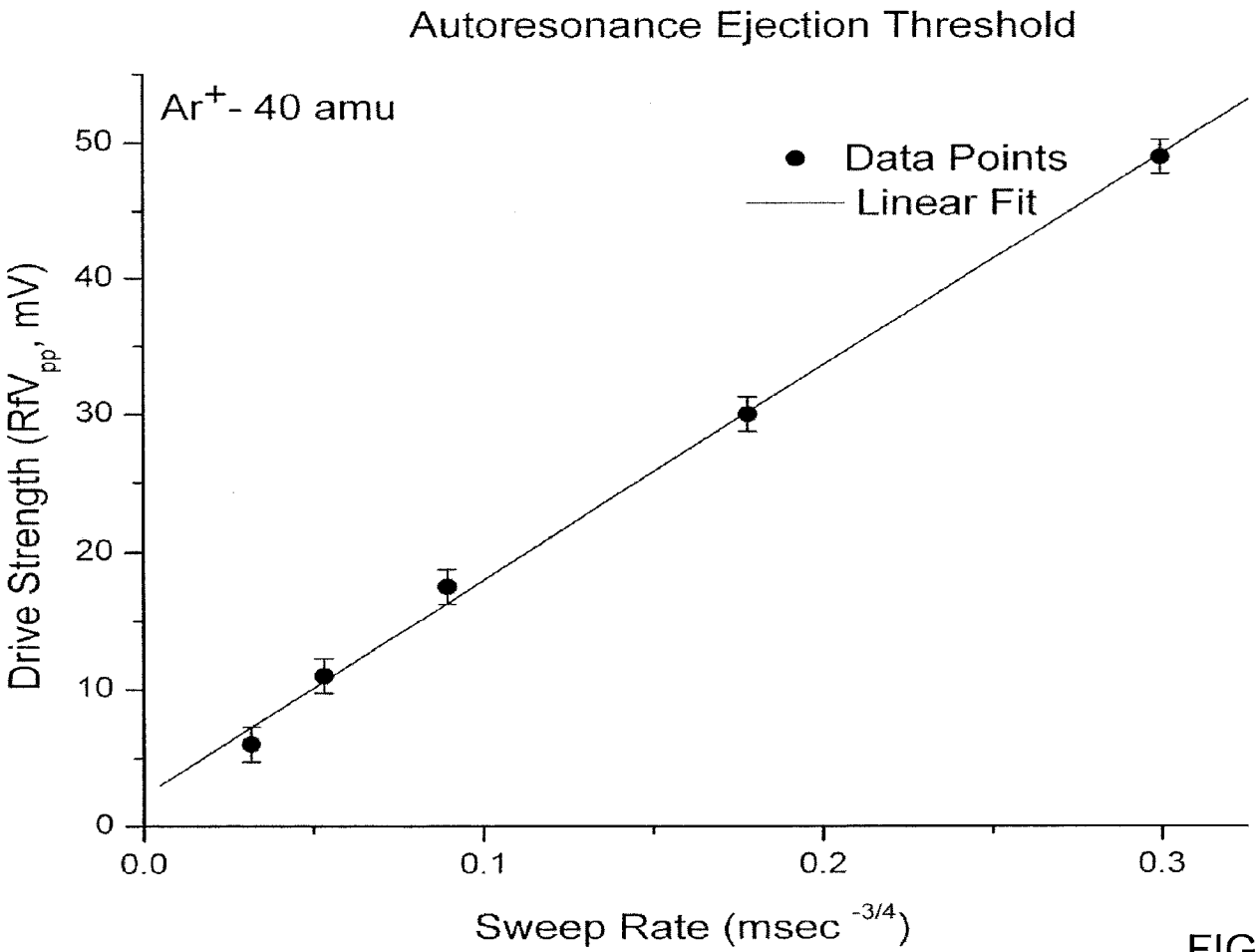
FIG. 29 is a drawing of a graph of the autoresonance ejection threshold with increasing sweep rate.

As scan times get shorter, it is often required to increase RF $V_{pp}$ voltage in order to assure that enough ions are ejected from the trap during the time the AC excitation frequency crosses the natural oscillation frequency of the ions. The ejection threshold for an ion is directly related to the frequency sweep rate, that is, the higher the frequency sweep rate, the higher the threshold for ejection, and the higher the RF $V_{pp}$ that must be applied, as shown in FIG. 29. The experimental results shown in FIG. 29 are in agreement with the predictions of autoresonance theory.

As the depth of the trapping potential increases, the amplitude of the RF excitation needs to be increased as well since the ions need to climb out of a deeper well. In other words, the ejection threshold increases as the ions need to gain more energy to get out of the trap.

The AC excitation amplitude is also adjusted based on the exit plate voltage setting. As the voltage on the exit plate gets more negative, it becomes easier to eject ions with lower AC excitation amplitudes since their ejection thresholds decrease. However, as the exit plate voltage drops it is also common to see a higher presence of mass peaks due to superharmonics. It is not unusual to improve the appearance of a spectrum, reducing the incidence of superharmonics, by raising the voltage on the exit plate (setting the exit plate less negative), while at the same time increasing the RF $V_{pp}$ to keep the peak intensities of the important peaks at the same levels.

There is a strict relationship between RF $V_{pp}$ and the voltage of the exit plate when off-axis electron ionization is used. The reason is simple: the ions are formed deep within the potential well when off-axis ionization is used. As a result, higher RF $V_{pp}$ thresholds are required to eject ions from the trap than when off-axis electron ionization is used. As the voltage on the exit plate is dropped (more negative), the amount of excitation required to eject ions from the trap decreases and the amount of RF $V_{pp}$ required to eject ions also decreases for the same scan time. An ART MS scan can use different frequency sweep profiles depending on the mass range involved and the scan times required. In general, different voltages are required to optimize ejection from a trap as the scan profile is changed. The RF $V_{pp}$ for different scan rates needs to be adjusted to assure maximum ion ejection compatible with acceptable levels of superharmonics.

The amplitude of the RF $V_{pp}$ will also depend on whether sine wave or square wave AC excitation is selected. In general, lower RF $V_{pp}$ values are required if square waves are selected for AC excitation. Switching from sine wave to square wave often results in a need to reduce the RF $V_{pp}$ to reduce the presence of superharmonics and to keep the resolution close to threshold values.

Peaks corresponding to the ejection of ions at frequencies corresponding to multiples of the applied excitation frequency are called superharmonic peaks and generally appear at low masses. For example, under certain trap conditions, a peak at 4.5 amu may appear in the spectrum when a large peak at 18 amu (corresponding to $H_2O^+$ ions) is also present. The peak at 4.5 amu corresponds to excitation at the second harmonic (i.e., 1.2 MHz superharmonic) of the main 18 amu excitation frequency (i.e., 600 kHz). As a general rule, superharmonic ejection of ions requires higher RF Vpp thresholds than ejection at the natural oscillation frequency, or twice the natural oscillation frequency if the RF excitation is applied to the transition plate. The factors that lead to the appearance and mitigation of superharmonics in the preferred embodiment are:

1. RF $V_{pp}$. Superharmonic peaks appear when the RF $V_{pp}$ is increased above a certain threshold that allows the ions to be ejected by multiples of their natural oscillation frequency. In general the superharmonic peaks are the first to disappear from the spectrum as the RF $V_{pp}$ is reduced since they have the highest thresholds. In other words, since the threshold value for ejection of superharmonics is larger than for the ejection at the natural oscillation frequency (or twice the natural oscillation frequency for transition plate pumping), the superharmonic peaks are the first to disappear from the spectrum as RF $V_{pp}$ is reduced.
2. Exit plate voltage: The presence of superharmonics is affected by the voltage on the exit plate. As the voltage on the exit plate drops (i.e., becomes more negative for positive ions), the relative abundance of superharmonic peaks increases. Very often it is possible to make superharmonics disappear from a spectrum by increasing the voltage on the exit plate. Lowering the exit plate voltage (setting the exit plate bias more negative) lowers the threshold for the ejection of superharmonics.
3. Scan Profile: The shape of the frequency scan function affects the quality of the spectrum. Linear scans are particularly susceptible to the presence of superharmonic peaks due to their relatively slow scan rates at low masses. In general 1/f scan profiles have been used in the preferred embodiment to provide low incidence of superharmonics while at the same time providing the best balance between low mass and high mass ejection efficiencies. Since most of the superharmonics appear at low masses, and low masses can be ejected with faster scan rates than heavier masses, scanning relatively faster at low masses increases the ejection thresholds for superharmonic ejection and reduces their contribution to the spectra. Absolute mass resolution values at low masses are generally very high, and, as a result, it is generally easy to identify spurious peaks due to superharmonics, unless they overlap with the fundamental peaks in the spectrum.
4. Scan Time. Scan time has a significant influence on the presence of superharmonics. This is because the RF $V_{pp}$ threshold for the ejection of ions decreases with increasing scan time, as illustrated in FIG. 29. As the scan time gets shorter, the threshold for ejection increases and the superharmonic peaks disappear from the spectrum. This is the reason why either scanning faster, or using scanning profiles that scan faster at lower mass (i.e., higher frequencies) than high masses is often the best approach to attain spectral purity.
5. Electron energy. The threshold for ejection of superharmonics is related to how deep within the potential well the ions are formed. Ions formed closer to the entry plate (i.e., higher energy) require less excitation to exit the trap, resulting in lower excitation thresholds. As a result, any time the electron energy is reduced and ions are formed closer to the back surface of the entry plate a relative increase in the contribution from superharmonics is observed. This is also the reason why superharmonic peaks become more noticeable (i.e., increase in magnitude) when the exit plate voltage is reduced (i.e., made more negative).
6. Trap potential well. As the potential well gets deeper, the threshold for the ejection of ions gets larger. The superharmonic peaks are the first to disappear from the spectrum since their thresholds are already higher. Keeping RF $V_{pp}$ constant, it is possible to eliminate superharmonics by simply increasing the depth of the potential. Even though the trapping potentials have been held constant during most of the frequency sweeps described herein, it should be apparent to those skilled in the art that electrode voltages can also be modulated during scans to change the trapping conditions during a scan.

7. Transition Plate/entry-exit Cup RF coupling. The contribution of superharmonics to the spectra is also affected by the way in which the RF is distributed throughout the trap. In the preferred embodiment, the RF $V_{pp}$ was distributed throughout the trap using a pair of capacitors and the exact coupling configuration was determined experimentally. Removing the coupling capacitors located between the transition plate and the cups was found to produce a significant amount of additional superharmonics as higher RF $V_{pp}$ is required to operate the trap.

The preferred embodiment operates with transition plate RF coupling. As a result, ions are naturally ejected at twice their natural oscillation frequency. One way to visualize the operation of an ion trap with transition plate RF coupling is to think of pumping a child on a swing by pulling on the chain rather than simply pushing the child from one side. In this case the most efficient pumping is achieved at twice the natural oscillation frequency of the swinging child. Even though transition plate RF coupling is already producing ions ejected at twice their natural oscillation frequency, this is not technically described as superharmonic excitation. Superharmonic peaks are still present in cases where transition plate RF coupling is used, but correspond to peaks ejected at twice the standard ejection frequency (i.e., four times the natural oscillation frequency of the ions). The same guidelines described above apply to the mitigation of those superharmonics as they apply to the case in which the ions are ejected at exactly their natural oscillation frequencies.

In an ART MS ion trap, all ions are initially trapped and then mass selectively ejected from the trap in increasing order of mass. Mass selective ejection preferably employs RF scans in order to eject the ions from the trap. To eject an ion by using autoresonance means to scan across its natural oscillation frequency (or twice its natural oscillation frequency in the preferred embodiment) from high to low frequency values. In most cases, the frequency range is scanned to cover a very wide range of masses so that full mass spectral information can be obtained. It is also equally possible, however, to scan narrow frequency ranges that eject only one or a few masses from the trap.

Narrow frequency scans are useful because they allow fast monitoring in real time the ratios of closely spaced ions. For example, it might make sense to scan between 26 and 34 amu to monitor $N_2/O_2$ mixtures and confirm the absence of air leaks in a complex vacuum chamber. The advantage of such short range scans is that they can be performed at very high speeds. In fact, the preferred embodiment allows monitoring single species in times as short as 0.5 msec. Air scans covering both $N_2$ and $O_2$ peaks have been performed with a 1 KHz repetition rate using the preferred embodiment of FIG. 1.

A difference between ART MS and a quadrupole mass filter is that, in ART MS, active scanning mass selectively ejects a specific mass-to-charge ratio. In a quadrupole mass filter, the filter can actually be parked at a specific mass and then the instantaneous changes in the concentration of that peak can be monitored in real time. Even though this seems like a significant advantage for single gas monitoring, most quadrupole mass filters do not have the bandwidth required to perform this measurement in real time, and monitoring of changes in mass concentration is generally limited in standard quadrupole-mass-filter-based residual gas analyzers (RGAs) to collecting data every few tens of milliseconds.

In an ART MS ion trap, it is also possible to mass selectively eject ions by using broad frequency spectrum RF generated via FFT inversion. Mass selectively ejecting ions of specified mass to charge can be accomplished by tuning the RF to a frequency range that overlaps the frequency peak of the ions of interest. An FFT inversion algorithm can generate the wide spectrum RF that can then be applied to the trap. This might not lead to efficient ion ejection (since autoresonance is not involved when no actual scanning is done), but this mode can enable the trap to operate essentially as a filter that only allows ions of a specific mass to be ejected. The trap can be held at a specific mass and instantaneous changes in concentration can then be monitored.

Ions are created in an ART MS ion trap by electron impact ionization using electrons from an emissive source, such as the hot filament 16 shown in FIG. 1. In an on-axis ART MS trap, the voltage difference between the filament and the entry plate sets the maximum energy of the electrons as they enter the trap, and the potential at which the electrons turn around within the potential well. The ionization volume defined by the electron beam can be modified by changing the energy of the electrons as they enter the trap and also by changing the transition plate bias voltage. In general, the ionization volume is increased by increasing the energy of the electrons or by lowering the magnitude of the bias potential on the transition plate. Increasing the ionization volume generally produces more intense peaks, but also reduces the resolution of the device as the ions oscillate over a wider spatial distribution of potential wells. The filament bias relative to the vacuum system's walls is also important since it defines the possibility of electrons reaching the walls of the vacuum system and other ionization based devices in the system. The filament was typically biased at a negative potential to deliver energetic electrons into the grounded entry plate. However, the entry plate and the filament can both be biased with positive potentials so that the electrons are still accelerated from the filament to the entry plate but do not have a chance of reaching the (grounded) walls of the vacuum system. Experiments have consistently shown more efficient coupling of emitted electrons into the trap whenever the filament emitter is biased positively relative to the chamber wall's potential. Positive biases on the filament or cold electron emitting surface, also reduce the likelihood of interference between the ART MS trap and other gauges or sensors in the vacuum system.

Careful control of the filament bias voltage is much more relevant in off-axis ionization. In this case the difference in voltage between the filament and the entry plate sets the maximum energy of the electrons as they enter the trap, and also sets the arch trajectory the electrons will follow inside the trap. The initial energy of the ions is intimately related to the exact location within the trap volume where the ions are formed. Changing electron energy has been shown to have absolutely no effect on the ejection frequency of the ions (as predicted) but it has a substantial influence on:

1. the peak heights,
2. the superharmonic contributions, and
3. the baseline offset levels.

In an off-axis ionization trap, the ions are typically formed deep within the trap. The exact origin of the ions depends on the angular orientation of the filament relative to the entry plate's plane and the energy of the electrons. As the energy of the electrons increases the electrons reach further inside the trap (i.e., with lower potential energy values) and higher RF $V_{pp}$ is required to eject the ions from the trap in the same scan time (i.e., the ejection threshold increases). If the arch gets too short, the end of the electron arch can reach the back plane of the entry plate and form ions within line of sight of the oscillating beam. As a result, some of the ions formed close to the back wall are then ejected from the trap without oscillation, resulting in increased baseline offset, noise, and reduced electron multiplier lifetime. The ions formed close to the back of the entry plate also have lower ejection thresholds and might be more easily ejected as superharmonics, contributing to superharmonic peaks at low masses.

Within the preferred embodiment of FIG. 1, the typical procedure used to adjust the electron bias voltage is:

1. Start at a low voltage differential setting relative to the entry cup, for example −50 VDC relative to the entry cup. At this setting there is often a significant baseline offset, low signal, and high noise levels.

2. Increase the voltage differential. As the voltage differential goes beyond −60 VDC (more negative), the baseline starts to drop and the signal increases. Some superharmonics might still be evident but the baseline starts to disappear.

3. Keep increasing the electron energy, i.e., making the filament bias more negative, until the peak heights are optimized in height, the baseline is minimized and the superharmonics are also minimized.

In the preferred embodiment, baseline offset is evident if the filament bias gets more positive than −60 VDC relative to the entry plate. As the voltage differential increases in magnitude, the quality of the spectra improves, and spectra are generally optimized as the voltage differential reaches −90 VDC. Reasonable spectra are typically collected between −70 and −110 VDC.

As the electron energy is reduced, and the electron arches get shorter, ions are formed closer to the entry plate's back plane and it is easier to eject them from the trap. In general this is also conducive to increased levels of superharmonics. In general, superharmonics are eliminated by increasing the exit plate voltage (setting it less negative), increasing electron energy, and reducing RF $V_{pp}$. Low energy electrons that hit the back plane of the entry plate can also form energetic ions through the ESD process described above. ESD ions generated in line-of-sight with the exit plate aperture can contribute to baseline offset levels and noise. The ejection of ESD ions by stray electrons that collide with the back surface of the entry plate can be minimized by applying specialized coatings to the back of the plate, such as, for example, gold and platinum coatings, which have been shown to reduce ESD ion levels compared to stainless steel.

A natural consequence of off-axis ionization is that the section of the electron beam arch that produces ions in line with the oscillating ion beam does not have electrons at the maximum electron energy possible. At the turn around point of the arch line-of-sight exposed to the beam, the electron beam has lost the axial velocity component, but still retains the initial component of radial velocity. The voltage difference between the filament and the entry plate must not be used to calculate ionization potentials for different gases, because appearance potentials calculated in this way will always be over-estimates.

Ions can be created in an ART MS ion trap either continuously or intermittently, in pulses. Pulsed filling is an alternative mode of operation in which ions are created inside, or loaded into the trap during pre-specified short periods of time. In its simplest and most common implementation, pulsed filling involves the generation of ions in the absence of any AC excitation: the ions are created and trapped under the influence of purely electrostatic trapping conditions, and then an RF frequency or trapping potential scan is triggered to produce mass selective ejection of the ions. The cycle can be repeated for each new ion pulse. An advantage of pulsed operation is improved control of space charge buildup inside the ion trap. Large ion concentrations inside a trap can cause peak broadening, resolution losses, dynamic range losses, peak position shifts, non-linear pressure dependent response, signal saturation, and increased background noise levels. Another advantage of pulsed operation is better control of the initial ionization conditions during mass selective storage, fragmentation, or dissociation experiments. For example, to completely clear undesirable ions from a trap, it is necessary to stop introducing new ions while a cleaning frequency sweep is on.

Anharmonic electrostatic ion traps relying on electron impact ionization can include electron gates to turn the electron beam on and off, or, alternatively, rely on the fast turn on/off times of cold electron emitters based on field emission, such as, for example, electron generator arrays, to control the duty cycle of the electron fluxes entering the trap's ionization volume. Gated external ionization sources are well known in the art.

The ionization duty cycle, or filling time, in pulsed filling operation can be determined through feedback arrangements. The total charge inside the trap can be integrated at the end of each scan and used to determine the filling conditions for the next scan cycle. Charge integration can be accomplished by (1) simply collecting all the ions in the trap with a dedicated charge collection electrode in a total pressure measurement as described above, or (2) integrating the total charge in the mass spectrum, or (3) using a representative measure of total ion charge, such as, for example, current flowing into an auxiliary electrode, to define the ionization duty cycle for the next scan. As described above and shown in FIGS. 24-26, total charge can also be determined by measuring the number of ions formed outside the trap as the pressure increases. Ion filling times can also be adjusted based on the specific mass distributions or concentration profiles present in the previous mass spectrum, or based on the presence, identity, and relative concentrations of specific analyte molecules in the gas mixture, or based on target specifications for the mass spectrometer, such as, for example, mass resolution, sensitivity, signal dynamic range, or detection limits for particular species.

Figure 30B:
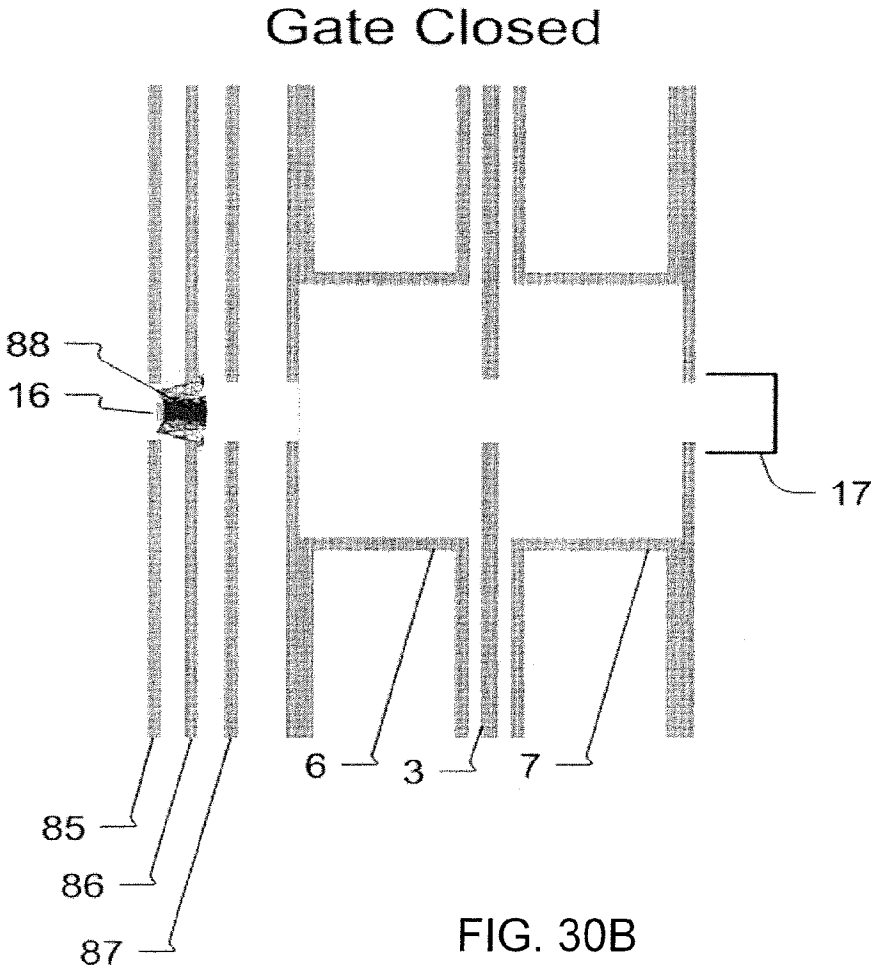
FIG. 30B is a schematic diagram of an electrostatic ion trap with a pulsed electron source showing a representative electron beam profile with the electron gate closed.
Figure 30A:
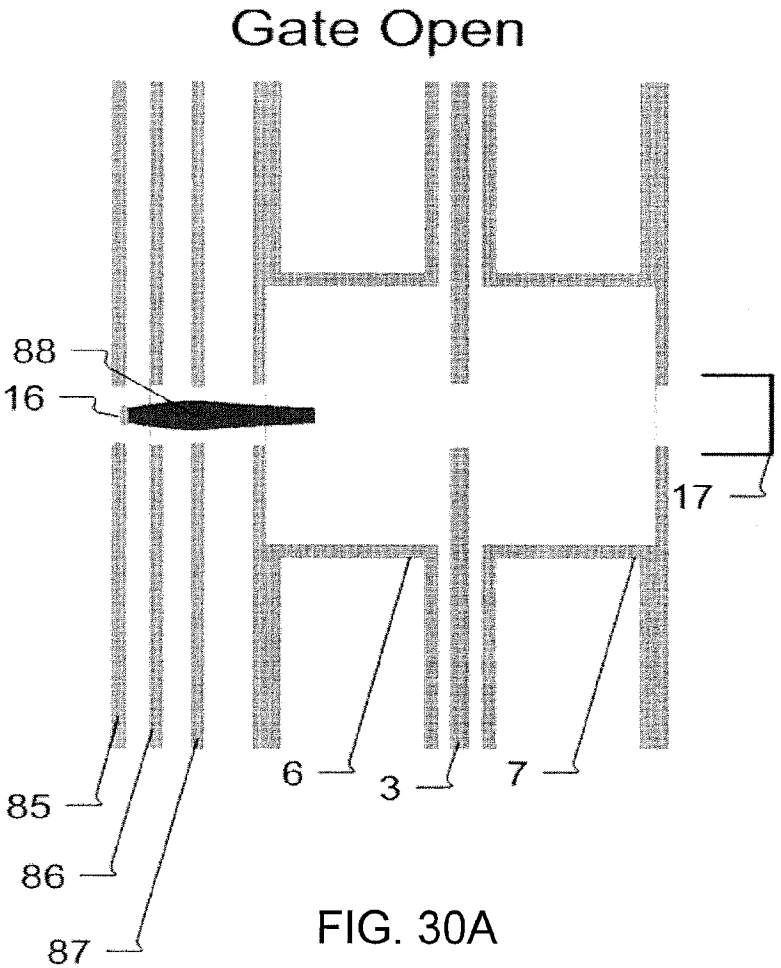
FIG. 30A is a schematic diagram of an electrostatic ion trap with a pulsed electron source showing a representative electron beam profile with the electron gate open.

Pulsed filling operation under electron impact conditions is shown in FIGS. 30A-B. Short pulses of highly energetic electrons were introduced into the trap in the absence of AC excitation using electron gates and on-axis electron impact ionization. Pulsed ionization minimizes baseline noise when operating with on-axis electron beams, such as, for example, in ART MS arrays based on MEMS designs or based on cold electron emitters. As illustrated in FIG. 30A, an electron gun consisting of an electron emitter 16, a repeller plate 85, a grid electrode 86, and a gate electrode 87 was used to pulse an electron beam 88 into the entry cup 6, which was grounded. The filament 16 and repeller 85 were biased at −70 VDC, while the grid and the gate electrodes were biased at −60 VDC, resulting in electrons reaching the entry cup's grid with 70 eV of energy—i.e., gate open. The gate is then closed by rapidly switching the gate bias 87 to ≤−85 VDC (i.e., more negative than the electron emitter bias), such that the electrons turn around and never reach the entry cup's mesh, as illustrated in FIG. 30B. Advantages of this simplistic electron gun design include fast response, with switching times in the range of nanoseconds, a constant electron extraction field, and a relatively compact design. The electron extraction field is constant because the grid bias, which is set by the voltage difference between the emitter's surface and the grid electrode, does not change when the gate is on or off, improving electron emission efficiency. The filament emission can be controlled with a feedback loop without risk of burning the filament when the gate is closed. Gated electron sources are well known in the art, and the example illustrated in FIGS. 30A-B is just one representative implementation.

Figure 31:
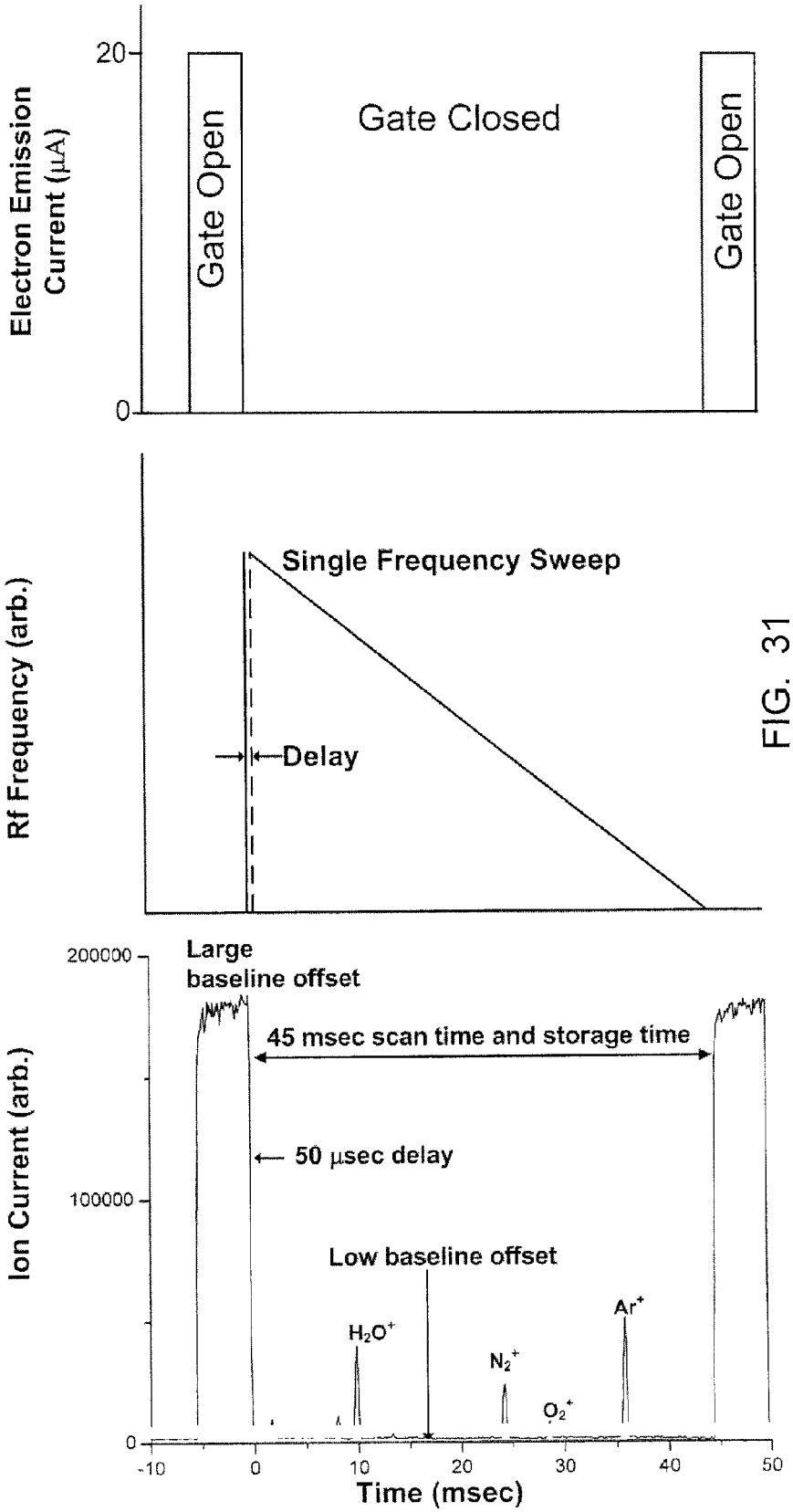
FIG. 31 is a drawing of timing diagrams of single pulse electron emission and RF excitation source scanning for pulsed operation of an electrostatic ion trap.

The timing diagram for a pulsed filling experiment is shown in FIG. 31. The top graph indicates the time during which the electron emission current is activated, which in this case corresponds to a 5 msec fill-time. This time can be in the range from tens of nanoseconds to several milliseconds. The emission current levels during the gate-on periods can be in the range from microamps to a few milliamps. The middle graph shows the time during which the RF frequency is scanned from high to low values. As shown in the graph, there is a small delay period between the time the gate is closed and the RF scan starts to allow ions that are not stored in the oscillating beam to leave the trap and to allow the detection electronics to respond to the new levels. This delay is necessary to insure that all background signal, caused by non-stored ions, dissipates from the trap as clearly shown in the bottom graph. In general, a delay of <0.1 millisecond is sufficient for noise to dissipate, although longer delay times might be required if the detection electronics have limited bandwidth. As demonstrated by the low baseline levels in the bottom graph, when the RF scan starts, there are essentially no ions detected except trapped ions that are mass selectively ejected out of the trap. Pulsed electron impact ionization is a convenient way to reduce baseline offset noise in ART MS traps using on-axis ionization.

Figure 32:
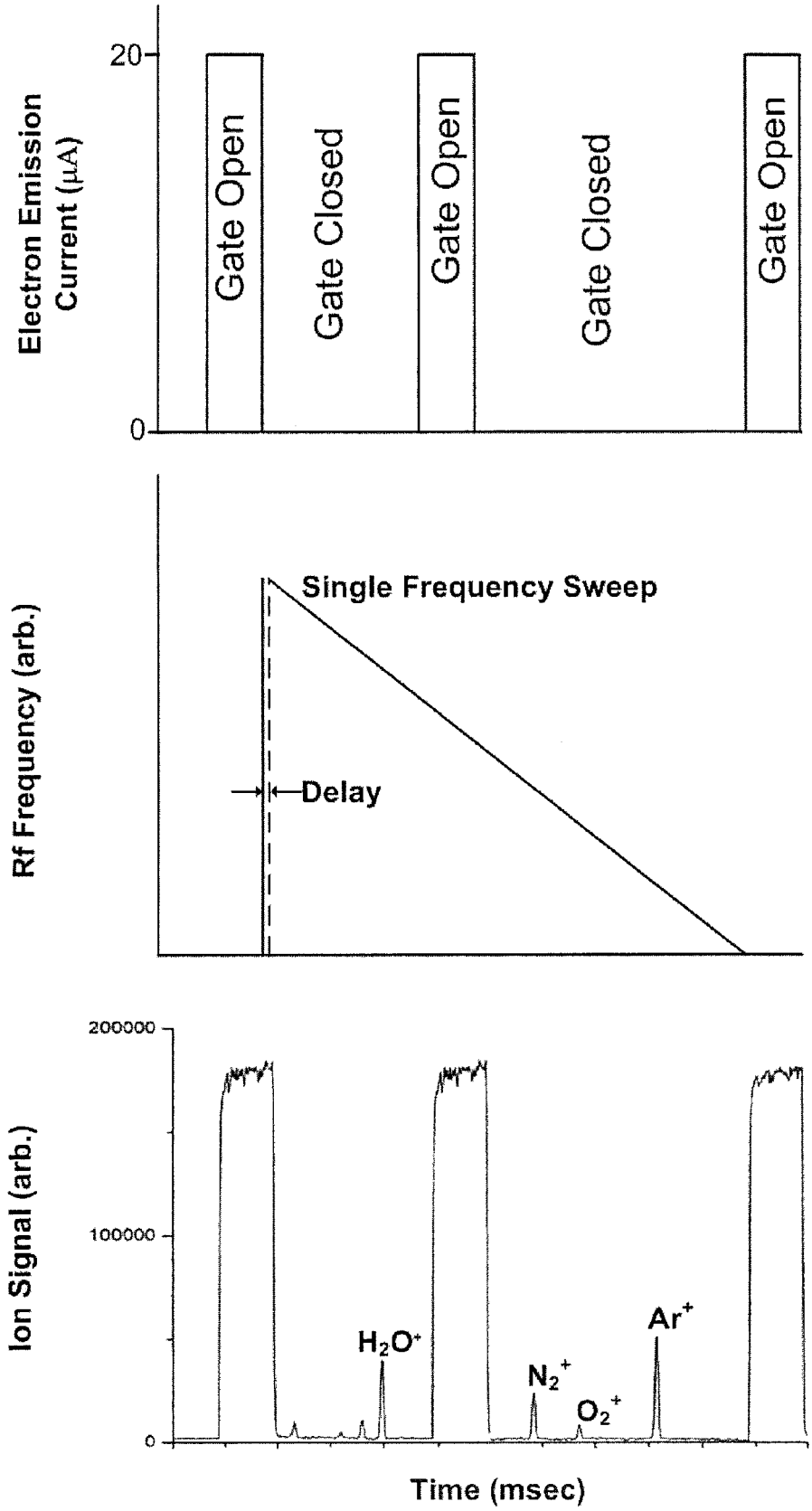
FIG. 32 is a drawing of timing diagrams of double pulse electron emission and RF excitation source scanning for pulsed operation of an electrostatic ion trap.

Once the electron gate is closed, no more ions are added to the trap by electron impact ionization. As ions are trapped in their oscillatory motion, they collide with neutral atoms and molecules as they oscillate from one cup to the other, and some ions will be lost after each cycle of oscillation due to scattering collisions. Therefore, it is important to adjust the scan time so that it does not exceed the residence time of the ions in the trap. In general, the residence time of ions in a trap at ultra-high vacuum (UHV) pressures (less than $10^{-8}$ Torr) is typically in the range of about 10 milliseconds to about 100 milliseconds. FIG. 31 clearly demonstrates the ability to generate a useful spectrum at $10^{-8}$ Torr with a scan time of 45 msec. However, as the pressure in the trap increases, the scan time has to be adjusted (i.e., reduced) to eject all the ions out of the trap before they are lost to ion-neutral scattering. At approximately $10^{-5}$ Torr, scan times must be as fast as 1 millisecond, i.e., the residence time of ions in the trap, to make sure the ions are ejected before being lost. To achieve faster scan times, it may be necessary to scan over a limited mass range, or to deliver ionization pulses throughout the scan right before a mass peak is expected to appear in the spectrum. It is possible to get more signal even at higher pressures by shortening the time between ionization (electron gate on) and detection (electron gate off), and also by increasing the RF $V_{pp}$. An example of a scanning mode in which ionization takes place twice right before the two peaks of interest appear in the spectrum is shown in FIG. 32. Introducing an ionization pulse during a scan, right before the peak of interest appears, creates ions right before they are excited and ejected from the trap, so that collisional losses are minimized. This method of operation improves the ion signal while still minimizing noise. The two peaks of interest, mass peaks 1 and 2, are preselected and ionization is timed so that the ions corresponding to mass peak 1 and mass peak 2 do not have time to be lost to scattering collisions at higher pressures. Fast frequency scans, however, generally require higher RF $V_{pp}$ voltages that can lead to decreased resolution.

Pulsed operation is also important for using the ART MS trap as an ion storage device. The trap can be filled with ions, and then RF excitation can be used to eject undesirable ions of specific masses out of the trap, or store or preconcentrate ions of preselected masses in the trap by ejecting all other masses. Pulsed operation is generally preferred when autoresonance excitation is used to chemically react the ions stored in the trap through collision-induced or electron-attachment dissociation. Alternatively, a total pressure measurement can be obtained by filling the trap with a short electron pulse, followed by measuring the decay of the ion signal with time after multiple frequency scans—the signal decay rate will be strictly related to pressure. For example, a single ionization pulse can be followed by two scan cycles separated by a fixed time. The signal decay between the first and second scan will be directly related to the pressure inside the trap. Alternatively, two frequency scans can be performed one after the other, but with different delays between the ionization pulse and the start of the frequency scan. The difference in the rate of decay in signal measured for the longer delay scan compared to the rate of decay of the shorter delay scan can be an indication of total pressure inside the trap.

As the pressure in a high vacuum system increases, the operational parameters of an ART MS trap need to be optimized to provide the best possible signal. As the pressure gets too high, it is also necessary to protect the filament and electron multiplier from operation under damaging conditions that can lead to reduced life or even catastrophic failure.

In general, as the total pressure increases, one should expect the signal from an ART MS sensor, operated with fixed parameters, to change in terms of:

1. signal amplitude,
2. mass resolution,
3. signal-to-noise ratio (SNR)
4. mass calibration
5. peak shape
6. background offset signal levels.

There are several physical electronics factors that affect trap performance as a function of increasing pressure. The following list includes some examples:

1. The decrease in mean free path with increasing pressure
2. The loss of phase locking with the RF for ions undergoing more frequent scattering collisions as the pressure increases
3. The physical spread of the ion cloud as the pressure increases
4. Change in fragmentation patterns as the pressure increases—i.e. due to collisionally induced dissociation (CID)
5. The decrease in ion residence time with increasing pressure
6. The increase in electron multiplier noise with pressure
7. The faster build up of charge inside the trap with increasing pressure
8. The saturation of the ion cloud density with increasing pressure
9. The change in space charge inside the trap with increase in pressure
10. The increase in RF power absorption with increasing pressure
11. The increase in filament temperature as the pressure increases
12. The increase in thermal processes at the filament as the pressure increases
13. Change in ion charge density around the filament with total pressure
14. Possible arcing between electrodes as the pressure increases.

The parameters that are most commonly adjusted during operation at different pressures include (but are not limited to):

1. Electron Emission current
2. Filament Repeller bias voltage
3. RF Vpp amplitude
4. Exit Plate bias voltage
5. Electron Multiplier bias voltage
6. Mass Axis Calibration parameter
7. Scan Speed.

Electron Emission Current: Operation at Ultra High Vacuum (UHV) levels requires an increase in electron emission current relative to operation under standard High Vacuum (HV) levels in order to achieve high signal levels and increased SNRs. At UHV levels, the trap does not fully saturate with charge and the ion signals in the spectrum tend to track the total pressure in the system. As the pressure increases, the signal intensities in the mass spectrum eventually reach a plateau as the trap becomes saturated with charge (i.e. the trap is full). To increase the ion signals at UHV levels, and achieve optimal SNRs, it is necessary to decrease the scanning rate and/or increase the electron emission current. As the pressures reach levels close to 1E−5 Torr it is generally observed that it is convenient to reduce the electron emission current in order to improve the SNR in the signal. Increases in noise floor levels are generally seen as the total pressure increases and a reduction in the electron emission current often alleviates the problem. The electron emission current also has a role in the control of baseline offset signals (see below). The electron emission setting affects filament temperature and as such has an impact on filament lifetime and analyte decomposition at the filament. Reducing the emission current at high pressures also increases filament lifetime and reduces the production of byproducts through thermal decomposition at the filament surface.

Filament Repeller Voltage: A repeller is often located behind the hot filament to focus the electron beam and improve the coupling of the electron beam into the trap volume. The use of repellers is very common in off axis ionization sources where tight coupling requirements are usually in place. The filament repeller voltage is a function of electron energy, filament bias, and electron emission current. The repeller voltage needs to be optimized at each new emission current in order to achieve optimal SNRs. Since emission current needs to be adjusted with pressure, so does the filament repeller voltage. Repeller voltage directly affects the coupling of electrons into the trap, and as such, it affects signal intensity, SNR, and peak shape.

RF Amplitude: The RF $V_{pp}$ amplitude is a critical parameter in ART MS traps. Operation of an ART MS sensor with an RF $V_{pp}$ too close to threshold can lead to loss of signal as the ion population increases with increasing pressure, and the effective RF field inside the trap drops below threshold. In general the RF $V_{pp}$ amplitude required to obtain consistent SNR levels in an ART MS trap increases with pressure. An increase in RF $V_{pp}$ generally causes an increase in ion signal with a decrease in mass resolution. In general, the RF $V_{pp}$ values need to be adjusted if trap operation is adjusted at the 1-2 E−7 Torr value and pressure reaches close to 1E−5 Torr levels. The increase in RF $V_{pp}$ at higher pressures generally produces a decrease in mass resolution that is generally offset by the large gains in SNR. The RF $V_{pp}$ levels have to be carefully balanced since superharmonics might affect the spectra. The user must decide the best balance between SNR, mass resolution and superharmonic contributions. An increase in RF $V_{pp}$ amplitude is generally the best way to improve the SNR in spectra collected at or above 1E−5 Torr. An increase in RF $V_{pp}$ amplitude is also required to keep signals constant if an increase in exit plate voltage takes place (see below.)

Exit Plate Bias Voltage: In most ART MS traps, an increase in baseline offset signal is observed as pressure increases. The problem is most serious with on-axis ionization and less significant in off-axis ionization sources. In order to decrease the amplitude of the baseline offset signal the exit plate voltage must be increased, and moved closer to the entry plate voltage. ART MS traps typically operate with the entry plate biased slightly positive relative to the exit plate. However, higher exit plate voltages are generally preferred as the pressure increases. There is a clear interplay between the exit plate voltage and the RF $V_{pp}$ values and the user must be careful during parameter selection to optimize SNR, reduce baseline offset and keep the superharmonics in check. The increase in baseline is caused by non-confined ions exiting the trap. Another approach that has been useful to reduce baseline offset at increasing pressures is to reduce the emission current.

Mass Axis calibration Parameter: As the pressure in an ART MS trap increases it is not unusual to see changes in peak positions in the mass spectra. Subtle changes are caused by changes in the charge density inside the trap. Changes in mass axis calibration are also expected as the voltages inside the trap are modified. Users must have calibration parameters that match the trap operational parameters at each pressure or pressure range.

Electron Multiplier (EM) Voltage: As the pressure in the system increases it is possible to see increased noise from the electron multiplier due to ion feedback. Good quality electron multipliers with ion feedback compensation will be less susceptible. On the flipside, as the signal amplitude (i.e. trap ion output) decrease with pressure it might be necessary to increase multiplier gain to improve SNR. An increase in EM voltage generally leads to a reduction in EM lifetime, but might be required to preserve SNR levels.

Scan Speed: At higher pressures it often makes sense to scan at higher scan rates. Higher scan rates result in lower charge density inside the trap and can reduce the effects of noise and baseline offset on signal. Since higher scan rates increase the RF $V_{pp}$ thresholds, this adjustment is usually followed by a comparable adjustment of RF signal levels. Higher scan rates at higher pressures are also consistent with the idea that ions have shorter residence times in a trap as the pressure increases.

Protection Modes: As the pressure increases it might be useful to carefully control the rate at which bias voltage is increased in the Electron Multiplier and the Transition Plate when the unit is first turned on. In general, sudden increases in bias voltage are known to cause more arcs than slower increases at higher pressures.

As the pressure increases it might be useful to set maximum pressure values—i.e. thresholds—below which the user is comfortable operating the EM and the filament. The user can also set time delayed triggers that shut down the ART MS sensor if the pressure remains above the threshold for a prespecified amount of time. This functionality is useful in order to minimize sensor shutdowns in the presence of brief pressure transients that cannot damage the unit.

Filament and EM protection modes and thresholds might also be species dependent since the filament will be more sensitive to certain species than others.

Characteristics of the Anharmonic Resonant Ion Trap

The nature of the ART MS device is to rapidly fill with ions from a sample of gas to be analyzed, with each gas component oscillating at its own resonant frequency. The energy requirement to selectively eject a sequence of m/q ions is very small and can be done using low-power electronic signals. This enables the trap in FIG. 1 to complete a 300 amu range scan within 200 ms or a 100 amu range scan in less than 70 ms. This scan rate is much faster than the typical 1-2 second 100 amu scan speed associated with typical residual gas analyzers (RGA) based on quadrupole mass spectrometry. This speed advantage can be used in two ways; (1) as an ultra-fast measurement instrument in closed-loop control system, and (2) for additional measurement averaging to improve signal-to-noise ratio for trace level contamination control. The combination of high sensitivity and high speeds makes ART MS devices ideally suited for fast closed-loop process control based on compositional analysis. There are indeed a few commercially available quadrupole mass spectrometers capable of scan speeds comparable with ART MS. However, such high-performance systems are very large, require bulky electronics and are very expensive to purchase and maintain. A well recognized advantage of ART MS sensors including total pressure measurement capabilities (i.e., as the embodiment of FIG. 1) is their ability to deliver both total and partial pressure information in real time and from a simple and small package which does not take any more room in a vacuum port than a traditional ionization gauge.

Electrostatic repulsion between ions in the oscillating beam leads to space charge limitations which ultimately fixes the density of charge that can be stored in the ART MS device, and is related to the length (L) and diameter (D)—a larger trap can store more ions and a smaller trap can store fewer ions. This property is largely pressure independent and the amount of charge stored within the trap is relatively constant over its usable range, and therefore the performance of the trap is more consistent over its usable range. Therefore, the speed and sensitivity advantage of the ART MS relative to a quadrupole MS increases with decreasing pressure because the quadrupole MS requires additional scan time to pass additional charge through the mass filter. An additional advantage of the typical ART MS device is that the small size has less surface area that is exposed to vacuum than most full range quadrupole devices, which minimizes vacuum surface and process memory effects.

Another characteristic of the ART MS fast scanning speed is that the sampled data better represents the gas components at the time of measurement if the gas components are rapidly changing. The fast scan rates provide a more accurate "point measurement" of the sample gas that enables the ART MS to better capture transient events, especially in the UHV pressure ranges. Surface science experiments and the detection of pressure bursts due to faulty vacuum valve operation are examples of applications that can take advantage of the "point measurement" capabilities of an ART MS device.

Because ART MS devices store a fixed amount of charge, the sensor is intrinsically a ratiometric device, where the maximum ion charge is a fixed 100% and the gas component partial pressures represent a portion of the 100%. In many applications where concentrations need to be tracked and reported, ratiometric information is preferred over absolute partial pressure information and is a native output of the ART MS device. Where absolute partial pressure information is needed, the output of an ART MS trap can be easily scaled using total pressure information to provide partial pressure outputs.

The low drive and operating power requirements of the ART MS device allows the sensor head to be operated at the end of a cable or integrated into a modular form (integrated electronics and sensor). Most quadrupole-based instruments require a close physical and electrical coupling of the RF drive electronics with the quadrupole sensor and are only available in the modular form (i.e., no cable between gauge and controller). For the ART MS device, a cable can be used to connect to the drive electronics. Combining the ability for remote cable operation, the small size of the ART MS device and the ability for a smaller electronics packaging of an ART MS based system provides additional flexibility for installation on crowded vacuum tools.

The mass specific oscillation frequency of the ART MS device is largely dependent upon the physical dimensions of the ion trap and the amplitude of the trapping potential, and is not dependent on the drive electronics. Therefore, once the extraction conditions for a single m/q are known, then all other m/q can be calibrated to the single gas. This allows for a rapid and easy single point calibration based upon gauge manufacturing dimensional control or through a single gas calibration. For example, detecting a water peak (18 amu) in the ART MS device allows for full calibration of the entire 1-300 amu range. This is an important ease-of-use benefit for both newly manufactured and field supported equipment.

Many quadrupole mass spectrometry devices cannot accurately measure below 2-to-4 amu due to zero blast limitations; therefore a quadrupole's 1-300 amu range is more accurately a 2-300 amu or even a 4-300 amu range in some cases. ART MS, by design, does not have the zero blast effects and can fully resolve all the lower amu peaks at full sensor resolution. Therefore, a permanently installed ART MS device could easily be used as an in-situ helium leak detector, in portable leak detector applications and as an efficient isotopic ratio mass spectrometer. A very exciting opportunity provided by ART MS traps is the ability to monitor both atomic and molecular hydrogen at masses of one and two amu, respectively.

ART MS sensors are often compared against RGAs based on quadrupole mass analyzers which typically operate in constant mass resolution mode. The throughput of quadrupole mass filters is mass dependent. As the mass of the ions increases, their radial oscillation amplitudes increase and more ions are lost to collisions with the rods. As a result, quadrupole mass spectrometers lose sensitivity as the mass of the ions increases. ART MS stores all ions inside the trap and preserves the relative concentrations of the ions during ejection, providing a more accurate representation of gas concentrations for the sample gas. ART MS sensors are expected to provide a much more accurate representation of hydrogen levels in ultra high and extreme high vacuum experiments. ART MS sensors are expected to find applications as fullness detectors for cryogenic pumps indicating the need to regenerate the cold arrays based on subtle changes in the gas composition of the residual gases emerging from the cryogenically cooled surfaces.

ART MS sensors do not technically have an upper mass limitation, or mass range. In fact, ART MS traps have been shown to provide mass information well above the 600 amu range. However, most volatile chemical substances have a molecular weight below 350 amu and the electronics and data acquisition software is typically limited to a mass range of 300 amu to support the most common gas sampling applications. ART MS devices with higher molecular weight ranges are expected to find use in more sophisticated applications including specialized ion sources or tandem mass spectrometry.

ART MS technology has demonstrated immense potential for a large variety of research and industrial processing applications. The combination of (1) low power requirements, (2) small size, (3) ease-of-assembly, (4) ease-of-use and (5) high resolving power makes ART MS technology ideal for field applications relying on battery, solar and other-alternative power sources. ART MS devices packaged into self-contained, field-deployable gas sampling units (i.e., integrating low power high vacuum pumping systems) can be used in atmospheric, aerospace, underwater, harsh environment, and homeland security gas sampling applications. Miniaturization of ART MS trap designs has the potential to provide the first truly palm-portable, fast gas analysis devices for both military and forensic applications featuring unprecedented operational times between battery charges. Large ART MS traps, with higher upper mass range limits, are expected to find their way into biological sampling applications in combination with specialized ionization schemes such as DART, DESI, MALDI, ESI, FARPA, SIMS, etc. ART MS traps will very likely find applications in combination with separation techniques (such as gas and liquid chromatography) as well as competitive mass spectrometry techniques (such as time-of-flight systems, quadrupoles, magnetic sectors and even orbitraps) and ion mobility spectrometers. Combination sensors including multiple pressure gauges as well as an ART MS trap are expected to become the new standard for gas analysis and vacuum quality measurement in high vacuum (HV) and ultrahigh vacuum (UHV) systems and for industrial applications including semiconductor processing, solar panel manufacturing, thin-film coating and etching. ART MS traps will also find applications as tunable ion sources, ion storage devices, ion steering devices, ion chemical reactors and ion filters. Further development of alternative detection schemes, such as the power absorption schemes described herein, are also expected to provide new methodologies to develop a new generation of specific-gas sampling systems dedicated to the analysis of single gases in real time while providing unprecedented reliability and low maintenance performance. Pulsed operation, in combination with external ion introduction schemes, will provide the ability to manipulate ions on their way to much larger and complex tandem mass spectrometry systems as well as enabling the development of preconcentration schemes compatible with ultratrace gas analysis requirements. For example, it is possible to imagine the addition of an ART MS trap into a MALDI source to separate matrix ions from the biological ions of interest and/or to preconcentrate biological molecules prior to delivery to a time-of-flight source. The high resolving power of ART MS traps at low masses (i.e., less than 10 amu) is expected to result in the application of the technology to leak detectors as well as low-mass isotopic ratio mass spectrometry. ART MS traps combined with sensitive charge detectors are expected to become the new standard for field deployable isotopic ratio mass spectrometry. The fast speed of ART MS devices, combined with their ability to perform measurements at the point of interest, is expected to revolutionize the field of mass spectrometry for surface science and catalysis. The development of alternative photoionization and electron impact ionization schemes, including cold electron emitters such as electron generator arrays, spyndt-like emitter arrays and carbon nanotube emitters is expected to reduce the power requirements of ART MS sensors further, improving their compatibility with low power requirements.

For standard high vacuum system monitoring applications, ART MS sensors can be used to monitor base pressure conditions at unprecedented sampling rates and without significant space requirements. ART MS devices can be used to monitor base pressure conditions, diagnose pumpdown problems, perform leak detection procedures and characterize pumpdown rates. The relative low cost of ART MS devices is expected to justify the replacement of each and every ionization gauge presently installed in a high or ultrahigh vacuum system with a combination gauge including both total and ART MS partial pressure capabilities. The standard gauge/ECU architecture for ART MS devices used in our laboratory includes the gauge (transducer) connected to the controller (ECU) using a cable. The transducer connects to a standard vacuum port while the ECU is placed somewhere else in the system without interfering with other components attached to the vacuum chamber. Another preferred implementation includes an ART MS sensor of reduced dimensions with the ECU permanently attached to the transducer's envelope to provide a monolithic/modular device of small physical dimensions and simplified operation. The information provided by the mass spectrometer system can be displayed as raw mass spectrometry data on a remote computer display or, if available, the necessary information can be extracted from the spectra, processed according to user's scripts and displayed on a graphical front panel display incorporated directly into the ECU. The partial pressure information can also be linked to one or many different analog, digital and relay-closure I/O ports located on the back plane of the controller to provide real-time process control.

For process applications, ART MS sensors provide unprecedented sampling rates combined with unobtrusive mounting configurations and point-of-use capabilities. Use cases compatible with ART MS include: (1) fixed volume sampling, (2) package/hermeticity testing, (3) transient response detection, (4) concentration control, and (5) process fingerprinting. ART MS sensors are expected to find immediate application in all regions of modern semiconductor ion implantation tools where careful control of gas composition is not only critical to assure wafer cleanliness, but also to assure proper dose delivery. ART MS devices are expected to provide real-time prompts for preventative maintenance based on changes in gas composition, as well as post-preventive maintenance (post-PM) system readiness analysis. ART MS traps will find applications in modern implantation cluster sources providing the ability to separate labile parent cluster ions from their fragments before delivery. ART MS devices will also find application in semiconductor PVD processes where interwafer times can be significantly reduced if gas compositional analysis is available between wafer process steps and photoresist contamination can be a big problem if undetected. ART MS traps are also expected to find application in the fast cycling processes used for magnetic media disk manufacturing. Typical cycle times for disk manufacturing steps are as short as 3 seconds, with the pressure of the chambers oscillating between medium to high vacuum during each cycle. ART MS devices provide the first opportunity to perform real time analysis of gas composition simultaneously controlling (1) pump down rates, (2) gas mixture ratios and (3) cross contamination between chambers. Process applications often require real-time, digital and/or analog output signals in order to close control loops based on partial pressure information. ART MS ECU controllers will generally include multiple I/O options including: (1) digital I/O, (2) analog I/O and (3) relay closure I/O and well as (4) standard communication ports such as USB, Ethernet, Device Net and RS485.

In one embodiment, a test instrument provides multiple sets of information to multiple independent computer host applications by incorporating a multi-client connection hierarchy into the test instrument (i.e., Ethernet Transmission Control Protocol/Internet Protocol [TCP/IP] network, direct serial, universal serial bus, and/or other test instrument-to-host data connections). In this way, the test instrument can be connected to a primary host connection (i.e., a process tool) performing functions requested by the primary host, while a separate application (i.e., advanced process control software) can collect the same or a different set of data, and a third application (i.e., maintenance application software) can collect the same or a different set of data or instrument status.

This is a powerful concept, where the test instrument can be used for the primary purpose of material processing using the primary host application and a second application (independent of the first application) can be connected to the test instrument and collecting data that allows for the detection of a specific contaminant or vacuum leak.

Figure 38:
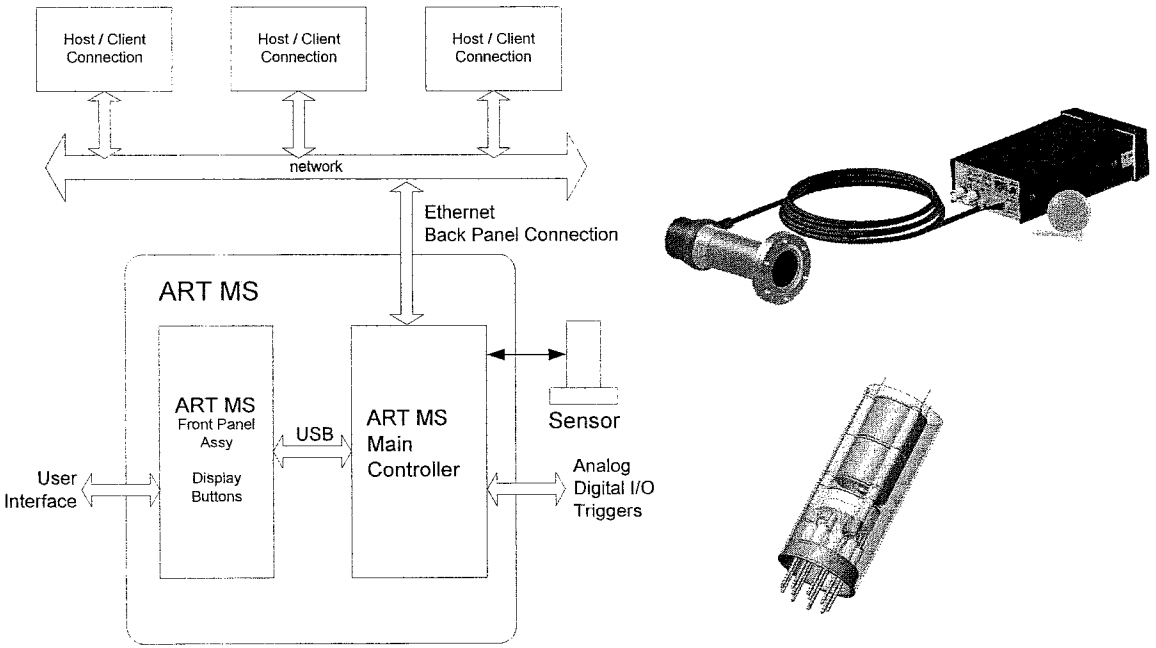
FIG. 38 is an illustration of an ART MS system.

FIG. 38 shows the concept of the ART MS trap connected to a network via an Ethernet TCP/IP connection to three (or more) Host/Client connections. The ART MS is a high performance test instrument that provides total pressure and partial pressure measurement information/data made by the ART MS sensor (right hand side of FIG. 38) that is connected to a vacuum system or chamber. The ART MS test instrument has a Controller, Sensor and cable. On the Controller there is a front panel User Interface (display and buttons, not shown) and on the back panel a variety of input and output electrical signal connections, setpoint relays, a Universal Serial Bus (USB) data connection and an Ethernet data connection. The ART MS has the ability to process the sensor's vacuum measurements into a plurality of measurement output formats that are accessed via the electrical signal connections, setpoint relays, or by external host connections to the USB and/or Ethernet data interfaces using an Application Programmer Interface (API) set of computer functions.

The ART MS will include an Ethernet connector and one USB-2 connector. Devices connected to any of these connectors will control (as Master) or access data (as Monitor) the ART MS via device-specific commands and replies. The data communications will be the payload of an Ethernet frame or USB data packets. The Ethernet and one USB-2 connector are located on the ART MS back panel. The ART MS will support multiple client connections as data Monitors, however only one device can be the ART MS Master.

The ART MS has a user-level hierarchy:

Administrator: This is a special level of user (see below) that can preempt any Master (if an Administrator registers as Master), control all functions of the ART MS device through the standard and an extended API, and has access to reserved information. Note that it is possible to register as an Administrative Master or an Administrative Monitor. Only the Administrative Master registration will preempt an existing Master. Administrative Monitors can access restricted data, but not control the gauge.

Master: This level of user can configure the sensor driver and data collection parameters and allow or lock out the front panel buttons and display. There is only one Master at a time. When a client tries to register as a Master and one already exists, the registration fails or the registration preempts the existing Master (forcing it to a Monitor registration).

Monitor: This level of user can retrieve collected data via the API, but can not change the way data is collected or the configuration of the ART MS.

These user-levels allow one Master to drive the ART MS and many data and/or maintenance Monitors. The Administrator allows for maintenance and support access to ART MS functions independent of the prior hosts connections.

The ART MS front panel assembly (FPA) consists of a graphic display and buttons and is connected to the ART MS via a dedicated front panel connector. The front panel can be mechanically attached to the ART MS. In this connection scheme the FPA is a host connection and is the Master in the ART MS power-up or post reset state. When the ART MS is used with other host connections through the back panel USB or Ethernet connections, the FPA can be the Master or a Monitor. The only exception is the IG OFF button which has priority over both a Master or Monitor host connections.

Figure 39:
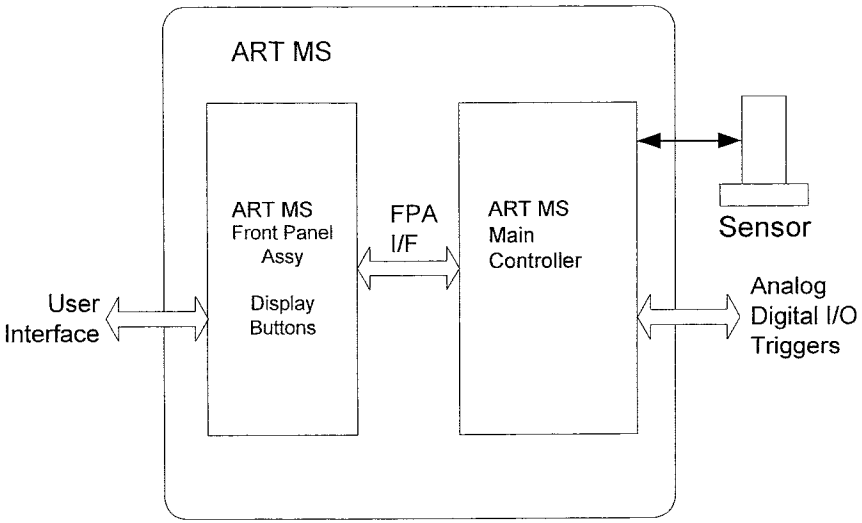
FIG. 39 is an illustration of an ART MS standalone configuration where the front panel assembly is the Master.

In the standalone application shown in FIG. 39 the Front Panel Assembly (FPA) controls all the functions, scanning parameters and input/output assignments on the ART MS. The FPA has two display modes:

1. For monitoring select variables (e.g., selected relative partial pressures and/or partial pressures).

2. For monitoring the trend of a select variable (e.g., a RPP, PP, or total pressure).

The FPA also allows the user to configure all the data collection parameters and input/outputs assignments via menu screen. FIG. 39 shows the FPA attached to the ART MS Main Controller via a dedicated FPA interface connection.

Figure 40:
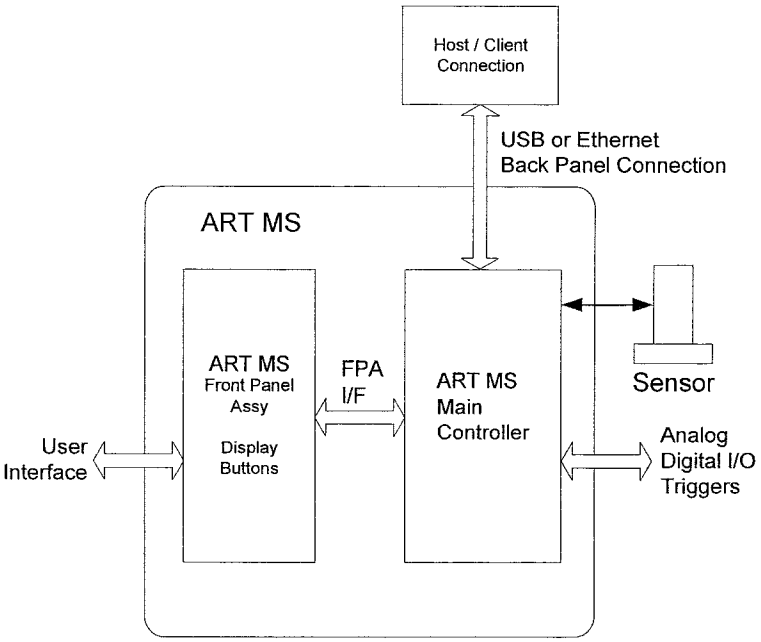
FIG. 40 is an illustration of an ART MS with a single (external) host configuration.

FIG. 40 shows the ART MS with a single externally connected host. A common configuration would be a PC as the Host/Client and connected via USB, where the PC is the Master and the FPA performs a monitor function. There are three options:

1. The PC/Host Master controls and configures the ART MS and the information that is displayed on the Front Panel (this is anticipated to be the most common configuration).

2. The PC/Host Master controls and configures the ART MS. The FPA display is controlled by the PC/Host Master or by selection from the front panel "monitoring" function. If the FPA display is controlled by the front panel button(s), a timeout automatically returns the FPA display control to the Master upon the next Master display update.

3. The PC/Host is a monitor only to collect data or monitor the performance of the ART MS.

TABLE 2

Master & Monitor Functions for the Single Host Connection Example

| Front Panel | Host/Client | Buttons | Display | Inputs/Outputs |
|---|---|---|---|---|
| Monitor | Master | Filament Only | Follows Master | Follows Master |
| Monitor | Master | Display Mode and Filament Only | Master or Monitor (Master may program a timeout) | Follows Master |
| Master | Monitor | Enabled | Follows Master | Follows Master |

Figure 41:
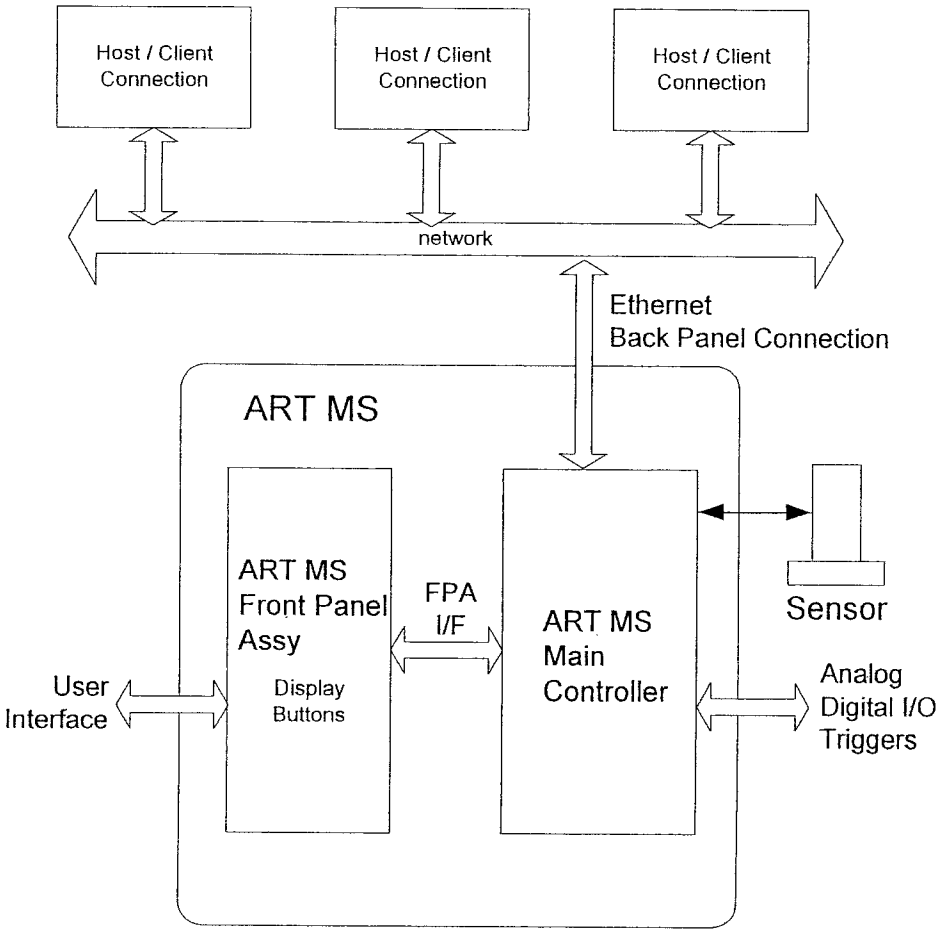
FIG. 41 is an illustration of an ART MS with a network host configuration.

FIG. 41 shows the ART MS with a network of externally connected host applications. A common configuration would be a group of application specific PC/Servers collecting information during manufacturing. In this configuration, only one of the PC/Servers is the Master, which in many cases would be the process tool or tool controller, and the other PC/Servers are collecting information for advanced process control and/or recipe management. The Master configures and controls the ART MS. The other PC/Servers collect information from the ART MS through API polling or publish/subscribe. There are two options:

1. The PC/Server Master controls and configures the ART MS and the FPA display information (this is anticipated to be the most common configuration)

2. The PC Master controls and configures the ART MS. The FPA display information is controlled by the Master or by selection from the front panel "monitoring" function. If the FPA display is controlled by the front panel button(s), a timeout automatically returns the FPA display to be controlled by the master upon the next master display update.

Figure 42:
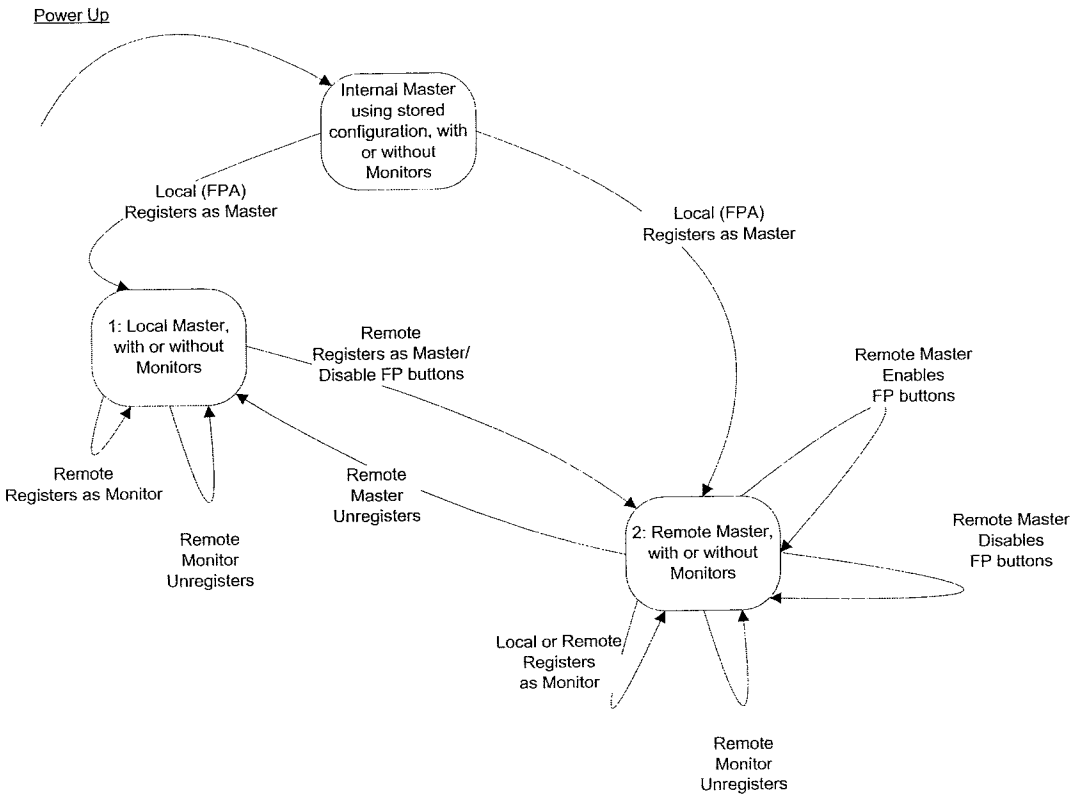
FIG. 42 is an illustration of a local/remote state transition diagram.

FIG. 42 shows the state transitions from local (FPA) and remote (host) control with respect to Master and Monitor control for the ART MS. The Power-Up (Reset state) (0) is where the controller initialization occurs. Until another Master registers, the internal stored program is the controller. (1) is where the FPA is the "Local Master", there is no remote connection established or any remote connections are Monitors, the FPA display is under the control of the FPA, and all the FPA buttons are enabled. Here the FPA control function is running a small application to display the contents and to pull the necessary FPA data via API calls to the ART MS Main Controller. (2) is where the remote client is the Master. The Local Master is preempted and forced into a Monitor state. The FPA display is under control of the remote Master and the FPA buttons are disabled (the filament on/off button remains enabled for safety reasons).

The multiple connection concept is not unique to ART MS, and other instrumentation can benefit from this multiple host/client connection approach. The ART MS provides a rich data set of multiple types of measurements (total pressure, partial pressure, relative partial pressure) that can be used in a large variety of ways by different applications. However other instruments that provide a more simple data type output (like total pressure) can use this same approach where the primary host connection can be the process tool and a secondary host connection is a supplier-provided service application that monitors the instrument's parameters to predict service requirements or store data into a database.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. An ion trap comprising:

an electrode structure, including first and second opposed mirror electrodes and a central lens therebetween, that produces an electrostatic potential in which ions are confined to trajectories at natural oscillation frequencies, the confining potential being anharmonic; and an AC excitation source having an excitation frequency $f$ that excites confined ions at a frequency of about twice a natural oscillation frequency of the ions, the AC excitation source being connected to the central lens.

2. The ion trap of claim 1, further including a scan control that sweeps the AC excitation frequency.

3. The ion trap of claim 2, wherein the scan control sweeps the AC excitation frequency f at a sweep rate in a direction from an excitation frequency higher than twice the natural oscillation frequency of the ions.

4. The ion trap of claim 2, wherein the scan control sweeps the AC excitation frequency f at a sweep rate in a direction from an excitation frequency lower than twice the natural oscillation frequency of the ions.

5. The ion trap of claim 4, wherein the sweep rate is set such that $d(1/f^n)/dt$ is about equal to a constant and n is greater than zero.

6. The ion trap of claim 5, wherein n is approximately equal to 1.

7. The ion trap of claim 2, wherein the scan control sweeps a magnitude V of the electrostatic potential at a sweep rate in a direction such that twice the natural oscillation frequency of the ions changes from a frequency lower than the frequency of the AC excitation source.

8. The ion trap of claim 2, wherein the scan control sweeps the magnitude V of the electrostatic potential at a sweep rate in a direction such that twice the natural oscillation frequency of the ions changes from a frequency higher than the frequency of the AC excitation source.

9. The ion trap of claim 1, wherein the first opposed mirror electrode of the electrode structure includes a) a first plate-shaped electrode with at least one aperture, located off-axis with respect to an axis of the opposed mirror electrode structure; and b) a second electrode shaped in the form of a cup, open towards the central lens, with a centrally located aperture; and the second opposed mirror electrode of the electrode structure includes i) a first plate-shaped electrode with an axially located aperture; and ii) a second electrode shaped in the form of a cup, open towards the central lens, with a centrally located aperture; and the central lens is plate-shaped and includes an axially located aperture.

10. The ion trap of claim 1, configured as a mass spectrometer, further including an ion source that includes at least one electron emissive source that creates ions by electron impact ionization of a gaseous species, and an ion detector.

11. The ion trap of claim 10, wherein the at least one electron emissive source is a hot filament.

12. The ion trap of claim 10, wherein the at least one electron emissive source is a cold electron emissive source.

13. The ion trap of claim 10, wherein the at least one electron emissive source is located off-axis relative to the electrode structure.

14. The ion trap of claim 13, wherein electrons generated by the at least one electron emissive source are injected at an angle of between about 20 degrees and about 30 degrees away from an axis normal to an axis along the electrode structure.

15. The ion trap of claim 10, wherein the ion detector is a charge-sensitive transimpedance amplifier.

16. The ion trap of claim 10, wherein the ion detector detects ions by measuring the amount of RF power absorbed from the AC excitation source as the AC excitation source frequency varies.

17. The ion trap of claim 10, wherein the ion detector detects ions by measuring the change in electrical impedance of the electrode structure as the AC excitation frequency varies.

18. The ion trap of claim 10, wherein the ion detector detects ions by measuring the current induced by image charges as the AC excitation frequency varies.

19. The ion trap of claim 10, wherein the ion detector detects ions by measuring the amount of RF power absorbed from the AC excitation source as the magnitude of the electrostatic potential varies.

20. The ion trap of claim 10, wherein the ion detector detects ions by measuring the change in electrical impedance of the electrode structure as the magnitude of the electrostatic potential varies.

21. The ion trap of claim 10, wherein the ion detector detects ions by measuring the current induced by image charges as the magnitude of the electrostatic potential varies.

22. An ion trap comprising:

an electrode structure that produces an electrostatic potential in which ions are confined to trajectories at natural oscillation frequencies, the confining potential being anharmonic;

an AC excitation source, connected to the electrode structure, having an excitation frequency that excites confined ions at a frequency that is about an integer multiple of natural oscillation frequency of the ions;

nonvolatile memory storing control parameters; and control electronics operatively connected to the AC excitation source and to the electrode structure, the control electronics controlling the AC excitation source and the electrostatic potential using the control parameters.

23. The ion trap of claim 22, wherein the nonvolatile memory and control electronics are integrated with the electrode structure.

24. The ion trap of claim 22, wherein the control parameters include configuration and calibration parameters and sensitivity factors, or any combination thereof.

25. The ion trap of claim 24, wherein configuration parameters include magnitudes of electrostatic potentials applied on the electrode structure that produce the electrostatic potential in which ions are confined, and amplitude and frequency settings for the AC excitation source, calibration parameters include voltage and current input and output calibration parameters of the ion trap, and sensitivity factors include a conversion factor from natural frequency of oscillation of ions to ion mass-over-charge (m/q) ratio.

26. The ion trap of claim 22, wherein the excitation frequency excites confined ions at a frequency of about twice the natural oscillation frequency of the ions.

27. A method of trapping ions in an ion trap comprising:

producing an anharmonic electrostatic potential in which ions are confined to trajectories at natural oscillation frequencies, in an electrode structure that includes first and second opposed mirror electrodes and a central lens therebetween; and exciting confined ions at a frequency of about twice the natural oscillation frequency of the ions with an AC excitation source having an excitation frequency f, the AC excitation source being connected to the central lens.

28. The method of claim 27, further including the step of scanning the excitation frequency of the AC excitation source.

29. The method of claim 28, wherein scanning the excitation frequency is performed at a sweep rate from an excitation frequency higher than about twice the natural oscillation frequency of the ions, to mass selectively achieve autoresonance as the frequency difference approaches zero.

30. The method of claim 28, wherein scanning the excitation frequency is performed at a sweep rate from an excitation frequency lower than about twice the natural oscillation frequency of the ions.

31. The method of claim 30, wherein the sweep rate is set such that $d(1/f^n)/dt$ is about equal to a constant and n is greater than zero.

32. The method of claim 31, wherein n is approximately equal to 1.

33. The method of claim 28, wherein scanning the excitation frequency includes the step of sweeping a magnitude V of the electrostatic potential at a sweep rate in a direction such that twice the natural oscillation frequency of the ions changes from a frequency lower than the frequency of the AC excitation source.

34. The method of claim 28, wherein scanning the excitation frequency includes the step of sweeping a magnitude V of the electrostatic potential at a sweep rate in a direction such that twice the natural oscillation frequency of the ions changes from a frequency higher than the frequency of the AC excitation source.

35. The method of claim 27, wherein the first opposed mirror electrode structure includes a first plate-shaped electrode with at least one aperture, located off-axis with respect to an axis of the opposed mirror electrode structure and a second electrode shaped in the form of a cup, open towards the central lens, with a centrally located aperture, and the second opposed mirror electrode structure includes a first plate-shaped electrode with an axially located aperture and a second electrode shaped in the form of a cup, open toward the central lens, with a centrally located aperture, and the central lens is plate-shaped and includes an axially located aperture.

36. The method of claim 27, further including using an ion source that includes at least one electron emissive source that creates ions by electron impact ionization of a gaseous species, and an ion detector, configured as a mass spectrometer.

37. The method of claim 36, wherein the at least one electron emissive source is a hot filament.

38. The method of claim 36, wherein the at least one electron emissive source is a cold electron emissive source.

39. The method of claim 36, wherein the at least one electron emissive source is located off-axis relative to the electrode structure.

40. The method of claim 39, wherein electrons generated by the at least one electron emissive source are injected at an angle of between about 20 degrees and about 30 degrees away from an axis normal to an axis along the electrode structure.

41. The method of claim 36, wherein the ion detector is a charge-sensitive transimpedance amplifier.

42. The method of claim 36, wherein the ion detector detects ions by measuring the amount of RF power absorbed from the AC excitation source as the AC excitation source frequency varies.

43. The method of claim 36, wherein the ion detector detects ions by measuring the change in electrical impedance of the electrode structure as the AC excitation frequency varies.

44. The method of claim 36, wherein the ion detector detects ions by measuring the current induced by image charges as the AC excitation frequency varies.

45. The method of claim 36, wherein the ion detector detects ions by measuring the amount of RF power absorbed from the AC excitation source as the magnitude of the electrostatic potential varies.

46. The method of claim 36, wherein the ion detector detects ions by measuring the change in electrical impedance of the electrode structure as the magnitude of the electrostatic potential varies.

47. The method of claim 36, wherein the ion detector detects ions by measuring the current induced by image charges as the magnitude of the electrostatic potential varies.

48. A method of trapping ions in an ion trap, comprising:

producing an anharmonic electrostatic potential in an electrode structure in which ions are confined to trajectories at natural oscillation frequencies;

exciting confined ions at a frequency of about an integer multiple of the natural oscillation frequency of the ions with an AC excitation source connected to the electrode structure and having an excitation frequency;

storing control parameters in nonvolatile memory; and controlling the AC excitation source and the electrostatic potential using the control parameters and control electronics operatively connected to the AC excitation source and to the electrode structure.

49. The method of claim 48, wherein the nonvolatile memory and control electronics are integrated with the electrode structure.

50. The method of claim 48, wherein the control parameters include configuration and calibration parameters and sensitivity factors, or any combination thereof.

51. The method of claim 50, wherein configuration parameters include magnitudes of electrostatic potentials applied on the electrode structure that produce the electrostatic potential in which ions are confined, and amplitude and frequency settings for the AC excitation source, calibration parameters include voltage and current input and output calibration parameters of the ion trap, and sensitivity factors include a conversion factor from natural frequency of oscillation of ions to ion mass-over-charge (m/q) ratio.

52. The method of claim 48, wherein the excitation frequency excites confined ions at a frequency of about twice the natural oscillation frequency of the ions.

* * * * *